US006269235B1

(12) United States Patent
Nishiyama

(10) Patent No.: US 6,269,235 B1
(45) Date of Patent: Jul. 31, 2001

(54) DEVELOPING APPARATUS FEATURING FIRST AND SECOND DEVELOPER BEARING MEMBERS EACH INCLUDING A NON-NEGATIVE MEMBER AND A COATING MEMBER COVERING THE NON-NEGATIVE MEMBER

(75) Inventor: Kazushige Nishiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/450,675

(22) Filed: Nov. 30, 1999

(30) Foreign Application Priority Data

| | | |
|---|---|---|
| Dec. 2, 1998 | (JP) | 10-343243 |
| Dec. 3, 1998 | (JP) | 10-343707 |
| Dec. 3, 1998 | (JP) | 10-343724 |
| Dec. 11, 1998 | (JP) | 10-353036 |

(51) Int. Cl.[7] ..... G03G 15/08; G03G 15/09
(52) U.S. Cl. ..... 399/267; 399/276
(58) Field of Search ..... 399/269, 276, 399/286

(56) References Cited

U.S. PATENT DOCUMENTS

| | | | | |
|---|---|---|---|---|
| 4,098,228 | * | 7/1978 | Ruckdeschel et al. | 399/269 |
| 5,630,201 | * | 5/1997 | Suzuki et al. | 399/269 |

* cited by examiner

*Primary Examiner*—Joan Pendegrass
(74) *Attorney, Agent, or Firm*—Fitzpatrick, Cella, Harper & Scinto

(57) ABSTRACT

The present invention relates to a developing apparatus which has an upstream developer bearing member for developing a latent image formed on an image bearing member and a downstream developer bearing member for developing a latent image on an image bearing member, and the downstream developer bearing member is provided downstream of the upstream developer bearing member in a moving direction of the image bearing member.

25 Claims, 36 Drawing Sheets

NEW TONER

120%

170%

220%

NEW TONER

120%

170%

220%

$$\Delta a = \frac{1}{\ell}\int_0^{\ell}\left|\frac{dy}{dx}\right|dx$$

$$= \left(\frac{h_1+h_2+h_3+\cdots+h_n}{\ell}\right)$$

DEVELOPING APPARATUS FEATURING FIRST AND SECOND DEVELOPER BEARING MEMBERS EACH INCLUDING A NON-NEGATIVE MEMBER AND A COATING MEMBER COVERING THE NON-NEGATIVE MEMBER

BACKGROUND OF THE INVENTION

1. Field of the Invention

The present invention relates to a developing apparatus that is used for a copier that employs an electrophotographic system, a laser beam printer, a facsimile machine, or a printing apparatus.

2. Related Background Art

There is available a conventional, well known image forming apparatus wherein an electrostatic latent image bearing member is uniformly charged and an electrostatic latent image is formed on the bearing member by analog exposure, or image exposure, using a semiconductor laser or an LED; wherein the electrostatic latent image is visualized as a developer image by a developing apparatus, and the developer image is transferred to a transfer material; wherein the transfer material is separated from the electrostatic latent image bearing member and is transmitted to a fixing unit; and wherein the developer image is fixed to the transfer material by the fixing unit and the obtained transfer material is output as an image.

The image forming processing will now be described while referring to FIG. 14.

FIG. 14 is a cross-sectional view of the essential portion of an image forming apparatus. The image forming apparatus includes a photosensitive drum 1 as an electrostatic latent image bearing member. A photoconductive layer, such as OPC or a-Si, is deposited on the surface of the photosensitive drum 1 and the drum 1 is rotated in the direction indicated by an arrow A. The surface of the photosensitive drum 1 is uniformly charged to −700 V, for example, by a primary charger 3. Then, image exposure process 12 is performed in accordance with image signal information to attenuate to −200 V, for example, the surface potential of the exposed portion of the photosensitive drum 1, and to form thereon a latent image consonant with an image signal. It should be noted that a semiconductor laser or an LED array is used for the image exposure process 12.

The latent image is developed by a developing unit 2, a dry, one-component developing unit, and is visualized as a toner image. Since the developing unit 2, which uses the dry, one-component developer, is simple and no carrier replacement is required, its durability is excellent and it has a long service life. As the development method, jumping development, which uses a one-component magnetic toner, for example, is employed.

The developing unit 2 employs black, negatively charged toner that, following the application, during the development process, to the developer bearing member of a DC bias of about −500 V as a developing bias, is used to develop a reversed latent image that is visualized as a toner image. The pre-transfer process (normally performed in conjunction with a DC or an AC corona application or a charge elimination process) is performed using a charger 10, as needed, and the toner image is transferred by a transfer charger 4 from the photosensitive drum 1 to a transfer material adhering thereto. The transfer material bearing the toner image is then transmitted to a fixing unit 7, which fixes the toner image to the transfer material. In this manner, a desired image is obtained. Thereafter, residual toner after transfer on the photosensitive drum 1 is removed by a cleaning unit 6, so that it is ready for the next image forming sequence.

Relative to increasing the processing speed of the image forming apparatus, since the developing unit employs a one-component developer and is rotated counterclockwise to limit the thickness of a layer, toner is rubbed heavily, so that even for the same toner the triboelectricity downstream is considerably higher than that upstream. Therefore, image development performed by the developing sleeve upstream differs from that performed by the developing sleeve downstream, so if a common developing bias is employed to reduce space and manufacturing costs, the development performance differs for each developing sleeve, making density control difficult. This phenomenon is contrary to the need for gradation (tone) of image and stability of the gradation that can cope with current digital images and graphics, and is especially apparent when a one-component magnetic toner is employed for which the strength of the charge applied is small and the development is poor.

With a sleeve that is not coated with SUS and the like, for example, a sleeve ghost image will occur, whereafter an image will appear at a sleeve pitch. Further, for a fast, image-forming apparatus, for which development time is shortened due to its high processing speed, and since a satisfactorily long development time is not provided, the development process is unstable and density fluctuation is increased.

SUMMARY OF THE INVENTION

It is, therefore, one objective of the present invention to provide a developing apparatus that can perform high quality image development using a plurality of developer bearing members.

It is another objective of the present invention to provide a developing apparatus that by equalizing the service lives of developer bearing members can eliminate much of the labor for which the services of a maintenance man are required, and can thus reduce maintenance costs.

It is an additional objective of the present invention to provide a developing apparatus that can resolve the differences between the development processes performed by various developer bearing members, so as to satisfy the need for image tones and tone stability that can cope with current digital images and graphics.

It is a further objective of the present invention to provide a developing apparatus that can prevent sleeve ghosts, and that can stabilize development and density relative to an increase in processing speed.

It is one more objective of the present invention to provide a developing apparatus, which comprises:

an upstream developer bearing member for developing a latent image formed on an image bearing member; and a downstream developer bearing member for developing the latent image on the image bearing member, wherein the downstream developer bearing member is provided downstream of the upstream developer bearing member in a moving direction of the image bearing member.

The other objectives and features of the present invention will become more apparent in due course, during the following detailed description, which is given while referring to the accompanying drawings.

DETAILED DESCRIPTION OF THE PREFERRED EMBODIMENTS

The preferred embodiments of the present invention will now be described while referring to the accompanying drawings.

<First Embodiment>

Figure 3:
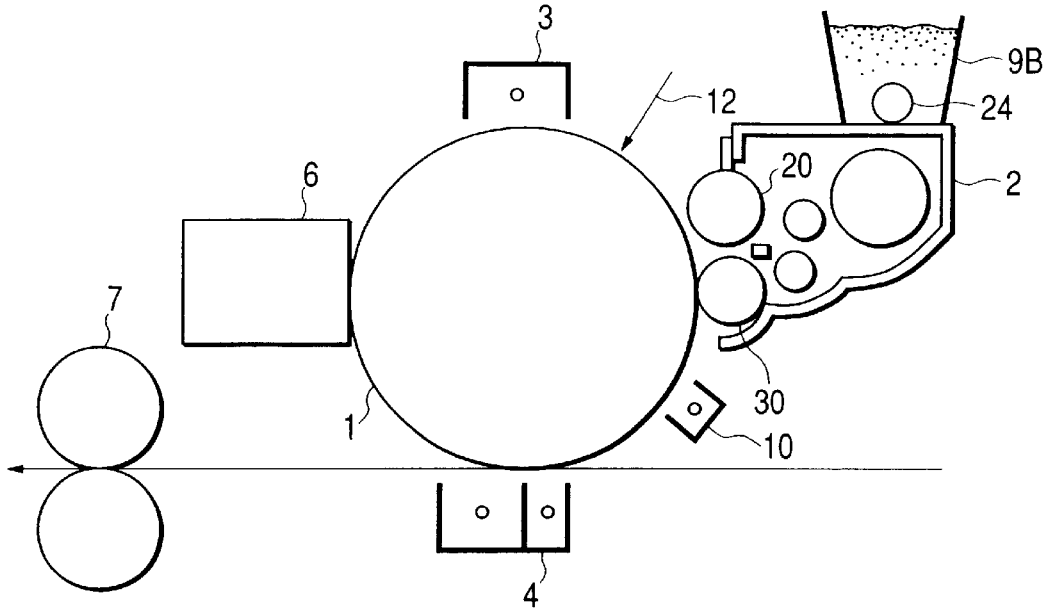
FIG. 3 is a cross-sectional view of the essential portion of an image forming apparatus, including the first developing apparatus of the present invention.

FIG. 3 is a cross-sectional view of the essential portion of an image forming apparatus that includes a developing apparatus according to the present invention. The image forming apparatus is a black and white digital copier that can output 92 sheets per minute at a processing speed of 460 mm/sec, and that employs, as a photosensitive member, an a-Si photosensitive drum 1 having a diameter ϕ of 108 mm. The relative dielectric constant of a-Si is approximately 10, which is greater than that of an organic photosensitive material, but the charge potential is relatively low and, when compared with OPC, a satisfactory latent image potential is not obtained. However, since a photosensitive drum 1 composed of a-Si is durable and has a service life of about 3 million sheets, it is appropriate for use in a high speed, image-forming apparatus.

The photosensitive drum 1 is uniformly charged to +500 V, for example, by a charger 3, and image exposure 12 is performed at 600 dpi. For the image exposure 12, a first laser beam is employed that is obtained by modulating a semiconductor laser source in accordance with a first image signal. The first laser beam is polarized by a polygon mirror that is rotated by a motor at a predetermined revolution speed, and the polarized beam passes through a focusing lens and is reflected by a return mirror. The reflected beam raster-scans the photosensitive drum 1, and the surface potential of the exposed portion is reduced to +100 V, for example, to form a latent image on the photosensitive drum 1. It should be noted that the wavelength of the laser beam is 680 nm.

Following this, the latent image formed on the photosensitive drum 1 is normally developed by a developing apparatus 2 and is visualized as a toner image. After the electrostatic latent image has been developed and visualized as a toner image by the developing apparatus 2, a post charger 10 supplies a total current (AC+DC) of −200 μA and charges the toner image. The toner image is then transferred by a transfer charger 4 to a transfer material that is fed in the direction indicated by an arrow, and the transfer material bearing the toner image is conveyed to a fixing unit 7 where the toner image is fixed to the transfer material. Thereafter, the residual toner after transfer on the photosensitive drum 1 is removed by a cleaning unit 6, so that it is ready for the next image forming sequence.

In this embodiment, the developing apparatus 2 employs a simple and stable development method using a one-component magnetic developer, for which no maintenance is required until the service life of the developing sleeve (2000 k (2 million) sheets) has expired.

In the first embodiment, the normal developing process is performed using a plurality of developer bearing members (developing sleeves) 20 and 30. When toner near a portion 2B in FIG. 1 is exhausted, rotation of a magnetic roller 24 is begun upon the receipt of a signal from a piezoelectric element 22, and as the magnetic roller 24 is rotated, the supply of toner in the developing apparatus 2 is replenished from a hopper 9B.

The developing apparatus 2 according to the present invention will now be described in detail while referring to FIGS. 1 and 2. FIG. 1 is a cross-sectional view of the developing apparatus, and FIG. 2 is a perspective view of the developing sleeve 20 of the developing apparatus.

In this embodiment, the developing apparatus 2 employs, as a simple developer, a negative, one-component magnetic toner that is durable, reliable and highly productive and for which no maintenance is required. The toner is a negative toner that has a particle diameter of 7.0 μm and that contains 1.0 weight % of $SiO_2$ as an outward additive.

Figure 1:
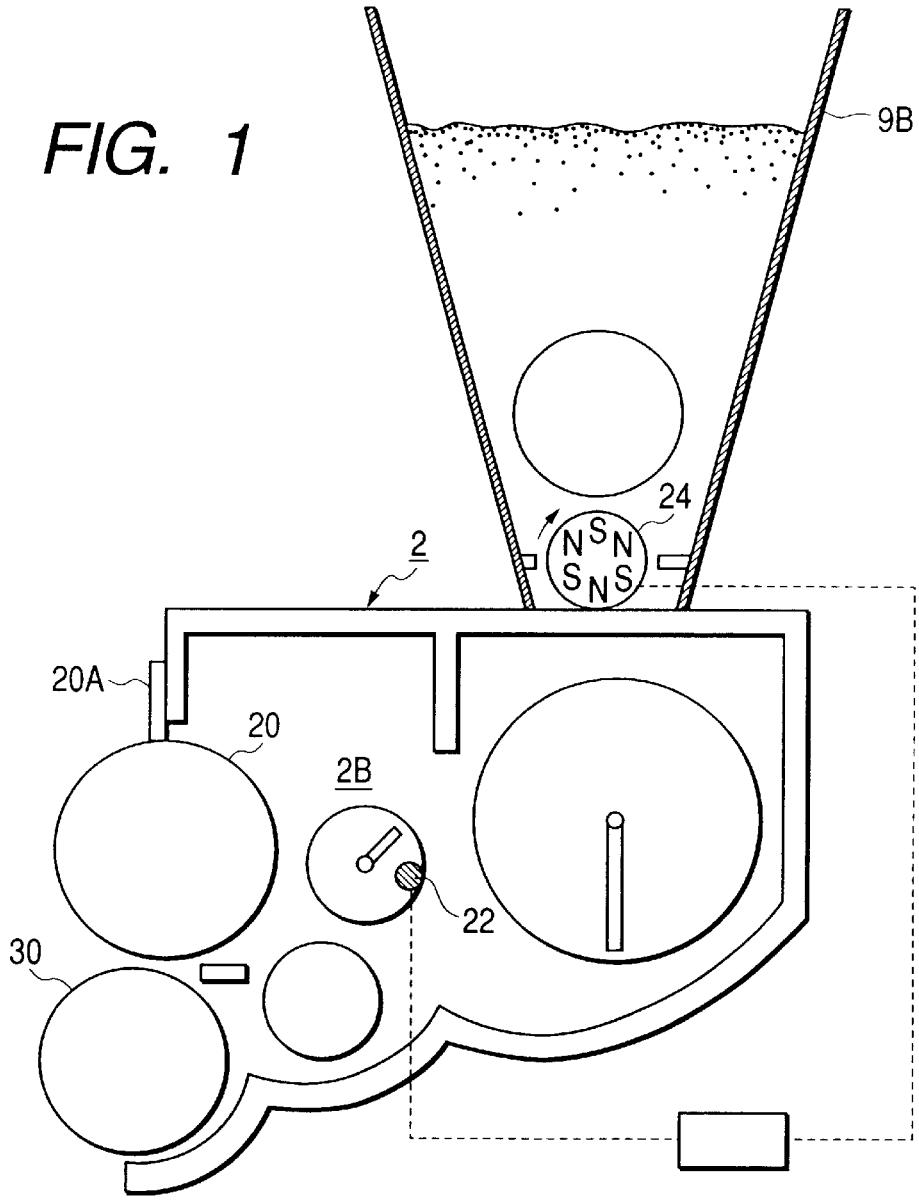
FIG. 1 is a cross-sectional view of a first developing apparatus according to the present invention.
Figure 2:
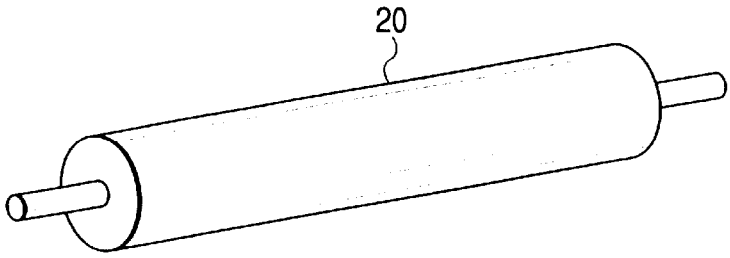
FIG. 2 is a perspective view of a developing sleeve in the first developing apparatus of the present invention.

As is shown in FIG. 1, the two developing sleeves 20 and 30 are provided as developer bearing members for the developing apparatus 2. The first developing sleeve 20 is formed by using FGB#300 to perform a blast process for a non-magnetic member that has a diameter ϕ of 30 mm and that is made of aluminum A2017, and by coating the resultant non-magnetic member. Similarly, the second developing sleeve 30 is formed by using FGB#300 to perform a blast process for a non-magnetic member that has a diameter ϕ of 20 mm and that is made of aluminum A2017, and by coating the resultant non-magnetic member. During the coating process, a protective film is formed on the aluminum surface in order to prevent the occurrence of a sleeve ghost image during a sleeve cycle, and to increase the durability of the sleeve surface. A material having a high thermal conductivity, such as aluminum, is preferable for the sleeves because, since a heater is used with an a-Si drum, a material having a low thermal conductivity, such as SUS, would cause thermal decentering of the sleeve, and uneven images would tend to be generated due to an uneven sleeve pitch.

A magnetic sealing member will now be described.

Figure 4:
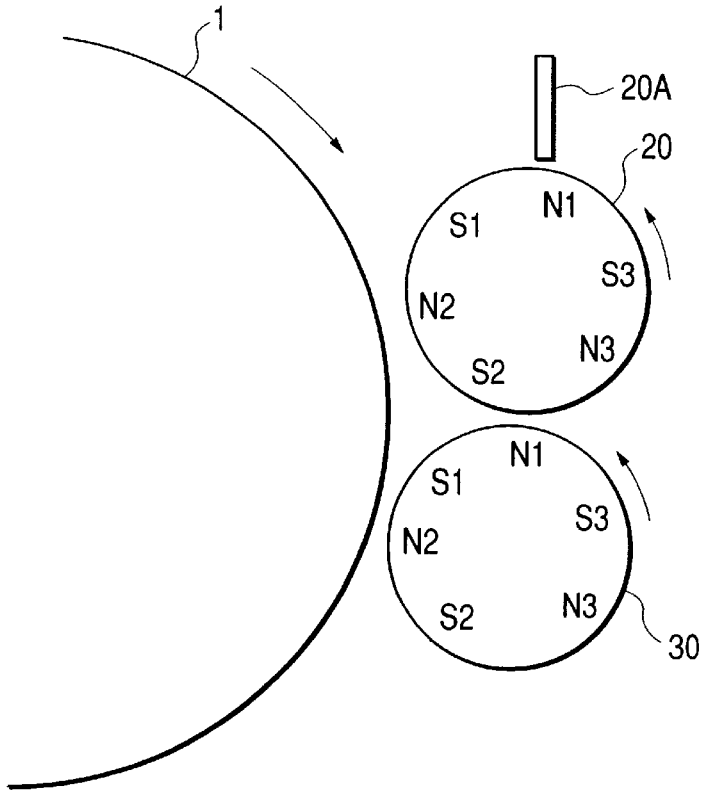
FIG. 4 is a cross-sectional view of the arrangement of magnetic poles for the first developing apparatus of the present invention.
Figure 5:
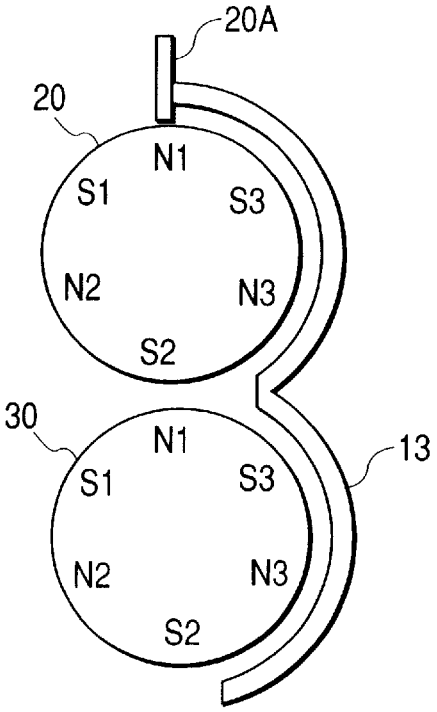
FIG. 5 is a cross-sectional view of the arrangement of magnetic poles for the first developing apparatus of the present invention.

As is shown in FIGS. 4 and 5, the first developing sleeve 20 and the second developing sleeve 30 have six internal magnetic poles (N1 to N3 and S1 to S3), and a magnetic sealing member 13 having the shape shown in FIG. 5 is provided along the external surfaces and near both ends of the sleeves 20 and 30 A gap between the developing sleeves 20 and 30 and the magnetic sealing member 13 is set to 420 μm±100 μm. The magnetic sealing member 13 is made of moldaroi (KN plated, permeability of 10.6) composed mainly of iron. The lengths of the first and the second magnets are set at 305 mm.

Figure 6:
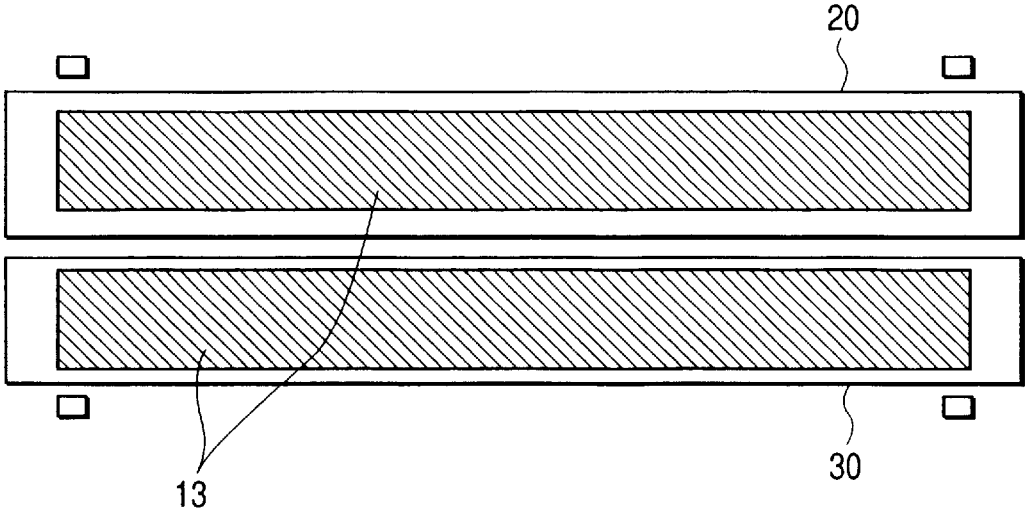
FIG. 6 is a diagram showing the relationship of the location of the developing sleeves and a magnetic sealing member in the first developing apparatus of the present invention.

For the appropriate positioning of the magnetic sealing member 13, it is most preferable that the outer ends of the magnets and those of the sealing member 13 correspond. This is because if the magnets extend out too far, beyond the area corresponding to that of the magnetic sealing member 13, an external longitudinal magnetic force will be produced, and accordingly, toner will be carried out too far and a leakage will occur. Conversely, if the ends of the magnets are withdrawn too far from an end of the magnetic sealing member 13, a magnetic brush, which originally is formed between the magnetic sealing member 13 and the magnets to prevent the leakage of toner, will be formed on a developing sleeve the width of the magnetic sealing member 13, even though no magnetic force is present at the outer end of the brush. Then, toner on the outside will leak out to the end, and at the same time the thickness of a toner layer will also be increased and cause toner to flake off (drip). Since there is longitudinal play between the developing sleeve 20 and 30 and the magnets, while taking this into account the magnetic sealing member 13 is located 1 mm inside measured from the magnet ends, as is shown in FIG. 6.

A fixed magnet is incorporated in the first developing sleeve 20, which has a magnetic field pattern formed by the six poles (N1 to N3 and S1 to S3) shown in FIGS. 4 and 5 and Table 1.

TABLE 1

| Magnet pole | Magnetic force (G) | Angle (°) | Half value width (°) |
|---|---|---|---|
| N1 | 900 | 0 | 36 |
| N2 | 950 | 60 | 46 |

TABLE 1-continued

| Magnet pole | Magnetic force (G) | Angle (°) | Half value width (°) |
|---|---|---|---|
| N3 | 550 | 220 | |
| S1 | 900 | 120 | |
| S2 | 500 | 175 | |
| S3 | 700 | 270 | |

Figure 7:
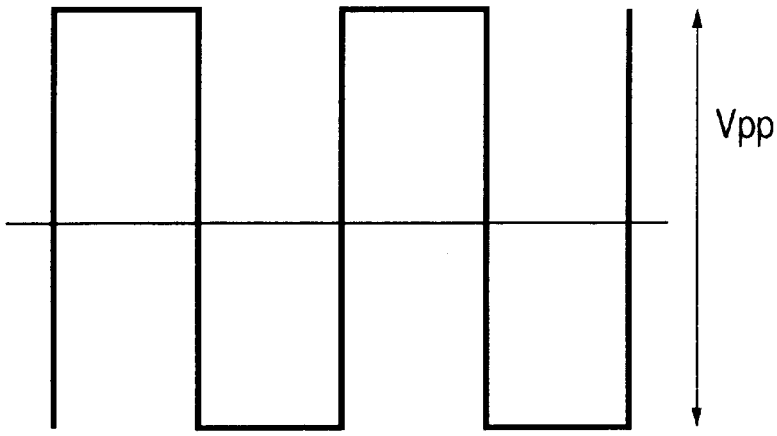
FIG. 7 is a diagram showing a development bias waveform.

The first developing sleeve 20 rotates at a speed 120% that to the photosensitive drum 1, and the thickness of the toner held on the developing sleeve 20 is controlled by a magnetic blade 20A. The gap S-$B_{gap}$ between the first developing sleeve 20 and the magnetic blade 20A is set at 250 μm, and the gap S-$D_{gap}$ between the sleeve 20 and the photosensitive drum 1 is set at 230 μm. A DC bias voltage of +200 V and an AC bias voltage, a rectangular wave $V_{pp}$ of 1400 V that has a frequency of 2.7 kHz, as is shown in FIG. 7, are applied to the first developing sleeve 20 to perform one-component non-contact magnetic development. Therefore, the developing contrast is 300 V in the toner dispersing direction, and the fog removal (toner returning) contrast is 100 V.

The second developing sleeve 30 is obtained by forming a film on a non-magnetic member that has a diameter ϕ of 30 mm and is made of aluminum A2017. A magnet is provided internally for the second developing sleeve 30 and has a magnetic field pattern formed by the six poles (N1 to N3 and S1 to S3) shown in FIGS. 4 and 5 and Table 2.

TABLE 2

| Magnet pole | Magnetic force (G) | Angle (°) | Half value width (°) |
|---|---|---|---|
| N1 | 900 | 330 | 36 |
| N2 | 950 | 30 | 46 |
| N3 | 500 | 190 | |
| S1 | 850 | 90 | |
| S2 | 500 | 145 | |
| S3 | 600 | 240 | |

A DC bias voltage of +200 V and an AC bias voltage, a rectangular wave $V_{pp}$ of 1400 V that has a frequency of 2.7 kHz, as is shown in FIG. 7, are applied to the second developing sleeve 30. Since the second developing sleeve 30 is the same as the first developing sleeve 20 and only one power source is required, the manufacturing costs can be reduced and only a small area is required for the power source.

The second developing sleeve 30 rotates at a speed 150% that of the photosensitive drum 1, and the gap S-$D_{gap}$ between the second developing sleeve 30 and the photosensitive drum 1 is set at 230 μm.

The magnetic blade 20A is plate-shaped magnetic blades of 1.0 mm thick, and the upstream developing sleeve 20 controls the thickness of the toner layer on the second developing sleeve 30. The distance between the first developing sleeve 20 and the second developing sleeve 30 is set at 300 μm. This distance value is required in order to equalize the amount of toner supplied to the first and the second developing sleeves 20 and 30 The amount of toner coating (M/S) on the developing sleeves 20 and 30 is approximately 1.0 mg/cm$^2$. The distance S-$D_{gap}$ between the second developing sleeve 30 and the photosensitive drum 1 is 230 μm, as is described above. Equalization of the amount of toner supplied per unit time is the most important factor contributing to the matching of the development characteristics of the developing sleeves and to the stabilizing of the image tones.

Figure 8:
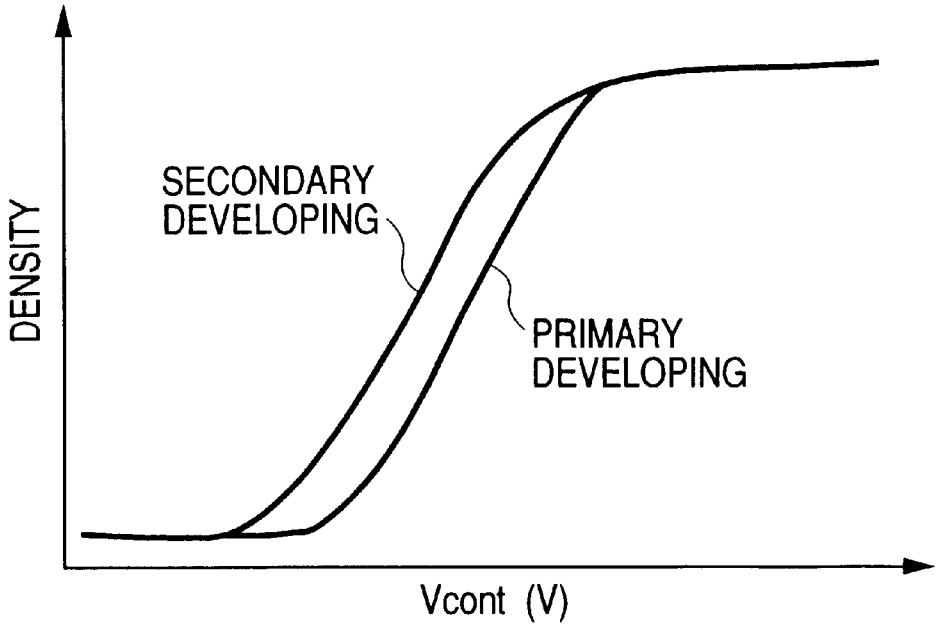
FIG. 8 is a graph showing the development characteristic of a conventional developing apparatus.

In order to satisfy requests for image tones and tone stability that can cope with current digital images and graphics, the most important factor is the matching of the development characteristics of the developing sleeves 20 and 30 The same amount of toner is supplied to the first and the second developing sleeves 20 and 30, the development pole of the first developing sleeve 20 is S1, and the magnetic force and the half-width are the same for both sleeves; however, the development characteristic for the durability required for processing 30 k sheets differs for the two developing sleeves 20 and 30, as is shown in FIG. 8 (the upper line represents the secondary developing and the lower line represents the primary developing).

These development characteristics will now be described.

Whereas for the first developing sleeve 20 the magnetic blade 20A is employed to regulate (control) the toner, for the second developing sleeve 30 the first developing sleeve 20 is employed to control the toner, and the first developing sleeve 20 is rotated at the toner control portion of the second developing sleeve 30 in the direction opposite to the direction in which the toner is fed. Thus, the toner is forcefully compressed and rubbed between the second developing sleeve 30 and the first developing sleeve 20, and the friction charging capability of the toner is increased so that it is higher than when the toner is normally controlled by the magnetic blade. In other words, the triboelectricity (Q/M) produced for the secondary developing is higher than that produced for the primary developing.

Generally, since the development characteristic depends on the triboelectricity (Q/M)×the amount of supplied toner (M/S), a difference in the triboelectricity (Q/M) appears on a V-D curve as a difference in the development characteristic, as is shown in FIG. 8. This trend is outstanding when a satisfactory development time, such as is provided by a fast image forming apparatus having a processing speed of 400 mm/s, can not be obtained, and when the rotational speed of the developing sleeve is high and the force exerted on the toner by friction is strong at the toner layer control member. The difference in triboelectricity causes a difference in the development characteristic (30 k sheets) in FIG. 8. It should be noted that the horizontal axis in FIG. 8 represents the contrast potential Vcont (V) and the vertical axis represents the V-D characteristic, which is density.

The service life of a developing sleeve, which is the second problem, will now be described.

The developing apparatus 2 in this invention is compactly designed because no member is provided between the developing sleeves 20 and 30 With this arrangement, the toner on the first developing sleeve 20 is controlled by the magnetic blade 20A, and then the toner on the second developing sleeve 30 is controlled by the first developing sleeve 20. That is, while the first developing sleeve 20 is rotated once, it accepts sharing of the toner twice, but the second developing sleeve 30 accepts the share once at the control portion. That is, as far as durability of image forming is concerned, the surface of the first developing sleeve 20 receives approximately twice the shares accepted by the surface of the second developing sleeve, and the coating on the first developing sleeve 20 is scraped more than is that on the second developing sleeve 30. For this reason the coating life (sleeve life) differs for the first developing sleeve 20 and for the second developing sleeve 30.

As a result, one developing sleeve will have to be replaced even though the service life of the other developing sleeve has not yet expired, and thus when the other sleeve is replaced later, the costs associated with the servicing provided by a maintenance man are is increased. Therefore, what is required is the equalization of the service lives of developing sleeves.

This embodiment is carried out while taking the above problem into account.

In Table 3 are shown the film formation performed by a conventional system, how much was scraped, the amount of triboelectricity (Q/M) produced, the amount of supplied toner (M/S), and the amount of triboelectricity (Q/M)×the amount of supplied toner (M/S).

TABLE 3

| | First (ϕ30) | Second (ϕ30) |
|---|---|---|
| P/B | 1/2.5 | 1/2.5 |
| Scrape (μm) | 9.9 | 6.4 |
| Q/M (μC/g) | 8.5 | 10.5 |
| M/S (mg/cm$^2$) | 1.01 | 0.99 |
| (Q/M) × (M/S) | 8.59 | 10.4 |

To form a film, phenol plastic, crystal graphite and carbon were mixed at a weight % ratio of 100:36:4, and the mixture was cured at a temperature of 150° on the surface of an Al sleeve, forming a film that was 10 μm thick, the appropriate thickness of a stable and uniform film. In this case, the ratio P/B is 1/2.5. It should be noted that B denotes the weight of a resin, and P is the weight of a pigment (crystalline (crystal) graphite+carbon), excluding the resin.

As is apparent from Table 3, with the conventional system, during the processing of 500 k sheets, the scraping depth (amount) for the first developing sleeve reached 9.9 μm while the scraping depth for the second developing sleeve reached 6.4 μm. Although a constant amount of supplied toner (M/S) could be maintained by adjusting the gap between the developing sleeves, the value of the triboelectricity (Q/M)×the amount of supplied toner (M/S), which is the indicator for the development characteristic, differed for the two developing sleeves. This is because of the difference in the triboelectricity (Q/M) that was produced, as was previously mentioned.

In contrast, in this embodiment the arrangement shown in Table 4 is employed to resolve the above problem.

TABLE 4

| | First (ϕ30) | Second (ϕ30) |
|---|---|---|
| P/B | 1/3.5 | 1/2.5 |
| Scrape (μm) | 6.6 | 6.4 |
| Q/M (μC/g) | 10.2 | 10.5 |
| M/S (mg/cm$^2$) | 1.01 | 0.99 |
| (Q/M) × (M/S) | 10.3 | 10.4 |

The film formation is as shown in Table 5. The weight ratio P/B of a resin (B) and a pigment (P) is so set that it is greater upstream than it is downstream. Thus, the ratio of graphite to carbon is preferably 9:1, due to the dispersion of the carbon.

TABLE 5

| | First (ϕ30) | Second (ϕ30) |
|---|---|---|
| P/B | 1/3.5 | 1/2.5 |
| Phenolic plastic | 100 | 100 |

TABLE 5-continued

| | First (ϕ30) | Second (ϕ30) |
|---|---|---|
| Carbon | 3.5 | 4.0 |
| Graphite | 31.5 | 36 |

The effects obtained from the above configuration are shown in Table 4.

Figure 10:
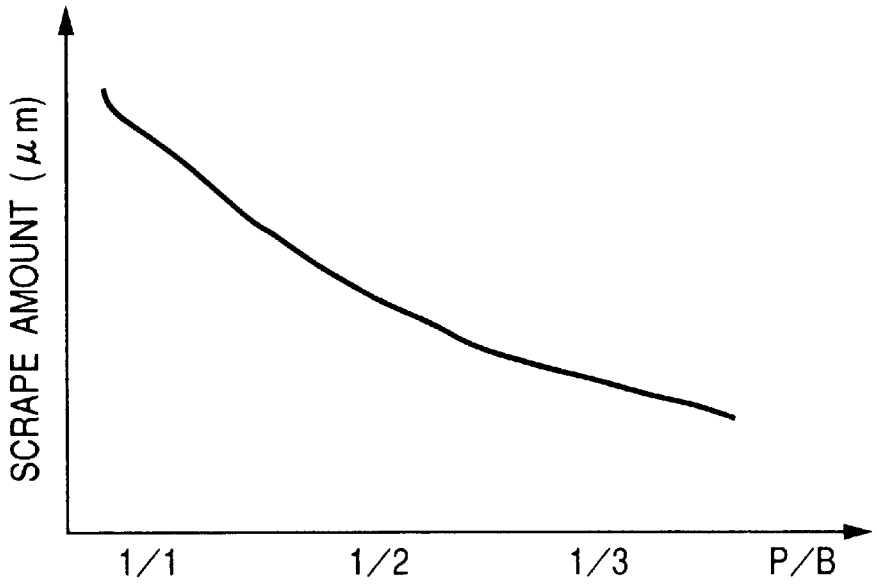
FIG. 10 is a graph showing the relationship between the P/B ratio of the composition of a film and the scrape amount of the film (how much the film was scraped)

First, during the processing performed for 500 k sheets, the second developing sleeve was scraped to a depth of 6.4 μm, and the first developing sleeve was scraped substantially the same, 6.6 μm. This is because of the characteristic shown in FIG. 10. That is, the relationship between the ratio P/B and how much the film was scraped is shown in FIG. 10, and the employed characteristic was that as the ratio P/B is increased, scraping of the film becomes easier, while as the ratio P/B is reduced, scraping of the film becomes more difficult.

Figure 9:
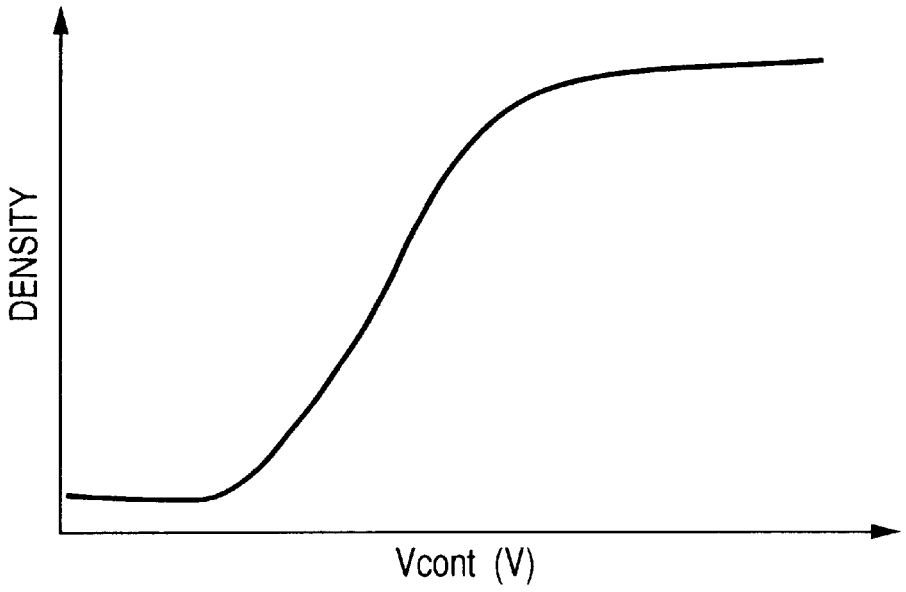
FIG. 9 is a graph showing the development characteristic of a developing apparatus.
Figure 11:
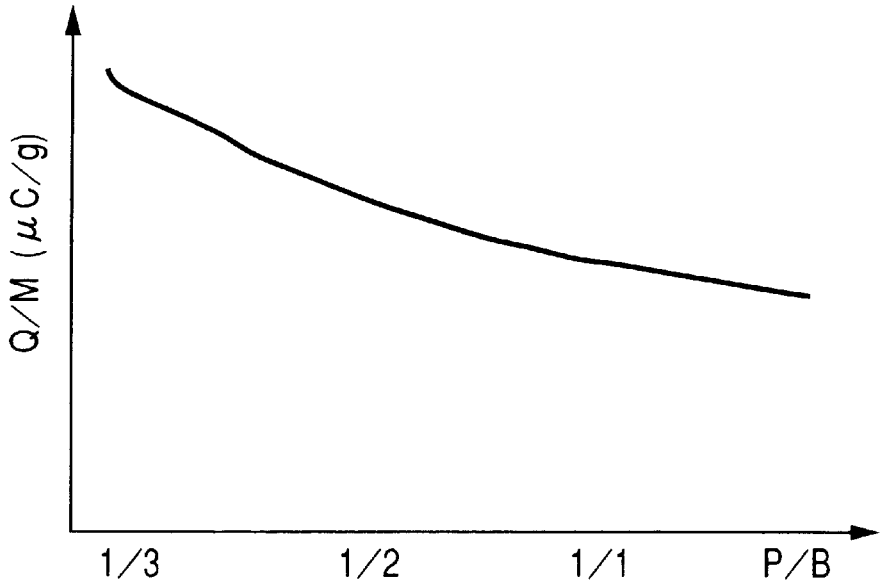
FIG. 11 is a graph showing the relationship between the P/B ratio of a film composition and the triboelectricity (Q/M)

In addition, the triboelectricity (Q/M) produced by the primary developing and by the secondary developing, which was produced because the toner on the second developing sleeve was controlled by the first developing sleeve and because the first developing sleeve was rotated at the toner control portion in a direction opposite to the direction in which the toner was fed, were substantially the same, i.e., 10.2 and 10.5 μC/g. As is apparent from the relationship between the ratio P/B and the triboelectricity (Q/M) in FIG. 11, the employed characteristic was that as the ratio P/B was increased, the triboelectricity (Q/M) was reduced, while as the ratio P/B was reduced, the triboelectricity (Q/M) was increased. As a result, while as shown in FIG. 8 the V-D curves (for 30 k sheets), which are the development characteristics, conventionally differ, V-D curves can be obtained that are substantially the same, as is shown in FIG. 9. As a result, the image tones and tone stability can be controlled, and the service lives of the developing sleeves can be equalized.

With the above arrangement, in a developing apparatus that constitutes a small developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that provides a high density and that generates no sleeve ghost images.

<Second Embodiment>

A second embodiment of the present invention will now be described.

The image forming apparatus for this embodiment is the same as that for the first embodiment.

The features of the second embodiment are that developing sleeves are constructed more compactly by employing a highly conductive material that is difficult to scrape, and a savings in space can be provided.

A developing apparatus 2 according to this embodiment will now be described in detail.

A negative, one-component magnetic toner is employed as a developer. As is shown in FIG. 1, two developing sleeves 20 and 30 are provided as developer bearing members for the developing apparatus 2. The first developing sleeve 20 is formed by performing a blast process using FGB#600 for a non-magnetic member that has a diameter ϕ of 20 mm and is made of aluminum A2017, and by then coating the resultant non-magnetic member. Similarly, the second developing sleeve 30 is formed by performing a blast process using FGB#600 for a non-magnetic member that has a diameter ϕ of 20 mm and is made of aluminum A2017, and by then coating the resultant non-magnetic member. The film coating is performed in order to prevent the occurrence of sleeve ghost images during sleeve cycles, and to increase the durability of the sleeve surface.

The first developing sleeve 20 rotates at a speed that is 150% that of the photosensitive drum 1, and the thickness of the toner held on the developing sleeve 20 is controlled by a magnetic blade 20A. The gap S-$B_{gap}$ between the first developing sleeve 20 and the magnetic blade 20A is set at 250 μm, and the gap S-$D_{gap}$ between the sleeve 20 and the photosensitive drum 1 is set at 230 μm. A DC bias voltage of +200 V and an AC bias voltage, a rectangular wave $V_{pp}$ of 1400 V that has a frequency of 2.7 kHz, as is shown in FIG. 7, are applied to the first developing sleeve 20 to perform one-component non-contact magnetic development. Therefore, the developing contrast is 300 V in the toner dispersing direction, and the fog removal contrast is 100 V.

The second developing sleeve 30 is obtained by forming a film on a non-magnetic member that has a diameter ϕ of 20 mm and is made of aluminum A2017. A DC bias voltage of +200 V and an AC bias voltage, a rectangular wave $V_{pp}$, of 1400 V that has a frequency of 2.7 kHz, as is shown in FIG. 7, are applied to the second developing sleeve 30. Since the voltage application means is the same as the first developing sleeve 20 and since only one power source is required, the manufacturing costs can be reduced and only a small area is required for the power source. The second developing sleeve 30 rotates at a speed that is 150% that of the photosensitive drum 1, and the gap S-$D_{gap}$ between the second developing sleeve 30 and the photosensitive drum 1 is set at 230 μm. The magnetic blade 20A is the same as that used for the first embodiment.

The features of this embodiment will now be described.

For the second embodiment, epoxy resin was used as resin (B), and $TiO_2$ and carbon were employed as pigments (P). This film is more durable than the film in the first embodiment, and is highly charged by negative charging. The results using this film are shown as follows.

In Table 6 are shown the film formation, how much was scraped, the triboelectricity (Q/M) produced, the amount of supplied toner (M/S), and the triboelectricity (Q/M)×the amount of supplied toner (M/S).

TABLE 6

| | First (ϕ20) | Second (ϕ20) |
|---|---|---|
| P/B | 1/2.5 | 1/2.5 |
| Scrape (μm) | 6.9 | 6.8 |
| Q/M (μC/g) | 9.2 | 11.2 |
| M/S (mg/cm$^2$) | 1.00 | 0.98 |
| (Q/M) × (M/S) | 9.2 | 10.88 |

To form the film, epoxy resin, $TiO_2$ and carbon were mixed at a weight % ratio of 100:36:4, and the mixture was cured at a temperature of 150° on the surface of an Al sleeve to form a film 10 μm thick, the appropriate thickness for a stable and uniform film. In this case, the ratio P/B was 1/2.5. It should be noted that B denotes the weight of a resin, and P is the weight of a pigment ($TiO_2$+carbon) excluding the resin.

As is apparent from Table 6, using the conventional system, during the processing for 500 k sheets, the first developing sleeve was scraped to a depth of 10.0 μm, while the second developing sleeve was scraped to a depth of 6.8 μm (the values overall are greater than those for the first embodiment because the diameters of the sleeves are smaller). The value of the triboelectricity (Q/M)×the amount of supplied toner (M/S), which is the indicator for the development characteristic, differs for the two developing sleeves.

Therefore, in this embodiment, the arrangement shown in Table 7 is employed to resolve the above problem.

TABLE 7

| | First (ϕ20) | Second (ϕ20) |
|---|---|---|
| P/B | 1/3.5 | 1/2.5 |
| Scrape (μm) | 6.9 | 6.8 |
| Q/M (μC/g) | 10.9 | 11.1 |
| M/S (mg/cm$^2$) | 1.00 | 0.98 |
| (Q/M) × (M/S) | 10.90 | 10.88 |

The film formation is as shown in Table 8. The weight ratio P/B of a resin (B) and a pigment (P) is set so that it smaller for the fast developing sleeve than for the slow developing sleeve. Thus, the ratio of $TiO_2$ to carbon is preferably 9:1, due to the dispersion of carbon.

TABLE 8

| | First (ϕ30) | Second (ϕ30) |
|---|---|---|
| P/B | 1/3.5 | 1/2.5 |
| Phenolic plastic | 100 | 100 |
| Carbon | 3.5 | 4.0 |
| $TiO_2$ | 31.5 | 36 |

The effects obtained by the above configuration are shown in Table 7.

First, during the processing performed for 500 k sheets, the second developing sleeve was scraped to a depth of 6.8 μm, and the first developing sleeve was scraped to substantially the same depth, 6.9 μm. This means that the film was not scraped, even though the diameters of the sleeves were reduced. As well as in the above embodiment, the characteristic that was employed was that as the ratio P/B was increased, the scraping of the film became easier, while as the ratio P/B was reduced, scraping the film became more difficult.

In addition, the triboelectricity (Q/M) produced by the primary developing and by the secondary developing, which occurred because the toner on the second developing sleeve was controlled by the first developing sleeve and because the first developing sleeve was rotated at the toner control portion in the direction opposite to the direction in which the toner was fed, were substantially the same, i.e., 10.9 and 11.1 μC/g. As is apparent from the relationship between the ratio P/B and the triboelectricity (Q/M) in FIG. 11, the characteristic that was employed was that as the ratio P/B was increased, the triboelectricity (Q/M) was reduced, while as the ratio P/B was reduced, the triboelectricity (Q/M) was increased. Therefore, the value of the triboelectricity (Q/M)×the amount of supplied toner (M/S), which is the indicator for the development characteristic, is substantially equal, and as a result, the V-D curves that are the development characteristics are substantially the same. As a result, the image tones and the tone stability can be controlled and the service lives of the developing sleeves can be equalized. Furthermore, the space required for the developing apparatus 2 can be reduced by selecting the above described materials.

With the above arrangement, in a developing apparatus that is a small developing system for a fast image forming apparatus and that has a plurality of developing sleeves, which is the first objective, differences in the development of the developing sleeves can be prevented, and requests can be satisfied for image tones and the tone stability that can cope with recent digital images and graphics. In addition, in a developing apparatus that has a plurality of developing sleeves, the service life of the developing sleeves can be equalized, which is the second objective, and maintenance costs can be reduced by eliminating some of the labor for which a maintenance man is required. Furthermore, a stable developing apparatus can be obtained that provides a high density.

In addition, a developing apparatus having a service life of 700,000 sheets can be provided wherein, as the third objective, the image density is stable and high, relative to high processing speed, and the required space is reduced.

<Third Embodiment>

A third embodiment of the present invention will now be described.

The feature of this embodiment is that the developing apparatus according to this invention is employed for a reuse image forming apparatus.

Figure 12:
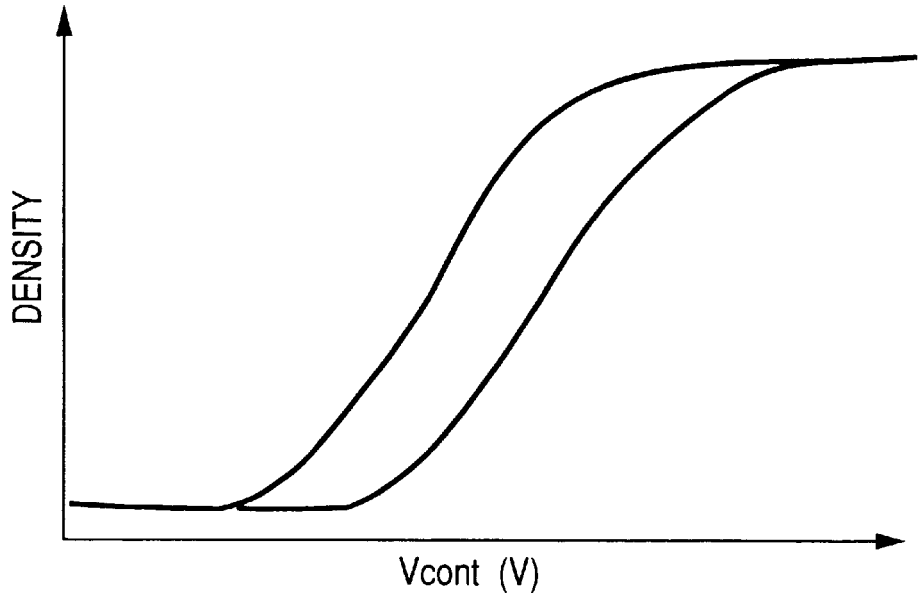
FIG. 12 is a graph showing the development characteristic of a conventional reuse image forming apparatus.

Since a reuse system basically employs waste toner that remains after the transferring process and is collected by cleaning, compared with new toner, the triboelectricity produced is considerably smaller and development is poor. Further, cohesion of the waste toner and the share at $S\text{-}B_{gap}$ are increased, and the film is scraped more. This phenomenon is shown in FIG. 12 as the development characteristic of the reuse system. It is apparent that compared with new toner, the density overall is low, and the difference between the developing sleeves is greater. The third embodiment is provided while taking all this into account.

Figure 13:
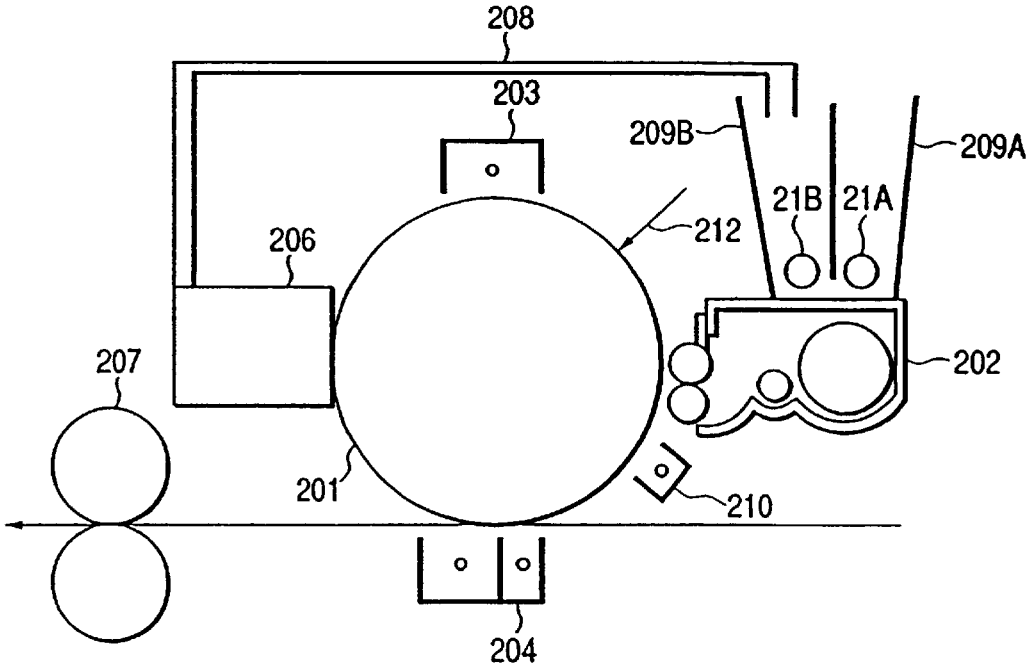
FIG. 13 is a cross-sectional view of the essential portion of a reuse image forming apparatus that includes a developing apparatus according to a third embodiment of the present invention.
Figure 14:
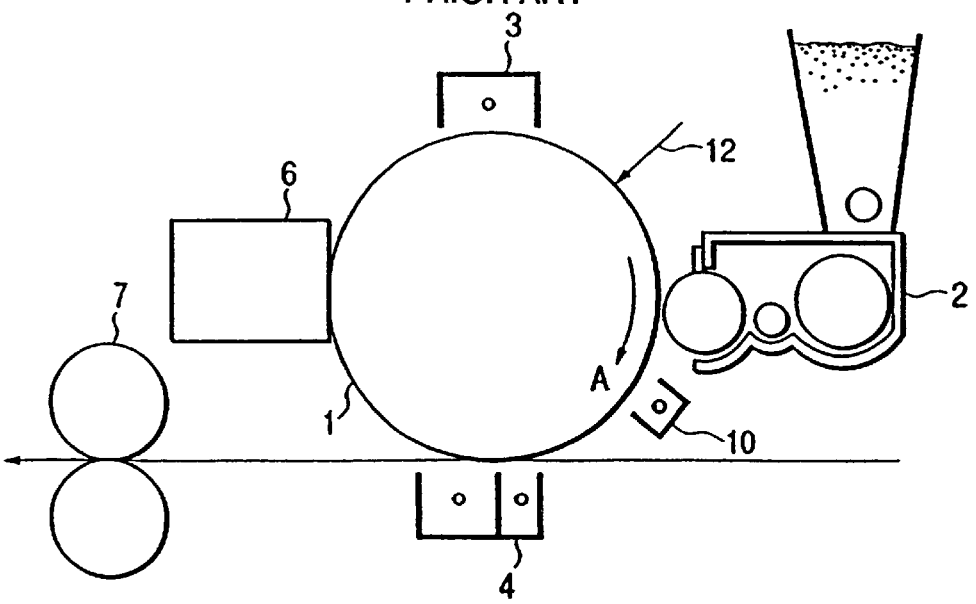
FIG. 14 PRIOR ART
FIG. 14 is a cross-sectional view of the essential portion of an image forming apparatus that includes a conventional developing apparatus.

For this embodiment, an explanation will now be given for a digital copier, functioning as the image forming apparatus shown in FIG. 13, that employs as a photosensitive drum 201 an a-Si drum.

The processing speed of the digital copier is 570 mm per second and 110 sheets per minute. The surface of the photosensitive drum 201 is uniformly charged to +500 V by a primary charger 203, and then, PWM exposure process 212 is performed at 600 dpi, by a semiconductor laser having a wavelength of 680 μm, to form an electrostatic latent image on the photosensitive drum 201.

Following this, the electrostatic latent image is normally developed by a developing apparatus 202 to visualize it as a toner image. A negative one-component magnetic toner is employed as a developer to perform jumping development, and the particle diameter of the toner is 6.0 μm. When the conventional two-component developer is employed, a carrier must be replaced by a maintenance man every 100,000 sheets, and because of maintenance free, the merits of the reuse system are not very well displayed. Thus, in this embodiment, a dry one-component magnetic toner is employed for which durability can be ignored and maintenance is not required. The development bias voltage is obtained by superimposing a DC voltage of +200 V and an AC voltage having a frequency of 2400 Hz, 1500 $V_{pp}$ and a duty ratio of 50% on both the first and the second developing sleeves. The $S\text{-}B_{gap}$ is set at 250 μm and the $S\text{-}D_{gap}$ is set at 250 μm. Then, a post charger 210 supplies a total current of −200 μA to charge the toner image, and a transfer charger 204 transfers the toner image to a transfer material that is fed in the direction indicated by an arrow. The transfer material bearing the toner image is then transmitted to a fixing unit 207, which fixes the toner image to the transfer material.

The residual toner on the photosensitive drum 201 is removed and is collected by a cleaning unit 206, and the waste toner (reuse toner) is returned via a conveyor pipe 208 to a developing hopper 209B. A screw-shaped conveyor member is provided in the conveyor pipe 208, and as the conveyor member is rotated, the reuse toner is transported. For reuse, the reuse toner is collected in the developing hopper 209B.

The new toner is contained in a hopper 209A. The new toner is attracted by the magnetic forces of magnetic rollers 21A and 21B, and is conveyed to the developing apparatus 202 as the rollers 21A and 21B are rotated. In this embodiment, a method for mixing the waste toner and the new toner in the developing apparatus 202 is employed, but space may be defined in the hopper for mixing these toners.

The toner mixed in the developing apparatus 202 is again fed to the developing sleeves, and is used to develop an electrostatic latent image on the photosensitive drum 201. The normal rotational speed of the magnetic roller 21 A is two revolutions per minute, and the rotational speed of the magnetic roller 21B is changed. When the weight of the toner is not applied to a piezosensor (produced by TDK) in the developing apparatus 202, and the piezosensor is vibrated, a toner supply signal is generated. Generally, the ratio of the amount of toner supplied by the magnetic roller 21B to that supplied by the magnet roller 21B is 10/90 (magnetic roller 21A: magnetic roller 21B=9:1).

The arrangement of the developing apparatus 202 in this embodiment is the same as that for the second embodiment, i.e., the film is formed of epoxy resin, $TiO_2$ and carbon, and the diameter of both sleeves is ϕ 20 mm.

The effects obtained in this embodiment are shown in Table 9.

TABLE 9

| | First (ϕ20) | Second (ϕ20) |
|---|---|---|
| P/B | 1/3.5 | 1/2.5 |
| Scrape (μm) | 7.4 | 7.3 |
| Q/M (μC/g) | 9.9 | 10.2 |
| M/S (mg/cm$^2$) | 1.00 | 0.98 |
| (Q/M) × (M/S) | 9.90 | 10.00 |

As is shown in Table 9, during the processing performed for 500 k sheets, the first developing sleeve was scraped to a depth of 7.4 μm, and the second developing sleeve was scraped substantially the same, 7.3 μm. This means that the service life was long enough for the processing of about 600 k sheets, despite of the cohesion of the reused waste toner.

In addition, concerning the triboelectricity (Q/M), even though there was deterioration of the fast developing sleeve due to a mechanical share, the charging with the toner of the deteriorated sleeve could be increased. That is, the triboelectricity (Q/M) of the first developing sleeve was substantially the same as that of the second developing sleeve. Therefore, in the reuse system for which the overall was charge low, the value of the triboelectricity (Q/M)×the amount of supplied toner (M/S), which was the indicator for the development characteristic, was substantially equal, and as a result, the V-D curves, which were the development characteristics, were substantially the same. As a result, a reuse system can be provided for which the image tones and tone stability can be controlled, and the service lives of the developing sleeves can be equalized.

With the above arrangement, in a small developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, sleeve ghost images are eliminated, the image density is stable and high relative to a high processing speed, and the space required is reduced.

As is apparent from the above explanation, according to the above embodiments, since the service lives of the developer bearing members are equalized, some of the labor for which a maintenance man is required is eliminated, and maintenance costs are reduced. Further, the difference in the development required for the developer bearing members is removed, and requests can be satisfied for image tones and the tone stability that can cope with recent digital images and graphics.

<Fourth Embodiment>

Figure 17:
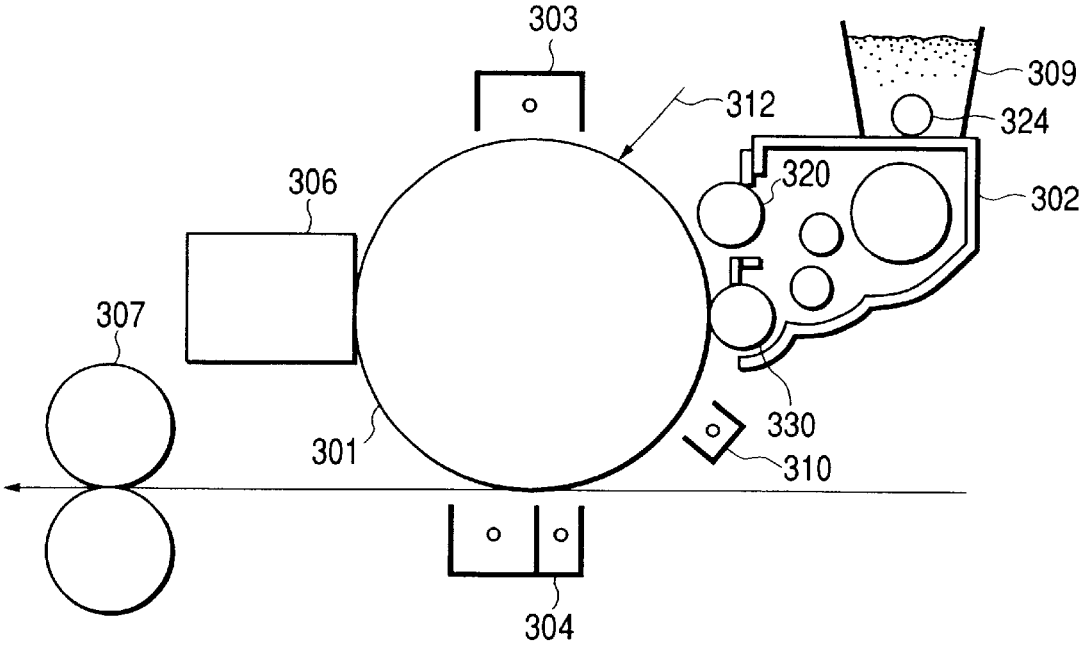
FIG. 17 is a cross-sectional view of the essential portion of an image forming apparatus that includes the second developing apparatus of the present invention.

FIG. 17 is a cross-sectional view of the essential portion of an image forming apparatus that includes a developing apparatus according to the present invention. The image forming apparatus is a black and white digital copier that can output 90 sheets per minute at a processing speed of 460 mm/sec, and that employs, as a photosensitive member, an a-Si photosensitive drum 301 having a diameter ϕ of 108 mm. The relative dielectric constant of a-Si is approximately 10, which is greater than that of an organic photosensitive material, but the charge potential is relatively low and, when compared with OPC, a satisfactory latent image potential is not obtained. However, since a photosensitive drum 1 composed of a-Si is durable and has a service life of 3 million sheets or more, it is appropriate for use in a fast, image-forming apparatus.

The photosensitive drum 301 is uniformly charged to +500 V, for example, by a charger 303, and image exposure 312 is performed at 600 dpi. For the image exposure 312, a first laser beam is employed that is obtained by modulating a semiconductor laser source in accordance with a first image signal. The first laser beam is polarized by a polygon mirror that is rotated by a motor at a predetermined revolution speed, and the polarized beam passes through a focusing lens and is reflected by a return mirror. The reflected beam raster-scans the photosensitive drum 301, and the surface potential of the exposed portion is reduced to +100 V, for example, to form a latent image on the photosensitive drum 301. It should be noted that the wavelength of the laser beam is 680 nm.

Following this, the latent image formed on the photosensitive drum 301 is normally developed by a developing apparatus 302 and is visualized as a toner image. After the electrostatic latent image has been developed and visualized as a toner image by the developing apparatus 302, a post charger 310 (see FIG. 17) supplies a total current (AC+DC) of −200 μA and charges the toner image. While a transfer material is so set as to easily transfer an image thereto and to be separated easily, the toner image is transferred by a transfer charger 304 to the transfer material that is fed to the photosensitive drum 301. The transfer material bearing the toner image is then conveyed to a fixing unit 7 where the toner image is fixed to the transfer material to obtain a desired image. Thereafter, the residual toner after transfer on the photosensitive drum 301 is removed by a cleaning unit 306, so that it is ready for the next image forming sequence.

In this embodiment, the developing apparatus 302 employs a simple and stable development method using a one-component magnetic developer, for which no maintenance is required until the service life of a 2000 k sheet developing sleeve has expired.

In the fourth embodiment, the normal developing process is performed using a plurality of developer bearing members (developing sleeves) 320 and 330. When toner near a portion 302B in FIG. 15 is exhausted, rotation of a magnetic roller 324 is begun upon the receipt of a signal from a piezoelectric element 322, and as the magnetic roller 324 is rotated, the supply of toner in the developing apparatus 302 is replenished from a hopper 309B.

The developing apparatus 302 according to the present invention will now be described in detail while referring to FIGS. 15 and 16. FIG. 15 is a cross-sectional view of the developing apparatus, and FIG. 16 is a perspective view of the developing sleeve 320 of the developing apparatus.

In this embodiment, the developing apparatus 302 employs, as a simple developer, a negative, one-component magnetic toner that is durable, reliable and highly productive and for which no maintenance is required. The toner is a negative toner that has a particle diameter of 7.5 $\mu$m and that contains $SiO_2$ as an outward additive.

Figure 15:
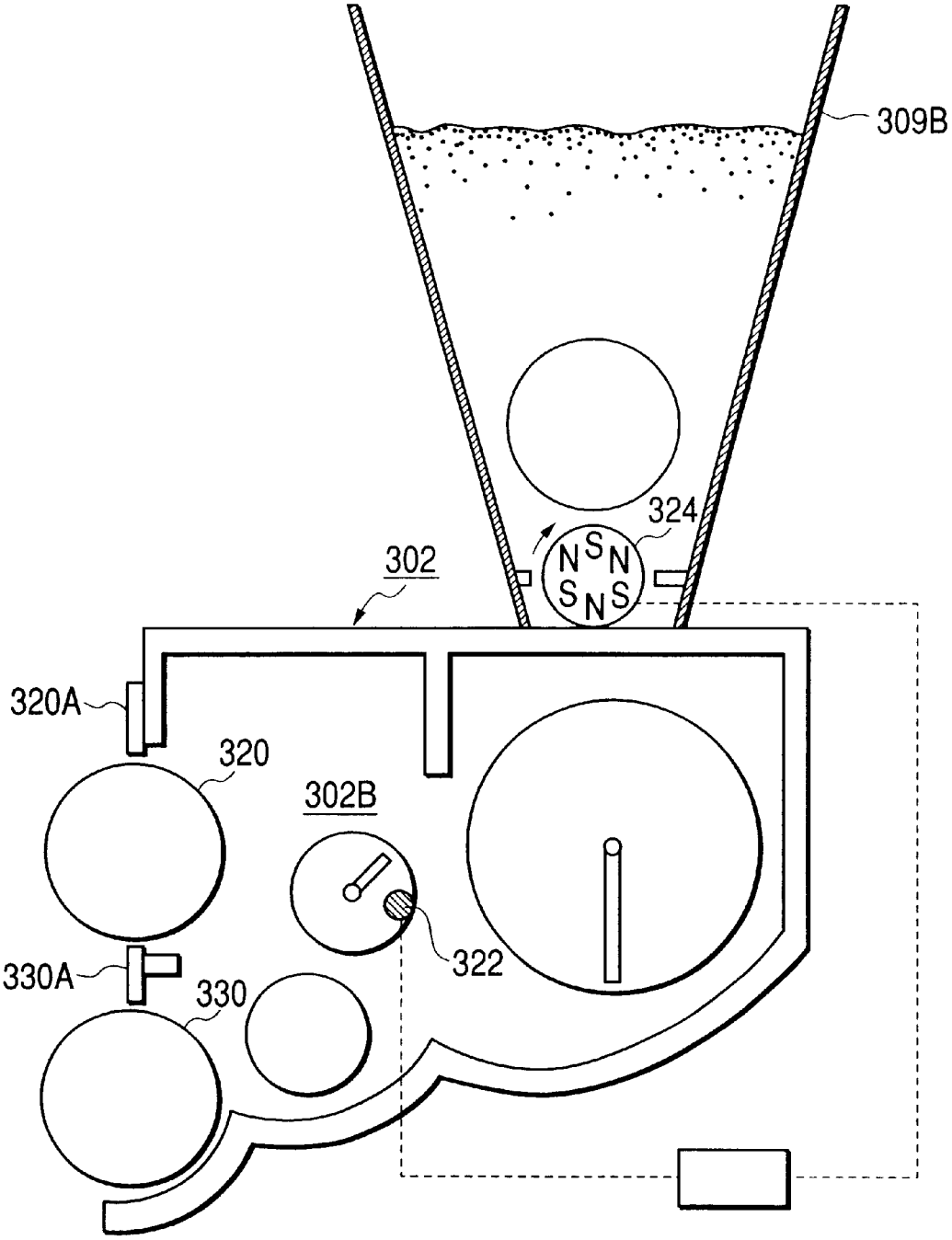
FIG. 15 is a cross-sectional view of a second developing apparatus according to the present invention.
Figure 16:
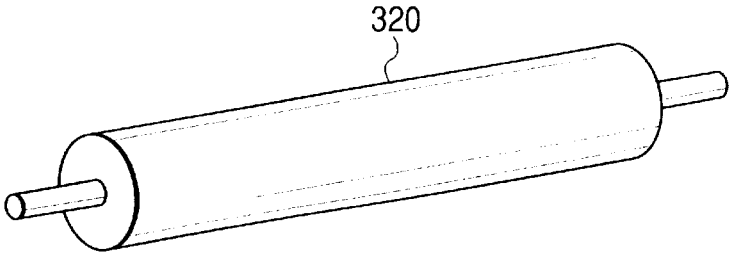
FIG. 16 is a perspective view of a developing sleeve in the second developing apparatus of the present invention.

As is shown in FIG. 15, the two developing sleeves 320 and 330 are provided as developer bearing members for the developing apparatus 302. The first developing sleeve 320 is formed by using FGB#600 to perform a blast process for a non-magnetic member that has a diameter $\phi$ of 30 mm and that is made of aluminum A2017, and by coating the resultant non-magnetic member. Similarly, the second developing sleeve 330 is formed by using FGB#600 to perform a blast process for a non-magnetic member that has a diameter $\phi$ of 30 mm and that is made of aluminum A2017, and by coating the resultant non-magnetic member. During the coating process, a protective film is formed on the aluminum (Al) surface in order to prevent the occurrence of a sleeve ghost image during a sleeve cycle, and to increase the durability of the sleeve surface. A material having a high thermal conductivity, such as aluminum, is more appropriate for the sleeves than SUS having a low thermal conductivity because, since a heater is used with an a-Si drum, thermal decentering of the sleeve tends to be caused.

Figure 18:
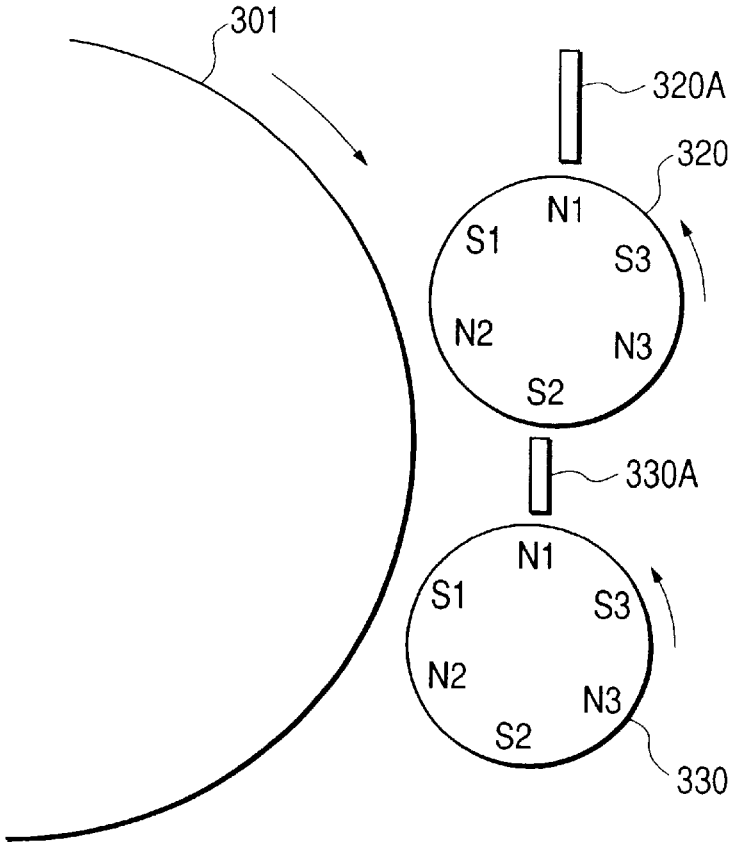
FIG. 18 is a cross-sectional view of the arrangement of the magnetic poles for the developing sleeves of the second developing apparatus of the present invention.

A fixed magnet is incorporated in the first developing sleeve 320, which has a magnetic field pattern formed by the six poles (N1 to N3 and S1 to S3) shown in FIG. 18 and Table 10.

TABLE 10

| Magnet pole | Magnetic force (G) | Angle (°) | Half value width (°) |
|---|---|---|---|
| N1 | 900 | 0 | 36 |
| N2 | 950 | 60 | 46 |
| N3 | 550 | 220 | |
| S1 | 900 | 120 | |
| S2 | 500 | 175 | |
| S3 | 700 | 270 | |

Figure 19:
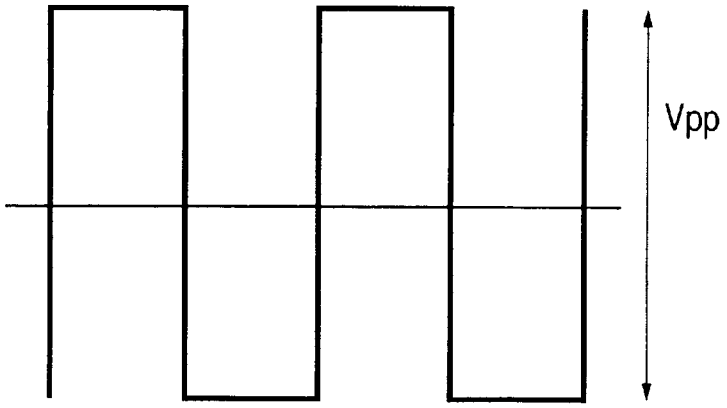
FIG. 19 is a diagram showing a development bias waveform.

The first developing sleeve 320 rotates at a speed 120% that to the photosensitive drum 301, and the thickness of the toner held on the developing sleeve 320 is controlled by a magnetic blade 320 A. The gap S-$B_{gap}$ between the first developing sleeve 320 and the magnetic blade 320A is set at 250 $\mu$m, and the gap S-$D_{gap}$ between the sleeve 320 and the photosensitive drum 301 is set at 200 $\mu$m. A DC bias voltage of +200 V and an AC bias voltage, a rectangular wave $V_{pp}$ of 1200 V that has a frequency of 2.5 kHz, as is shown in FIG. 19, are applied to the first developing sleeve 320 to perform one-component non-contact magnetic development. Therefore, the developing contrast is 300 V in the toner dispersing direction, and the fog removal (toner returning) contrast is 100 V.

The second developing sleeve 330 is obtained by forming a film on a non-magnetic member that has a diameter $\phi$ 30 mm and is made of aluminum A2017. A magnet is provided internally for the second developing sleeve 330 and has a magnetic field pattern formed by the six poles (N1 to N3 and S1 to S3) shown in FIG. 18 and Table 11.

TABLE 11

| Magnet pole | Magnetic force (G) | Angle (°) | Half value width (°) |
|---|---|---|---|
| N1 | 900 | 330 | 36 |
| N2 | 950 | 30 | 46 |
| N3 | 500 | 190 | |
| S1 | 850 | 90 | |
| S2 | 500 | 145 | |
| S3 | 600 | 240 | |

A DC bias voltage of +200 V and an AC bias voltage, a rectangular wave $V_{pp}$ of 1200 V that has a frequency of 2.5 kHz, as is shown in FIG. 19, are applied to the second developing sleeve 330. Since the second developing sleeve 330 is the same as the first developing sleeve 320 and only one power source is required, the manufacturing costs can be reduced and only a small area is required for the power source.

The second developing sleeve 330 rotates at a speed 170% that of the photosensitive drum 301 (the peripheral speed differs depending on the location of the developing apparatus 302 and the gear ratio), and the toner layer held on the developing sleeve 330 is controlled by the magnetic blade 330A. The gap S-$B_{gap}$ between the second developing sleeve 330 and the magnetic blade 330A is set to 250 $\mu$m, and the gap S-$D_{gap}$ between the second developing sleeve 330 and the photosensitive drum 301 is set at 200 $\mu$m.

Figure 20:
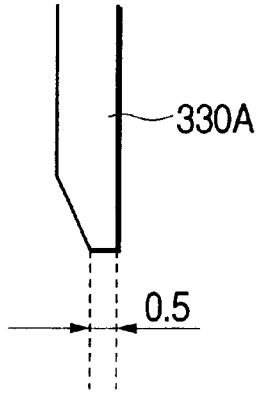
FIG. 20 is a diagram showing the shape of the tip of a magnetic blade.

The magnetic blade 320A is a plate-shaped magnetic blade 1.0 mm thick, while the magnetic blade 330A is a plate-shaped magnetic blade 0.5 mm thick, and at its distal end is tapered as is shown in FIG. 20. Since the peripheral speed differs for the first developing sleeve 320 and the second developing sleeve 330, a different amount of toner is supplied to the photosensitive drum 301 each unit time. The second developing sleeve 330 is tapered in order to correct for that difference. With this setup, the amounts of toner (M/S) coating the developing sleeves 320 and 330 are changed, and are set as approximately 1.0 mg/cm$^2$ and 0.7 mg/cm$^2$, as is shown in Table 12 to equalize the peripheral speed×M/S. Equalization of the amount of toner supplied per unit time is the most important factor contributing to the matching of the development conditions of the developing sleeves and to the stabilizing of the image tones.

TABLE 12

| | First (120%) | Second (170%) |
|---|---|---|
| P/B | 1/2.5 | 1/3.0 |
| Scrape ($\mu$m) | 5.4 | 5.6 |

TABLE 12-continued

| | First (120%) | Second (170%) |
|---|---|---|
| Q/M | 30k | 30k |
| (μc/g) | 8.7 | 8.6 |
| Blade thickness (mm) | 1.0 | 0.5 |
| M/S (mg/cm$^2$) | 1.01 | 0.72 |
| M/S × peripheral speed ratio | 1.21 | 1.22 |
| Q/M × M/S × peripheral speed | 10.53 | 10.49 |

In order to satisfy requests for image tones and tone stability that can cope with current digital images and graphics, the most important factor is the matching of the development characteristics of the developing sleeves 320 and 330 (the primary developing and the secondary developing). As is described above, the same amount of toner (M/S) is supplied per unit time to the first and the second developing sleeves 20 and 30, the development pole of the first developing sleeve 320 is N2, while the development pole of the second developing sleeve 330 is S1, and the magnetic force and the half value width (half-width) are the same for both sleeves.

Figure 21:
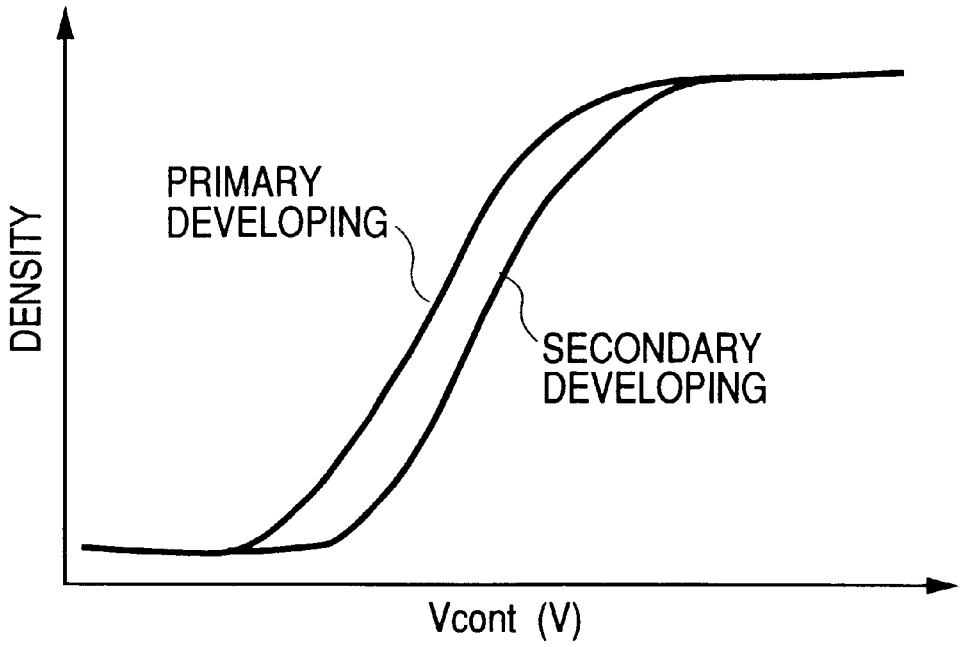
FIG. 21 is a graph showing the development characteristic of a conventional developing apparatus.
Figure 22A:
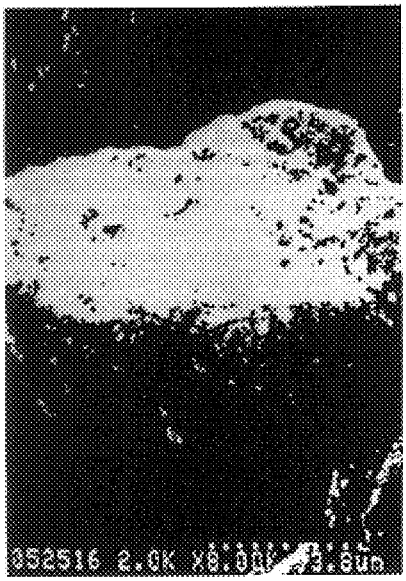
FIGS. 22A, 22B, 22C and 22D are diagrams showing SEM photos of toner.
Figure 22B:
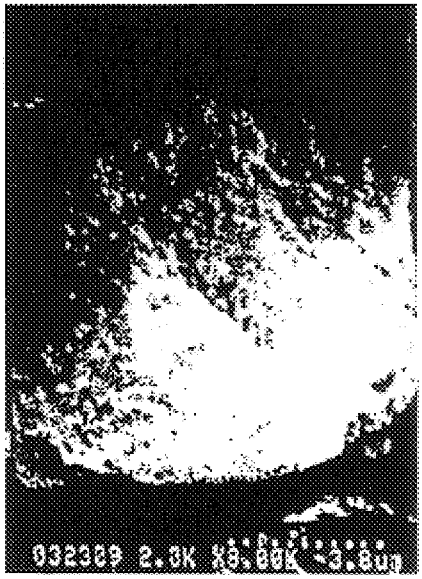
Figure 22C:
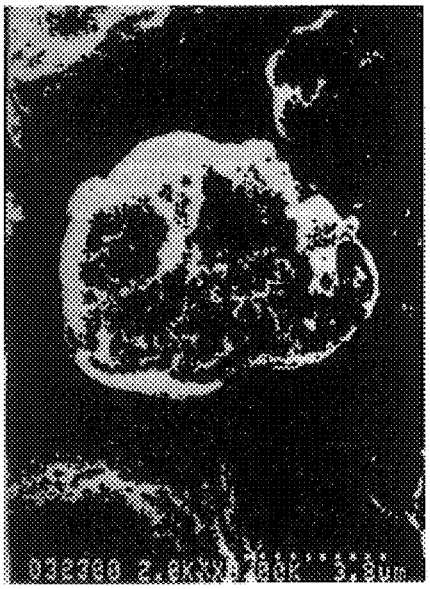
Figure 22D:
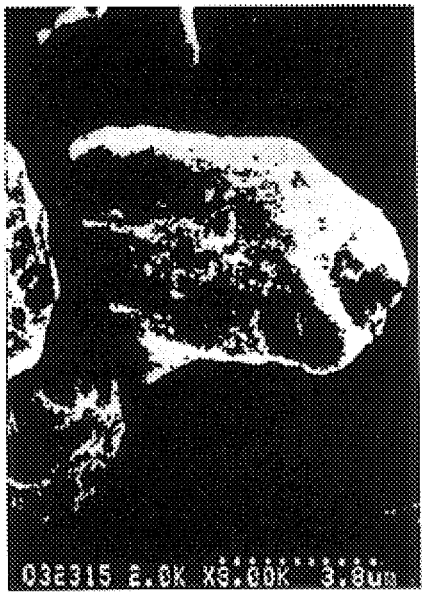

However, the development characteristic for the durability required for processing 30 k sheets differs for the two developing sleeves 320 and 330, as is shown in FIG. 21 (the upper line represents the primary developing and the lower line represents the secondary developing). These development characteristics will now be described.

Figure 23:
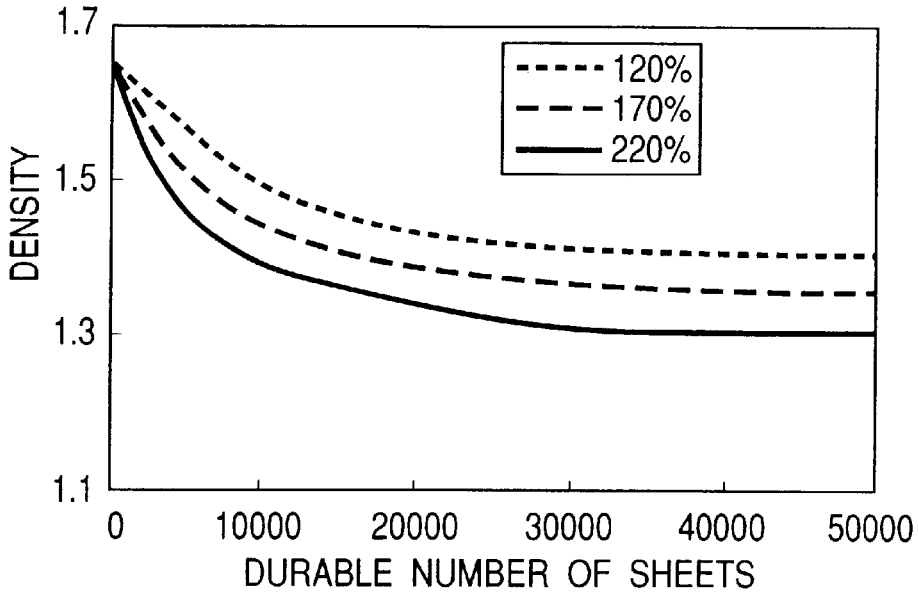
FIG. 23 is a graph showing the relationship between the durable number of sheets and a density having a peripheral speed ratio as a parameter.
Figure 24:
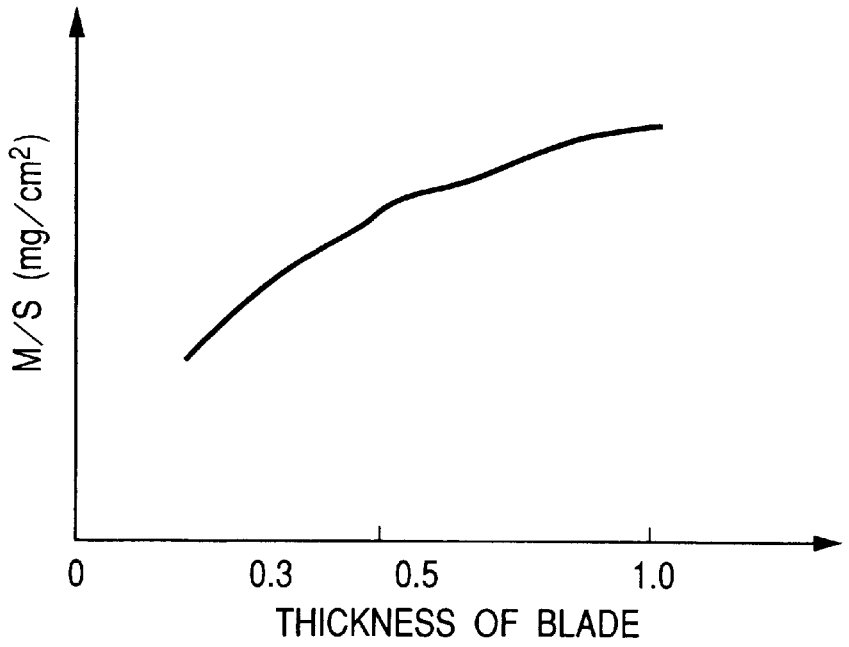
FIG. 24 is a graph showing the relationship between the thickness of a blade and a toner coating volume (M/S)

In a machine especially having the process speed of 400 mm/s or higher employs a plurality of developing sleeves, since the rotational speed of the developing sleeve is high in accordance with the increase of the process speed, the mechanical shear applied to toner by the toner layer control portion is great as the speed is high. This phenomenon is shown in FIGS. 22A, 22B, 22C and 22D. FIGS. 22A, 22B, 22C and 22D are SEM photos of toners on the developing sleeve after processing of 30 k sheets when the peripheral speed ratios of the developing sleeve to the photosensitive drum are 120%, 170% and 220%. Compared with new toner, it is apparent that as the speed of the developing sleeve is increased, outward additive $SiO_2$ (particle diameter of about 7 nm) coating the surface of the toner is embedded in the toner and the surface of the toner becomes smooth. This is because the shear received by the toner is increased as the speed is increased, and the toner is deteriorated. As a result, the charging (triboelectricity) is reduced due to the mechanical deterioration of the toner. FIG. 23 is a graph showing the shifting of the durable density when, in order to supply the constant amount of toner, the peripheral speed ratio of the developing sleeves is 120%, 170% and 220%, while the thickness of the blade is set at 1.0 mm, 0.5 mm and 0.3 mm, and the amount of coating toner (M/S) is adjusted to equalize the peripheral speed×M/S to 1.2. The property that, as is shown in FIG. 24, as the blade is thin, M/S can be reduced is employed to set M/S and the thickness of the blade. As is apparent from FIG. 23, after the processing of approximately 20 k sheets, the density differs. This means that the degree of deterioration of the toner relative to the sleeve speed differs, and the reduction of triboelectricity due to this is the main cause. This difference causes a difference in the development characteristics in FIG. 21 (30 k sheets). The horizontal axis in FIG. 21 represents the contrast potential Vcont (V), and the vertical axis represents the V-D characteristic that is a density.

When the developing sleeves have the same diameter and the same amount of toner is supplied, basically the development characteristic is proportional to the triboelectricity (Q/M) of the toner.

The service life of a developing sleeve, which is the second problem, will now be explained.

Since a developing sleeve having a low peripheral speed passes through the blade less frequently for the unit copy (unit time), the amount of film scraped from the sleeve is small. Therefore, when the diameter is the same and the peripheral speed is different for the developing sleeves in this embodiment, the film on the fast developing sleeve is scraped more. As a result, one developing sleeve will have to be replaced even though the service life of the other developing sleeve has not yet expired, and thus when the other sleeve is replaced later, the costs associated with the servicing provided by a maintenance man are is increased. Therefore, what is required is the equalization of the service lives of developing sleeves.

This embodiment is carried out while taking the above problem into account.

In Table 13 are shown the film formation (P/B) performed by a conventional system, how much was scraped, the amount of triboelectricity (Q/M) produced, the thickness of a blade, the amount of supplied toner (M/S), the amount of supplied toner (M/S)×the peripheral speed ratio, and the amount of triboelectricity (Q/M)×the amount of supplied toner (M/S)×the peripheral speed ratio.

TABLE 13

| | First (120%) | Second (170%) |
|---|---|---|
| P/B | 1/2.5 | 1/2.5 |
| Scrape (μm) | 5.4 | 7.6 |
| Q/M | 30k | 30k |
| (μc/g) | 8.7 | 7.9 |
| Blade thickness (mm) | 1.0 | 0.5 |
| M/S (mg/cm$^2$) | 1.01 | 0.72 |
| M/S × peripheral speed ratio | 1.21 | 1.22 |
| Q/M × M/S × peripheral speed | 10.53 | 9.64 |

To form a film, phenol plastic, crystal graphite and carbon were mixed at a weight % ratio of 100:36:4, and the mixture was cured at a temperature of 150° C. on the surface of an Al sleeve, forming a film that was 10 μm thick, the appropriate thickness of a stable and uniform film. In this case, the ratio P/B is 1/2.5. It should be noted that B denotes the weight of a resin, and P is the weight of a pigment (crystal graphite+carbon), excluding the resin.

As is apparent from Table 13, with the conventional system, during the processing of 500 k sheets, the scraping depth for the first developing sleeve reached 5.4 μm while the scraping depth for the second developing sleeve exceeded 7.6 μm. Although a constant amount of supplied toner (M/S)×the peripheral speed ratio could be maintained by adjusting the thickness of the blade, the value of the triboelectricity (Q/M)×M/S×the peripheral speed ratio, which is the indicator for the development characteristic, differed for the two developing sleeves. In contrast, in this embodiment the arrangement shown in Table 12 is employed to resolve the above problem.

The film formation is as shown in Table 14. The weight ratio P/B of a resin (B) and a pigment (P) is so set that the film on the fast developing sleeve is thinner than that on the slow developing sleeve. Thus, the ratio of graphite to carbon is preferably 9:1, due to the dispersion of the carbon.

TABLE 14

| | First (120%) | Second (170%) |
|---|---|---|
| P/B | 1/2.5 | 1/3 |
| Phenolic plastic | 100 | 100 |
| Graphite | 4.0 | 3.3 |
| Carbon | 36 | 27.9 |

The effects obtained from the above configuration are shown in Table 12.

Figure 26:
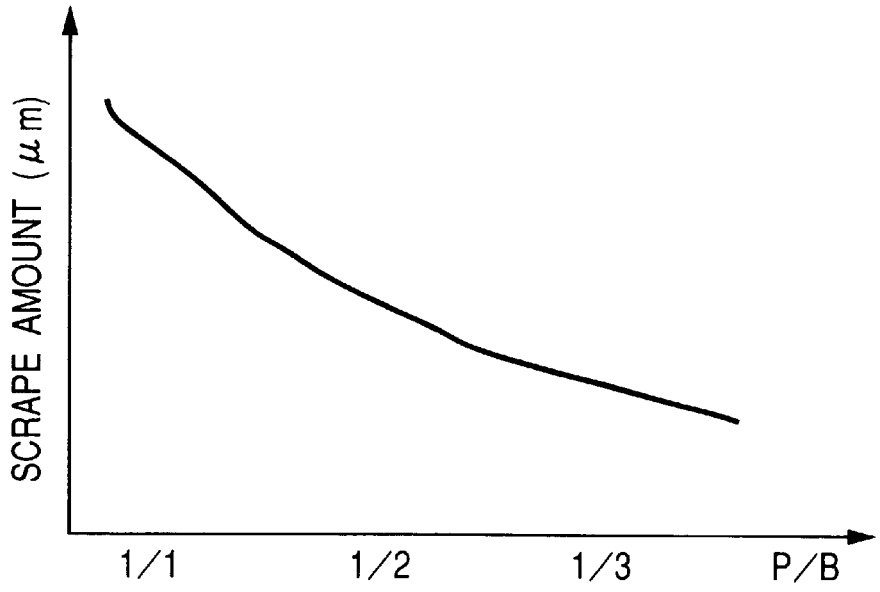
FIG. 26 is a graph showing the relationship between the P/B ratio of a film composition and how much the film was scraped.
Figure 27:
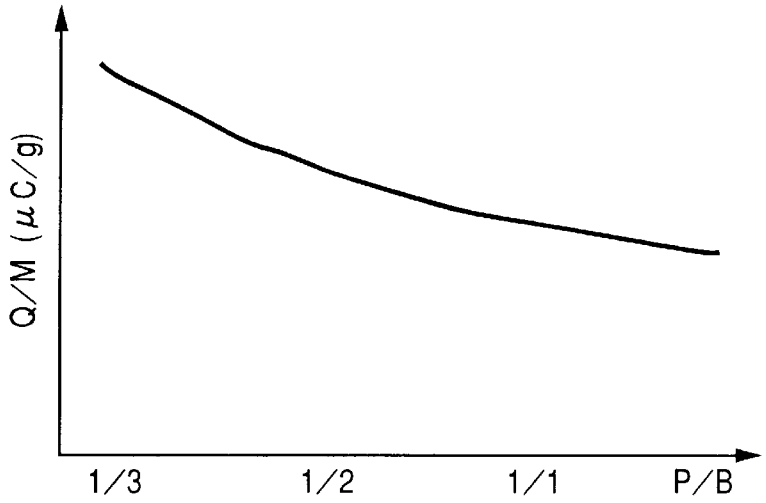
FIG. 27 is a graph showing the relationship between the P/B ratio of a film composition and the triboelectricity (Q/M)

First, during the processing performed for 500 k sheets, the first developing sleeve was scraped to a depth of 5.4 $\mu$m, and the second developing sleeve was scraped substantially the same, 5.6 $\mu$m. This is because of the characteristic shown in FIG. 26. That is, the relationship between the ratio P/B and how much the film was scraped is shown in FIG. 26, and the employed characteristic was that as the ratio P/B is increased, scraping of the film becomes easier, while as the ratio P/B is reduced, scraping of the film becomes more difficult.

Figure 25:
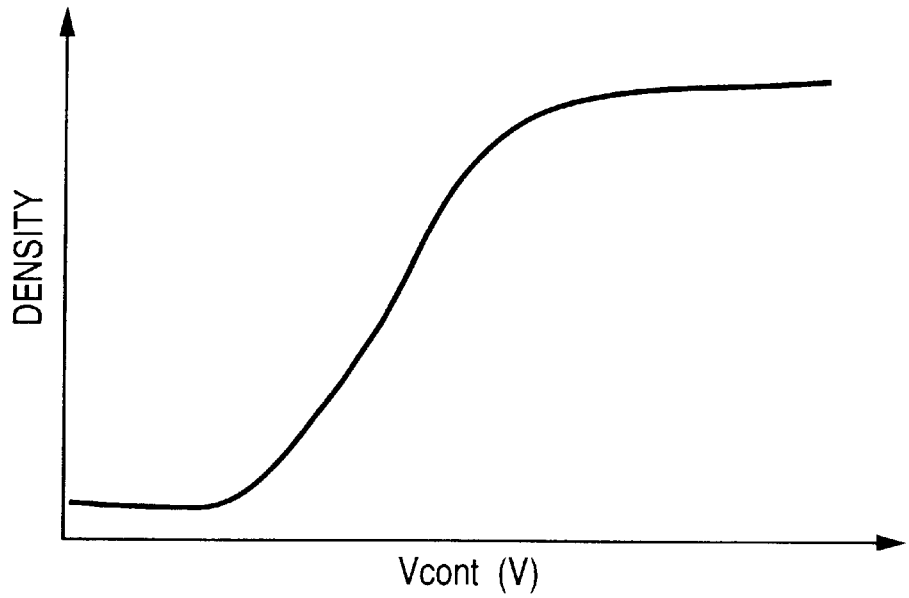
FIG. 25 is a graph showing the development characteristic of a developing apparatus.

In addition, while the fast developing sleeve was deteriorated due to the mechanical share, the triboelectricity (Q/M) for the deteriorated sleeve could be further increased. In other words, the triboelectricity (Q/M) of the fast developing sleeve could be higher than the triboelectricity of the slow developing sleeve. As is apparent from the relationship between the ratio P/B and the triboelectricity (Q/M) (30 k) in FIG. 13, the employed characteristic was that as the ratio P/B was increased, the triboelectricity (Q/M) was reduced, while as the ratio P/B was reduced, the triboelectricity (Q/M) was increased. As a result, the amount of supplied toner (M/S)×the triboelectricity (Q/M)×the peripheral speed ratio, which is the indicator of the development characteristic, can be substantially the same. Therefore, while as shown in FIG. 21 the V-D curves (for 30 k sheets), which are the development characteristics, conventionally differ, V-D curves can be obtained that are substantially the same, as is shown in FIG. 25 (it should be noted that, since the deterioration is small in the initial state, the development is very high and a difference in Q/M does not appear as a density difference). As a result, the image tones and tone stability can be controlled, and the service lives of the developing sleeves can be equalized.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that provides a high density.

<Fifth Embodiment>

A fifth embodiment of the present invention will now be described.

The image forming apparatus for this embodiment is the same as that for the fourth embodiment.

The features of the fifth embodiment are that developing sleeves are constructed more compactly by employing a highly conductive material that is difficult to scrape, and a savings in space can be provided.

A developing apparatus 302 according to this embodiment will now be described in detail.

A negative, one-component magnetic toner is employed as a developer. As is shown in FIG. 15, two developing sleeves 320 and 330 are provided as developer bearing members for the developing apparatus 302. The first developing sleeve 320 is formed by performing a blast process using FGB#600 for a non-magnetic member that has a diameter $\phi$ of 20 mm and is made of aluminum A2017, and by then coating the resultant non-magnetic member. Similarly, the second developing sleeve 330 is formed by performing a blast process using FGB#600 for a non-magnetic member that has a diameter $\phi$ of 20 mm and is made of aluminum A2017, and by then coating the resultant non-magnetic member. The film coating is performed in order to prevent the occurrence of sleeve ghost images during sleeve cycles, and to increase the durability of the sleeve surface.

The first developing sleeve 320 rotates at a speed that is 120% that of the photosensitive drum 301, and the thickness of the toner held on the developing sleeve 320 is controlled by a magnetic blade 320A. The gap S-$B_{gap}$ between the first developing sleeve 320 and the magnetic blade 320A is set at 250 $\mu$m, and the gap S-$D_{gap}$ between the sleeve 320 and the photosensitive drum 301 is set at 200 $\mu$m. A DC bias voltage of +200 V and an AC bias voltage, a rectangular wave $V_{pp}$ of 1200 V that has a frequency of 2.5 kHz, as is shown in FIG. 19, are applied to the first developing sleeve 320 to perform one-component non-contact magnetic development. Therefore, the developing contrast is 300 V in the toner dispersing direction, and the fog removal contrast is 100 V.

The second developing sleeve 330 is obtained by forming a film on a non-magnetic member that has a diameter $\phi$ of 20 mm and is made of aluminum A2017. A DC bias voltage of +200 V and an AC bias voltage, a rectangular wave $V_{pp}$ of 1200 V that has a frequency of 2.5 kHz, as is shown in FIG. 19, are applied to the second developing sleeve 330. Since the voltage application means is the same as the first developing sleeve 320 and since only one power source is required, the manufacturing costs can be reduced and only a small area is required for the power source. The second developing sleeve 330 rotates at a speed that is 170% that of the photosensitive drum 301, and the magnetic blade 330A is employed to control the thickness of a toner layer. The gap S-$B_{gap}$ is set at 250 $\mu$m, and the gap S-$D_{gap}$ is set at 200 $\mu$m. The magnetic blades 320A and 330A are the same as those for the fourth embodiment.

The features of this embodiment will now be described.

For the fifth embodiment, epoxy resin was used as resin (B), and titanium oxide ($TiO_2$) and carbon were employed as pigments (P). This film is more durable than the film in the fourth embodiment, and is highly charged by negative charging. The results using this film are shown as follows.

In Table 15 are shown the film formation (P/B) performed by a conventional system, how much was scraped, the triboelectricity (Q/M) produced, the thickness of a blade, the amount of supplied toner (M/S), M/S×the peripheral speed ratio, and Q/M×M/S×the peripheral speed ratio.

TABLE 15

| | First (120%) | Second (170%) |
|---|---|---|
| P/B | 1/2.5 | 1/2.5 |
| Scrape ($\mu$m) | 6.0 | 8.2 |

TABLE 15-continued

| | First (120%) | Second (170%) |
|---|---|---|
| Q/M | 30k | 30k |
| (μc/g) | 9.6 | 8.8 |
| Blade thickness (mm) | 1.0 | 0.5 |
| M/S (mg/cm$^2$) | 1.01 | 0.71 |
| M/S × peripheral speed ratio | 1.22 | 1.21 |
| Q/M × M/S × peripheral speed | 11.75 | 10.65 |

To form the film, epoxy resin, $TiO_2$ and carbon were mixed at a weight % ratio of 100:36:4, and the mixture was cured at a temperature of 150° C. on the surface of an Al sleeve to form a film 10 μm thick, the appropriate thickness for a stable and uniform film. In this case, the ratio P/B was 1/2.5. It should be noted that B denotes the weight of a resin, and P is the weight of a pigment ($TiO_2$+carbon) excluding the resin.

As is apparent from Table 15, using the conventional system, during the processing for 500 k sheets, the first developing sleeve was scraped to a depth of 6.0 μm, while the second developing sleeve was scraped to a depth of 8.2 μm (the values overall are greater than those for the fourth embodiment because the diameters of the sleeves are smaller). The peripheral speed differs, and the value of the amount of supplied toner (M/S)×the triboelectricity (Q/M)× the peripheral speed ratio, which is the indicator for the development characteristic, differs for the two developing sleeves.

Therefore, in this embodiment, the arrangement shown in Table 14 is employed to resolve the above problem.

The film formation is as shown in Table 16. The weight ratio P/B of a resin (B) and a pigment (P) is set so that it is smaller for the fast developing sleeve than for the slow developing sleeve. Thus, the ratio of $TiO_2$ to carbon is preferably 9:1, due to the dispersion of carbon.

TABLE 16

| | First (120%) | Second (170%) |
|---|---|---|
| P/B | 1/2.5 | 1/3 |
| Epoxy resign | 100 | 100 |
| $TiO_2$ | 4.0 | 3.3 |
| Carbon | 36 | 27.9 |

The effects obtained by the above configuration are shown in Table 14.

First, during the processing performed for 500 k sheets, the first developing sleeve was scraped to a depth of 6.0 μm, and the second developing sleeve was scraped to substantially the same depth, 6.2 μm. This means that the film was not scraped, even though the diameters of the sleeves were reduced. As well as in the above embodiment, the characteristic that was employed was that as the ratio P/B was increased, the scraping of the film became easier, while as the ratio P/B was reduced, scraping the film became more difficult.

In addition, concerning the triboelectricity (Q/M), even though there was deterioration of the fast developing sleeve due to a mechanical share, the charging with the toner of the deteriorated sleeve could be increased. That is, the triboelectricity (Q/M) of the first developing sleeve was substantially the same as that of the second developing sleeve. As is apparent from the relationship between the ratio P/B and the triboelectricity (Q/M) (30 k) in FIG. 13, the employed characteristic was that as the ratio P/B was increased, the triboelectricity (Q/M) was reduced, while as the ratio P/B was reduced, the triboelectricity (Q/M) was increased. As a result, the triboelectricity (Q/M)×M/S×the peripheral speed ratio, which is the indicator of the development characteristic, can be substantially the same. Therefore, the V-D curves, which are the development characteristics, can be obtained that are substantially the same. As a result, the image tones and tone stability can be controlled, and the service lives of the developing sleeves can be equalized. In addition, the space required for the developing apparatus 302 can be reduced by selecting the above materials.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that provides a high density.

In addition, a developing apparatus having a service life of 900,000 sheets can be provided wherein, as the third objective, the image density is stable and high, relative to high processing speed, and the required space is reduced.

<Sixth Embodiment>

A sixth embodiment of the present invention will now be described.

The feature of this embodiment is that the developing apparatus according to this invention is employed for a reuse image forming apparatus.

Figure 28:
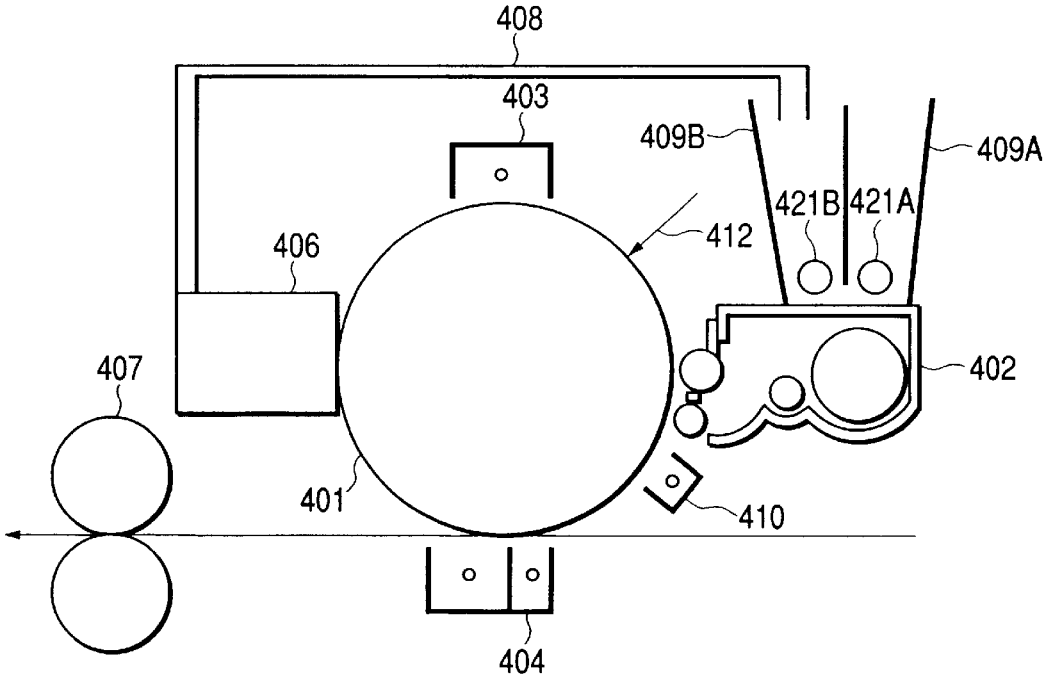
FIG. 28 is a cross-sectional view of the essential portion of a reuse image forming apparatus including a developing apparatus according to a sixth embodiment of the present invention.

For this embodiment, an explanation will now be given for a digital copier, functioning as the image forming apparatus shown in FIG. 28, that employs as a photosensitive drum 401 an a-Si drum.

The processing speed of the digital copier is 570 mm per second and 125 sheets per minute. The surface of the photosensitive drum 401 is uniformly charged to +500 V by a primary charger 403, and then, PWM exposure process 412 is performed at 600 dpi, by a semiconductor laser having a wavelength of 680 μm, to form an electrostatic latent image on the photosensitive drum 401.

Following this, the electrostatic latent image is normally developed by a developing apparatus 402 to visualize it as a toner image. A negative one-component magnetic toner is employed as a developer to perform jumping development, and the particle diameter of the toner is 6.0 μm. When the conventional two-component developer is employed, a carrier must be replaced by a maintenance man every 100,000 sheets, and because of maintenance free, the merits of the reuse system are not very well displayed. Thus, in this embodiment, a dry one-component magnetic toner is employed for which durability can be ignored and maintenance is not required. The development bias voltage is obtained by superimposing a DC voltage of +200 V and an AC voltage having a frequency of 2000 Hz, 1500 $V_{pp}$ and a duty ratio of 50% on both the first and the second developing sleeves. The S-$B_{gap}$ is set at 250 μm and the S-$D_{gap}$ is set at 250 μm. Then, a post charger 410 supplies a total current of −200 μA to charge the toner image, and a transfer charger 404 transfers the toner image to a transfer material that is fed in the direction indicated by an arrow. The transfer material bearing the toner image is then transmitted to a fixing unit 407, which fixes the toner image to the transfer material.

The residual toner on the photosensitive drum 401 is removed and is collected by a cleaning unit 406, and the waste toner (reuse toner) is returned via a conveyor pipe 408 to a developing hopper 409B. A screw-shaped conveyor member is provided in the conveyor pipe 408, and as the conveyor member is rotated, the reuse toner is transported. For reuse, the reuse toner is collected in the developing hopper 409B.

The new toner is retained in a hopper 409A. The new toner is attracted by the magnetic forces of magnetic rollers 421A and 421B, and is fed to the developing apparatus 402 as the rollers 421A and 421B are rotated. In this embodiment, a method for mixing the waste toner and the new toner in the developing apparatus 402 is employed, but space may be defined in the hopper for mixing these toners.

The toner mixed in the developing apparatus 402 is again fed to the developing sleeves, and is used to develop an electrostatic latent image on the photosensitive drum 401. The normal rotational speed of the magnetic roller 421A is two revolutions per minute, and the rotational speed of the magnetic roller 421B is changed. When the weight of the toner is not applied to a piezosensor (produced by TDK) in the developing apparatus 402, and the piezosensor is vibrated, a toner supply signal is generated. Generally, the ratio of the amount of toner supplied by the magnetic roller 421B to that supplied by the magnet roller 421B is 10/90 (magnetic roller 421A: magnetic roller 421B=9:1).

The arrangement of the developing apparatus 402 in this embodiment is the same as that for the fifth embodiment, i.e., the film is formed of epoxy resin, $TiO_2$ and carbon, and the diameter of both sleeves is ϕ 20 mm.

The effects obtained in this embodiment are shown in Table 17.

TABLE 17

| | First (120%) | Second (170%) |
|---|---|---|
| P/B | 1/2.5 | 1/2.5 |
| Scrape (μm) | 7.2 | 7.4 |
| Q/M | 50k | 50k |
| (μc/g) | 8.9 | 8.9 |
| Blade thickness (mm) | 1.0 | 0.5 |
| M/S (mg/cm$^2$) | 0.98 | 0.69 |
| M/S × peripheral speed ratio | 11.76 | 11.73 |
| Q/M × M/S × peripheral speed | 104.67 | 104.40 |

As is shown in Table 17, during the processing performed for 500 k sheets, the first developing sleeve was scraped to a depth of 7.2 μm, and the second developing sleeve was scraped substantially the same, 7.4 μm. This means that the service life was long enough for the processing of about 650 k sheets, despite of the cohesion of the reused waste toner.

In addition, concerning the triboelectricity (Q/M), even though there was deterioration of the fast developing sleeve due to a mechanical shear, the charging with the toner of the deteriorated sleeve could be increased. That is, the triboelectricity (Q/M) of the first developing sleeve was substantially the same as that of the second developing sleeve. Therefore, in the reuse system for which the overall was charge low, the value of the triboelectricity (Q/M)×M/S×the peripheral speed ratio, which is the indicator for the development characteristic, was substantially equal, and as a result, the V-D curves, which are the development characteristics, were substantially the same. As a result, a reuse system can be provided for which the image tones and tone stability can be controlled, and the service lives of the developing sleeves can be equalized.

With the above arrangement, in a developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, the image density is stable and high relative to a high processing speed, and the space required is reduced.

As is apparent from the above explanation, according to the above embodiments, requests can be satisfied for image tones and the tone stability that can cope with recent digital images and graphics.

Furthermore, since the service lives of the developer bearing members are equalized, some of the labor for which a maintenance man is required is eliminated, and maintenance costs are reduced.

In addition, the occurrence of a sleeve ghost image can be prevented, and stable development and density can be provided relative to increase of the process speed.

<Seventh Embodiment>

Figure 31:
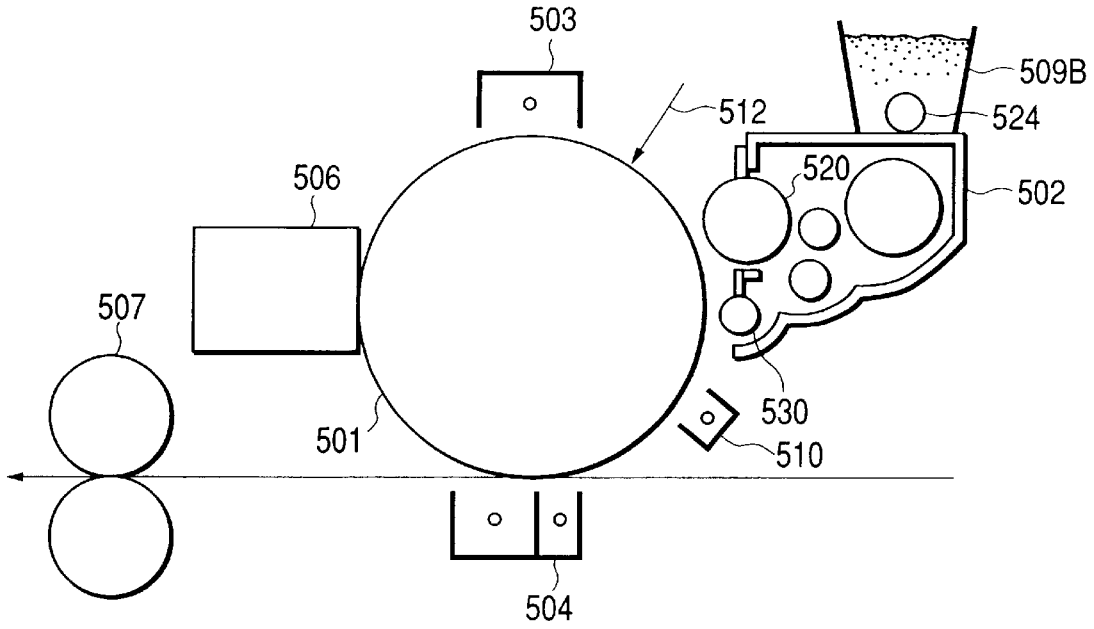
FIG. 31 is a cross-sectional view of the essential portion of an image forming apparatus that includes the third developing apparatus of the present invention.
Figure 32:
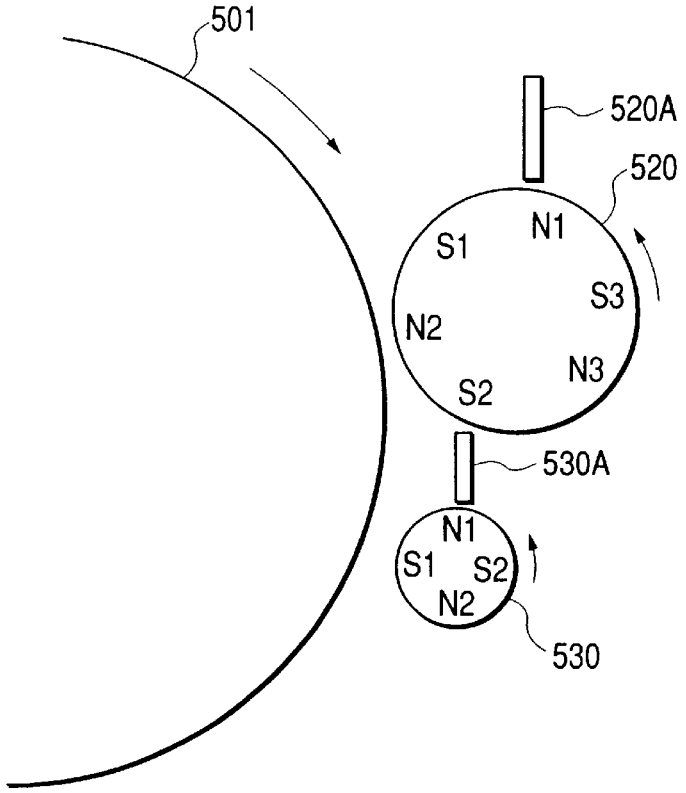
FIG. 32 is a cross-sectional view of the arrangement of the magnetic poles of the developing sleeves of the third developing apparatus of the present invention.

FIG. 31 is a cross-sectional view of the essential portion of an image forming apparatus that includes a developing apparatus according to the present invention. The image forming apparatus is a black and white digital copier that can output 82 sheets per minute at a processing speed of 450 mm/sec, and that employs, as a photosensitive member, an a-Si photosensitive drum 501 having a diameter ϕ of 108 mm. The relative dielectric constant of a-Si is approximately 10, which is greater than that of an organic photosensitive material, but the charge potential is relatively low and, when compared with OPC, a satisfactory latent image potential is not obtained. However, since a photosensitive drum 1 composed of a-Si is durable and has a service life of 3 million sheets or more, it is appropriate for use in a fast, image-forming apparatus.

The photosensitive drum 501 is uniformly charged to +500 V, for example, by a charger 503, and image exposure 512 is performed at 600 dpi. For the image exposure 512, a first laser beam is employed that is obtained by modulating a semiconductor laser source in accordance with a first image signal. The first laser beam is polarized by a polygon mirror that is rotated by a motor at a predetermined revolution speed, and the polarized beam passes through a focusing lens and is reflected by a return mirror. The reflected beam raster-scans the photosensitive drum 501, and the surface potential of the exposed portion is reduced to +100 V, for example, to form a latent image on the photosensitive drum 501. It should be noted that the wavelength of the laser beam is 680 nm.

Following this, the latent image formed on the photosensitive drum 501 is normally developed by a developing apparatus 502 and is visualized as a toner image. After the electrostatic latent image has been developed and visualized as a toner image by the developing apparatus 502, a post charger 510 supplies a total current (AC+DC) of −200 μA and charges the toner image. The toner image is then transferred by a transfer charger 504 to a transfer material that is fed in the direction indicated by an arrow, and the transfer material bearing the toner image is conveyed to a fixing unit 507 where the toner image is fixed to the transfer material. As a result, a desired image is obtained. Thereafter, the residual toner on the photosensitive drum 501 is removed by a cleaning unit 506, so that it is ready for the next image forming sequence.

In this embodiment, the developing apparatus 502 employs a simple and stable development method using a one-component magnetic developer, for which no maintenance is required until the service life of a 2000 k sheet developing sleeve has expired. The toner is a negative toner that has a particle diameter of 8.5 μm.

In the seventh embodiment, the normal developing process is performed using a plurality of developer bearing members (developing sleeves) 520 and 530. When toner near a portion 502B in FIG. 29 is exhausted, rotation of a magnetic roller 524is begun upon the receipt of a signal from a piezoelectric element 522, and as the magnetic roller 524 is rotated, the supply of toner in the developing apparatus 502 is replenished from a hopper 509B.

The developing apparatus 502 according to the present invention will now be described in detail while referring to FIGS. 29 and 30. FIG. 29 is a cross-sectional view of the developing apparatus, and FIG. 30 is a perspective view of the developing sleeve 520 of the developing apparatus.

In this embodiment, the developing apparatus 502 employs, as a simple developer, a negative, one-component magnetic toner that is durable, reliable and highly productive and for which no maintenance is required.

Figure 29:
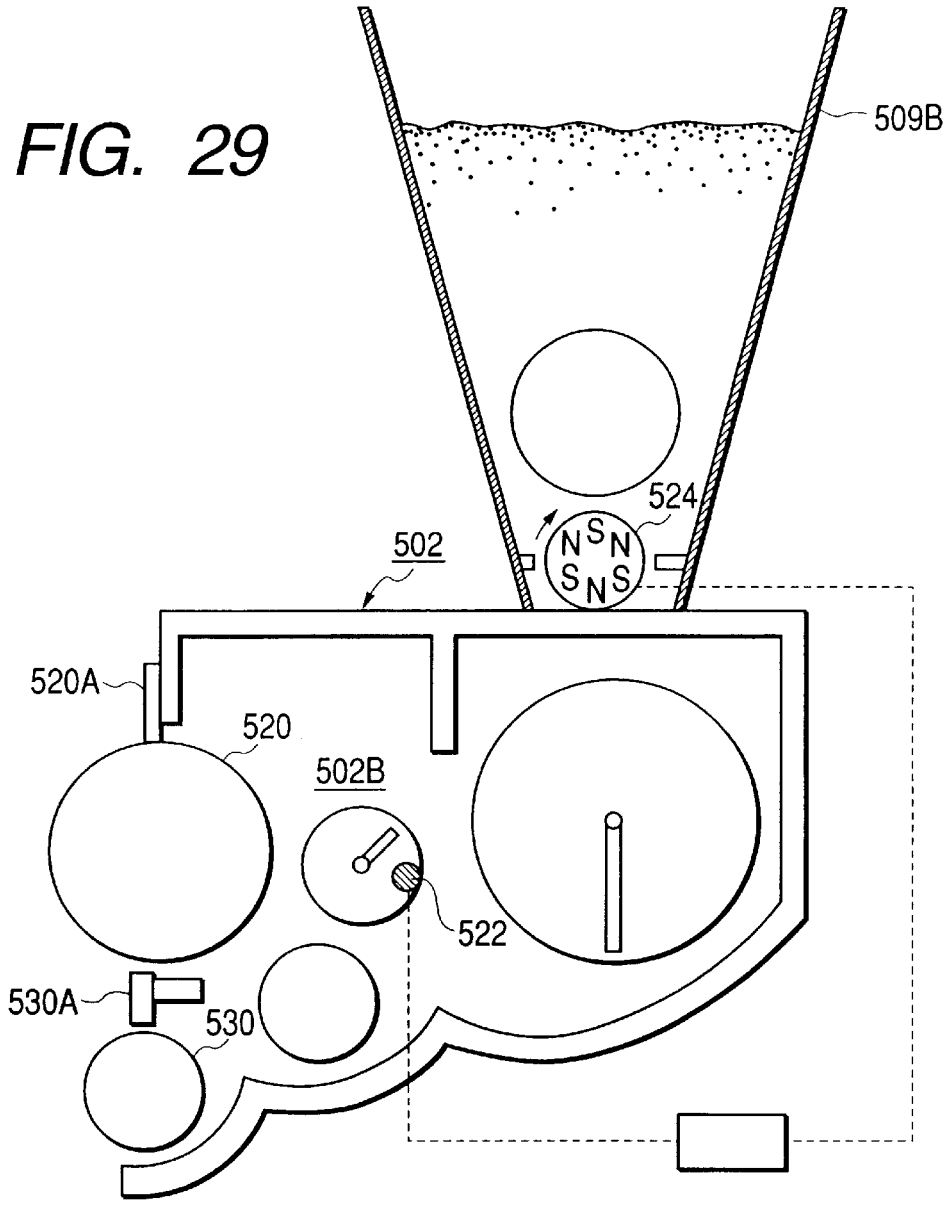
FIG. 29 is a cross-sectional view of a third developing apparatus according to the present invention.
Figure 30:
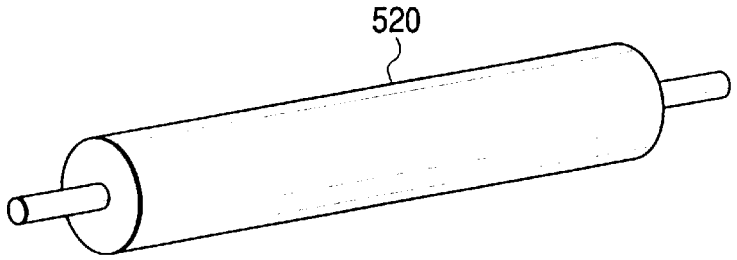
FIG. 30 is a perspective view of a developing sleeve in the third developing apparatus of the present invention.

As is shown in FIG. 29, the two developing sleeves 520 and 530 are provided as developer bearing members for the developing apparatus 502. The first developing sleeve 520 is formed by using FGB#600 to perform a blast process for a non-magnetic member that has a diameter ϕ of 30 mm and that is made of aluminum A2017, and by coating the resultant non-magnetic member. Similarly, the second developing sleeve 530 is formed by using FGB#600 to perform a blast process for a non-magnetic member that has a diameter ϕ of 20 mm and that is made of aluminum A2017, and by coating the resultant non-magnetic member. During the coating process, a protective film is formed on the aluminum surface in order to prevent the occurrence of a sleeve ghost image during a sleeve cycle, and to increase the durability of the sleeve surface.

A fixed magnet is incorporated in the first developing sleeve 520, which has a magnetic field pattern formed by the six poles (N1 to N3 and S1 to S3) shown in FIG. 31 and Table 18.

TABLE 18

| Magnet pole | Magnetic force (G) | Angle (°) | Half value width (°) |
|---|---|---|---|
| N1 | 950 | 0 | 38 |
| N2 | 950 | 60 | 46 |
| N3 | 550 | 220 | |
| S1 | 900 | 120 | |
| S2 | 500 | 175 | |
| S3 | 700 | 270 | |

Figure 33:
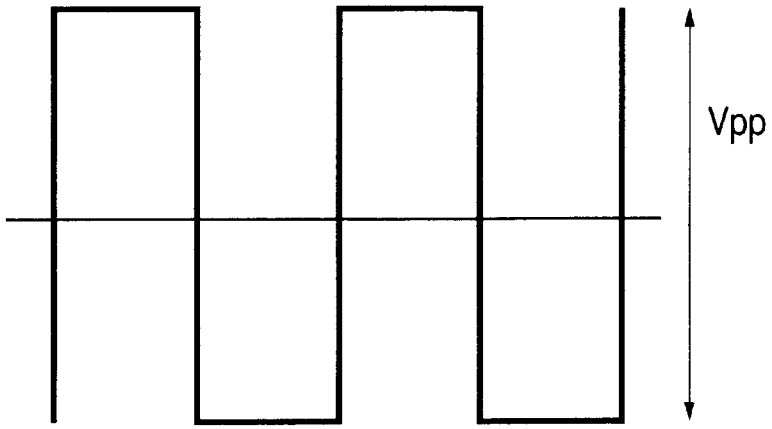
FIG. 33 is a diagram showing a development bias waveform.

The first developing sleeve 520 rotates at a speed 150% that to the photosensitive drum 501, and the thickness of the toner held on the developing sleeve 520 is controlled by a magnetic blade 520A. The gap S-$B_{gap}$ between the first developing sleeve 520 and the magnetic blade 520A is set at 250 μm, and the gap S-$D_{gap}$ between the sleeve 520 and the photosensitive drum 501 is set at 200 μm. A DC bias voltage of +200 V and an AC bias voltage, a rectangular wave $V_{pp}$ of 1200 V that has a frequency of 2.5 kHz, as is shown in FIG. 33, are applied to the first developing sleeve 520 to perform one-component non-contact magnetic development. Therefore, the developing contrast is 300 V in the toner dispersing direction, and the fog removal (toner returning) contrast is 100 V.

The second developing sleeve 530 is obtained by forming a film on a non-magnetic member that has a diameter ϕ of 20 mm and is made of aluminum A2017. A magnet is provided internally for the second developing sleeve 530 and has a magnetic field pattern formed by the four poles (N1, N2, S1 and S2) shown in FIG. 31 and Table 19.

TABLE 19

| Magnet pole | Magnetic force (G) | Angle (°) | Half value width (°) |
|---|---|---|---|
| N1 | 950 | 0 | 38 |
| N2 | 800 | 170 | |
| S1 | 950 | 90 | 46 |
| S2 | 500 | 260 | |

A DC bias voltage of +200 V and an AC bias voltage, a rectangular wave $V_{pp}$ of 1200 V that has a frequency of 2.5 kHz, as is shown in FIG. 33, are applied to the second developing sleeve 530. Since the second developing sleeve 530 is the same as the first developing sleeve 520 and only one power source is required, the manufacturing costs can be reduced and only a small area is required for the power source.

The second developing sleeve 530 rotates at a speed 150% that of the photosensitive drum 501, and the thickness of the toner layer held on the developing sleeve 530 is controlled by the magnetic blade 530A. The gap S-$B_{gap}$ between the second developing sleeve 530 and the magnetic blade 530A is set at 250 μm, while the gap S-$D_{gap}$ between the second developing sleeve 530 and the photosensitive drum 501 is set at 200 μm.

The magnetic blade 520A and 530A are plate-shaped blades 1.0 mm thick. Since the magnetic blades 520A and 530A are identically formed, it is possible to set the same developing conditions, and when the density fluctuates due to the environment or durability, it can be corrected.

In order to satisfy requests for image tones and tone stability that can cope with current digital images and graphics, the most important factor is the matching of the development characteristics of the developing sleeves 520 and 530 (primary developing and secondary developing). Since the S-$B_{gap}$ is the same for the first and the second developing sleeves 520 and 530, the amount of toner coating the developing sleeves 520 and 530 is also the same, about 1.0 mg/cm$^2$. The development pole of the first developing sleeve 520 is N2, while the development pole of the second developing sleeve 530 is S1, and the magnetic force and the half-width are the same for both sleeves.

Figure 34:
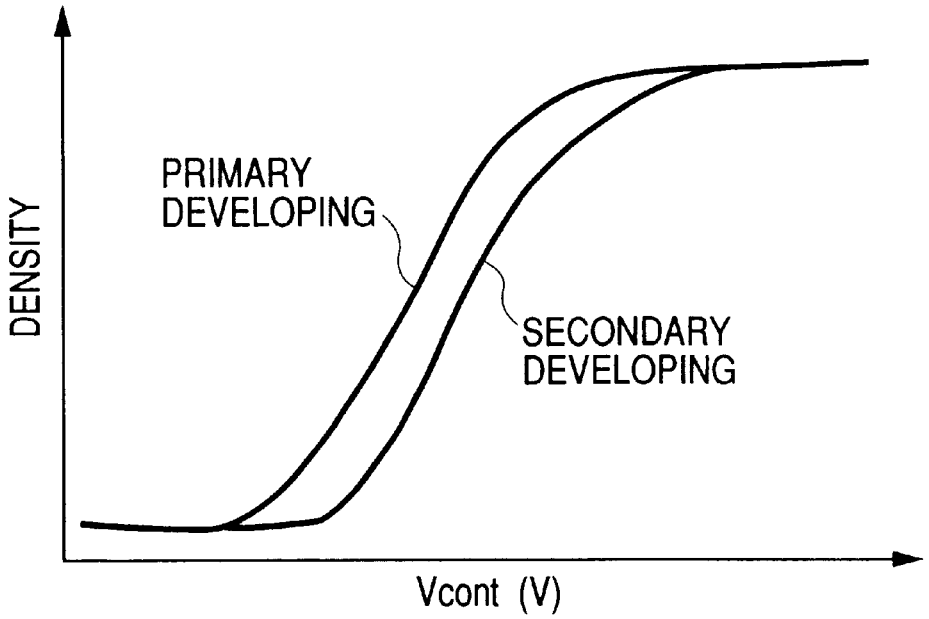
FIG. 34 is a graph showing the development characteristic of a conventional developing apparatus.

However, although the peripheral speeds of the developing sleeves 520 and 530 are the same, the actual development characteristics are different as is shown in FIG. 34. These development characteristics will now be described.

Figure 39:
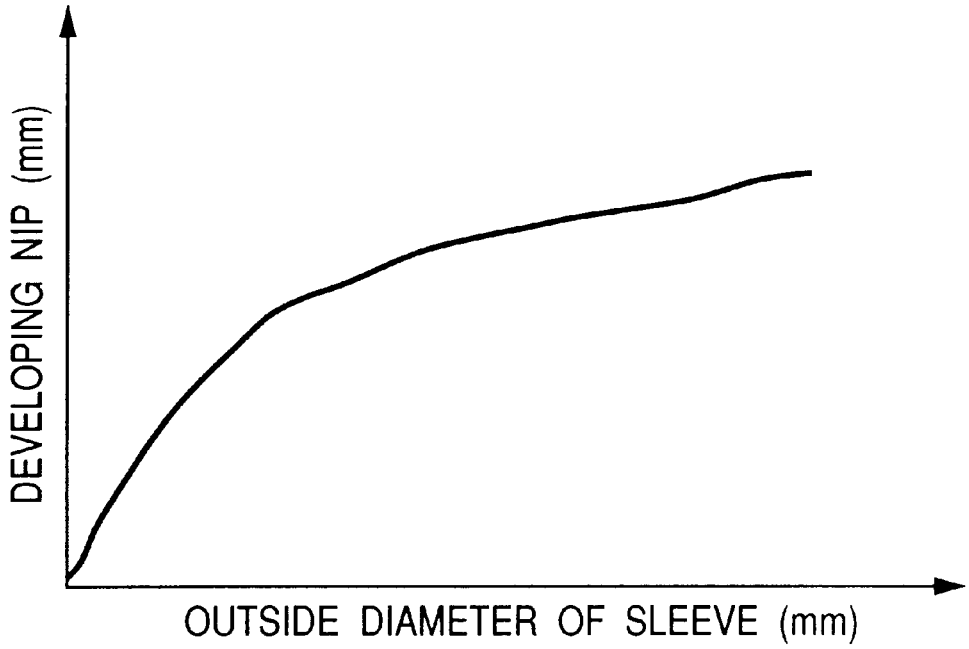
FIG. 39 is a graph showing the relationship of the outside diameter of a sleeve and the size of a developing nip.

This is because, as is shown in FIG. 39, when the outer diameter differs in the developing sleeves, the size of the developing area (developing nip) differs depending on the sleeve diameter. As the outer diameter is increased, the developing nip is also increased.

The development is basically proportional to the values of the amount of supplied toner (M/S), the triboelectricity (Q/M) that is the amount of charges per unit weight and the developing nip. That is, when the peripheral speed ratio of the developing speeds is equal, it is proportional to the amount of supplied toner (M/S)×the triboelectricity (Q/M)× the developing nip. Therefore, under the above described development conditions, the developing nip is 5.7 mm for the primary developing and 5.0 mm for the secondary developing. A difference between the two causes a difference in the development characteristics in FIG. 46. The horizontal axis in FIG. 34 represents the contrast potential Vcont (V) and the vertical axis represents the V-D characteristic that is a density.

The service life of a developing sleeve, which is the second problem, will now be explained.

Since a developing sleeve having the large outer diameter passes through the blade less frequently for the unit copy (unit time), the amount of film scraped from the sleeve is small. Therefore, when the diameters of the sleeves are ϕ 20 mm and ϕ 30 mm in this embodiment, the film on the developing sleeve having the diameter of ϕ 20 mm is scraped by about 1.6 times of the film on the sleeve having the diameter ϕ of 30 mm. As a result, the developing sleeve having the diameter ϕ of 20 mm will have to be replaced even though the service life of the developing sleeve having the diameter ϕ of 30 mm has not yet expired, and thus when the sleeve having the diameter ϕ of 30 mm is replaced later, the costs associated with the servicing provided by a maintenance man are is increased. Therefore, what is required is the equalization of the service lives of developing sleeves.

This embodiment is carried out while taking the above problem into account.

In Table 20 are shown the film formation (P/B) performed by a conventional system, how much was scraped, the amount of triboelectricity (Q/M) produced, the amount of supplied toner (M/S), the developing nip, and the amount of supplied toner (M/S)×the triboelectricity (Q/M)×the developing nip.

TABLE 20

| | First (ϕ30) | Second (ϕ20) |
|---|---|---|
| P/B | 1/2.5 | 1/2.5 |
| Scrape (μm) | 6.7 | 10.0 |
| Q/M (μC/g) | 9.1 | 9.1 |
| M/S (mg/cm$^2$) | 1.02 | 1.02 |
| Developing nip (mm) | 5.7 | 5.0 |
| Developing nip × (Q/M) × (M/S) | 52.9 | 46.41 |

To form a film, phenol plastic, crystal graphite and carbon were mixed at a weight % ratio of 100:36:4, and the mixture was cured at a temperature of 150° C. on the surface of an Al sleeve, forming a film that was 10 μm thick, the appropriate thickness of a stable and uniform film. In this case, the ratio P/B is 1/2.5. It should be noted that B denotes the weight of a resin, and P is the weight of a pigment (crystal graphite+carbon), excluding the resin.

As is apparent from Table 20, with the conventional system, during the processing of 500 k sheets, the scraping depth for the developing sleeve having the diameter ϕ of 30 mm reached 6.7 μm while the scraping depth for the developing sleeve having the diameter ϕ of 20 mm exceeded 10 μm. The developing nip and the value of the amount of supplied toner (M/S)×the triboelectricity (Q/M)×the developing nip, which is the indicator for the development characteristic, differed for the two developing sleeves. In contrast, in this embodiment the arrangement shown in Table 21 is employed to resolve the above problem.

TABLE 21

| | First (ϕ30) | Second (ϕ20) |
|---|---|---|
| P/B | 1/2.5 | 1/3 |
| Scrape (μm) | 6.7 | 6.8 |
| Q/M (μC/g) | 9.1 | 10.3 |
| M/S (mg/cm$^2$) | 1.02 | 1.03 |
| Developing nip (mm) | 5.7 | 5.0 |
| Developing nip × (Q/M) × (M/S) | 52.9 | 53.0 |

The film formation is as shown in Table 22. The weight ratio P/B of a resin (B) and a pigment (P) is so set that the value of the coating member for the developing sleeve having the small diameter is smaller than that for the developing sleeve having the large diameter. Thus, the ratio of graphite to carbon is preferably 9:1, due to the dispersion of the carbon.

TABLE 22

| | First (ϕ30) | Second (ϕ20) |
|---|---|---|
| P/B | 1/2.5 | 1/3 |
| Phenolic plastic | 100 | 100 |
| Carbon | 4.0 | 3.3 |
| Graphite | 36 | 27.9 |

The effects obtained from the above configuration are shown in Table 21.

Figure 36:
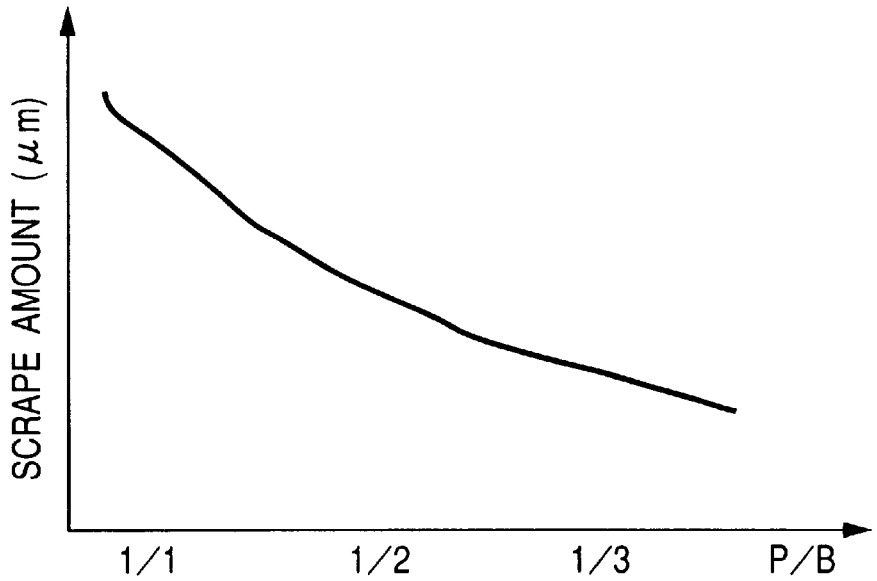
FIG. 36 is a graph showing the relationship between the P/B ratio of a film composition and how much the film was scraped.

First, during the processing performed for 500 k sheets, the developing sleeve having the diameter ϕ of 30 mm was scraped to a depth of 6.7 μm, and the developing sleeve having the diameter ϕ of 20 mm was scraped substantially the same, 6.8 μm. This is because of the characteristic shown in FIG. 36. That is, the relationship between the ratio P/B and how much the film was scraped is shown in FIG. 36, and the employed characteristic was that as the ratio P/B is increased, scraping of the film becomes easier, while as the ratio P/B is reduced, scraping of the film becomes more difficult.

Figure 35:
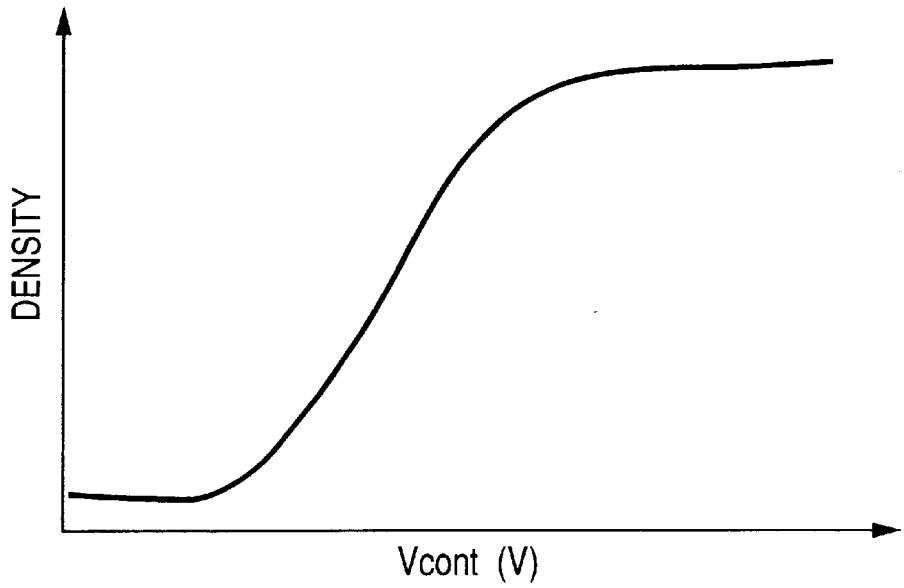
FIG. 35 is a graph showing the development characteristic of a developing apparatus.
Figure 37:
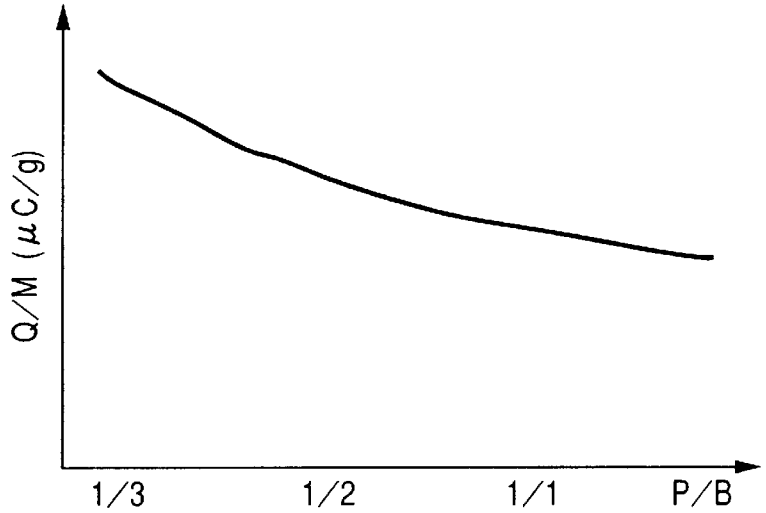
FIG. 37 is a graph showing the relationship between the P/B ratio of a film composition and the triboelectricity (Q/M)

In addition, the triboelectricity (Q/M) was greater for the developing sleeve having the diameter ϕ of 20 mm for which the developing nip was small and the development was poor. As is apparent from the relationship between the ratio P/B and the triboelectricity (Q/M) in FIG. 37, the employed characteristic was that as the ratio P/B was increased, the triboelectricity (Q/M) was reduced, while as the ratio P/B was reduced, the triboelectricity (Q/M) was increased. As a result, the amount of supplied toner (M/S)×the triboelectricity (Q/M)×the developing nip, which is the indicator of the development characteristic, can be substantially the same. Therefore, while as shown in FIG. 34 the V-D curves, which are the development characteristics, conventionally differ, V-D curves can be obtained that are substantially the same, as is shown in FIG. 35. As a result, the image tones and tone stability can be controlled, and the service lives of the developing sleeves can be equalized.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. In addition, a developing apparatus can be provided wherein, as the third objective, sleeve ghost images are eliminated and the image density is stable and high relative to a high processing speed.

<Eighth Embodiment>

An eighth embodiment of the present invention will now be described.

The image forming apparatus for this embodiment is the same as that for the seventh embodiment.

The features of the eighth embodiment are that developing sleeves are constructed more compactly by employing a highly conductive material that is difficult to scrape, and a savings in space can be provided.

A developing apparatus 502 according to this embodiment will now be described in detail.

A negative, one-component magnetic toner is employed as a developer. As is shown in FIG. 29, two developing sleeves 520 and 530 are provided as developer bearing members for the developing apparatus 502. The first developing sleeve 520 is formed by performing a blast process using FGB#600 for a non-magnetic member that has a diameter ϕ of 20 mm and is made of aluminum A2017, and by then coating the resultant non-magnetic member. Similarly, the second developing sleeve 530 is formed by performing a blast process using FGB#600 for a non-magnetic member that has a diameter ϕ of 20 mm and is made of aluminum A2017, and by then coating the resultant non-magnetic member. The film coating is performed in order to prevent the occurrence of sleeve ghost images during sleeve cycles, and to increase the durability of the sleeve surface.

The first developing sleeve 520 rotates at a speed that is 150% that of the photosensitive drum 501, and the thickness of the toner held on the developing sleeve 520 is controlled by a magnetic blade 520A. The gap S-$B_{gap}$ between the first developing sleeve 520 and the magnetic blade 520A is set at 250 μm, and the gap S-$D_{gap}$ between the sleeve 520 and the photosensitive drum 501 is set at 200 μm. A DC bias voltage of +200 V and an AC bias voltage, a rectangular wave $V_{pp}$ of 1200 V that has a frequency of 2.5 kHz, as is shown in FIG. 33, are applied to the first developing sleeve 520 to perform one-component non-contact magnetic development. Therefore, the developing contrast is 300 V in the toner dispersing direction, and the fog removal contrast is 100 V.

The second developing sleeve 530 is obtained by forming a film on a non-magnetic member that has a diameter ϕ of 15 mm and is made of aluminum A2017. A DC bias voltage of +200 V and an AC bias voltage, a rectangular wave $V_{pp}$ of 1200 V that has a frequency of 2.5 kHz, as is shown in FIG. 33, are applied to the second developing sleeve 530. Since the voltage application means is the same as the first developing sleeve 520 and since only one power source is required, the manufacturing costs can be reduced and only a small area is required for the power source. The second developing sleeve 530 rotates at a speed that is 150% that of the photosensitive drum 501, and the magnetic blade 530A is employed to control the thickness of a toner layer. The gap S-$B_{gap}$ is set at 250 μm, and the gap S-$D_{gap}$ is set at 200 μm. The magnetic blades 520A and 530A are the same as those for the seventh embodiment.

The features of this embodiment will now be described.

For the eighth embodiment, epoxy resin was used as resin (B), and titanium oxide ($TiO_2$) and carbon were employed as pigments (P). This film is more durable than the film in the seventh embodiment, and is highly charged by negative charging. The results using this film are shown as follows.

In Table 23 are shown the film formation (P/B) performed by a conventional system, how much was scraped, the triboelectricity (Q/M) produced, the amount of supplied toner (M/S), the developing nip, and the amount of supplied toner (M/S)×the triboelectricity (Q/M)×the developing nip.

TABLE 23

| | First (ϕ20) | Second (ϕ15) |
|---|---|---|
| P/B | 1/2.5 | 1/2.5 |
| Scrape (μm) | 5.2 | 7.0 |
| Q/M (μC/g) | 9.8 | 9.8 |
| M/S (mg/cm$^2$) | 1.01 | 1.02 |
| Developing nip (mm) | 5.0 | 4.4 |
| Developing nip × (Q/M) × (M/S) | 49.49 | 43.98 |

To form the film, epoxy resin, $TiO_2$ and carbon were mixed at a weight % ratio of 100:36:4, and the mixture was cured at a temperature of 150° on the surface of an Al sleeve to form a film 10 μm thick, the appropriate thickness for a stable and uniform film. In this case, the ratio P/B was 1/2.5. It should be noted that B denotes the weight of a resin, and P is the weight of a pigment (crystalline graphite+carbon) excluding the resin.

As is apparent from Table 23, using the conventional system, during the processing for 500 k sheets, the developing sleeve having the diameter ϕ of 20 mm was scraped to a depth of 5.2 μm, while the developing sleeve having the diameter ϕ of 15 mm was scraped to a depth of 7.0 μm. The developing nip and the value of the amount of supplied toner (M/S)×the triboelectricity (Q/M)×the developing nip, which is the indicator for the development characteristic, differed for the two developing sleeves.

Therefore, in this embodiment, the arrangement shown in Table 24 is employed to resolve the above problem.

TABLE 24

| | First (ϕ20) | Second (ϕ15) |
|---|---|---|
| P/B | 1/2.5 | 1/3 |
| Scrape (μm) | 5.2 | 5.4 |
| Q/M (μC/g) | 9.8 | 11.0 |
| M/S (mg/cm$^2$) | 1.01 | 1.02 |
| Developing nip (mm) | 5.0 | 4.4 |
| Developing nip × (Q/M) × (M/S) | 49.49 | 49.37 |

The film formation is as shown in Table 25. The weight ratio P/B of a resin (B) and a pigment (P) is set so that a small value of the coating member is set for the developing sleeve having a small diameter than for the developing sleeve having a large diameter. Thus, the ratio of $TiO_2$ to carbon is preferably 9:1, due to the dispersion of carbon.

TABLE 25

| | First (ϕ20) | Second (ϕ15) |
|---|---|---|
| P/B | 1/2.5 | 1/3 |
| Epoxy resign | 100 | 100 |

TABLE 25-continued

| | First (ϕ20) | Second (ϕ15) |
|---|---|---|
| Carbon | 4.0 | 3.3 |
| $TiO_2$ | 36 | 27.9 |

The effects obtained by the above configuration are shown in Table 24.

First, during the processing performed for 500 k sheets, the developing sleeve having the diameter ϕ of 20 mm was scraped to a depth of 5.2 μm, and the developing sleeve having the diameter ϕ of 15 mm was scraped to substantially the same depth, 5.4 μm. This means that the film was not scraped, even though the diameters of the sleeves were reduced. As well as in the above embodiment, the characteristic that was employed was that as the ratio P/B was increased, the scraping of the film became easier, while as the ratio P/B was reduced, scraping the film became more difficult.

In addition, the triboelectricity (Q/M) could be greater for the developing sleeve having the diameter ϕ of 15 mm for which the developing nip was small and the development was poor. The employed characteristic was that as the ratio P/B was increased, the triboelectricity (Q/M) was reduced, while as the ratio P/B was reduced, the triboelectricity (Q/M) was increased. As a result, the amount of supplied toner (M/S)×the triboelectricity (Q/M)×the developing nip, which is the indicator of the development characteristic, can be substantially the same. Therefore, the V-D curves, which are the development characteristics, can be obtained that are substantially the same. As a result, the image tones and tone stability can be controlled, and the service lives of the developing sleeves can be equalized. In addition, the space required for the developing apparatus 502 can be reduced by selecting the above materials.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that provides a high density.

In addition, a developing apparatus having a service life of 900,000 sheets can be provided wherein, as the third objective, the image density is stable and high, relative to high processing speed, and the required space is reduced.

<Ninth Embodiment>

A ninth embodiment of the present invention will now be described.

The feature of this embodiment is that the developing apparatus according to this invention is employed for a reuse image forming apparatus.

Figure 38:
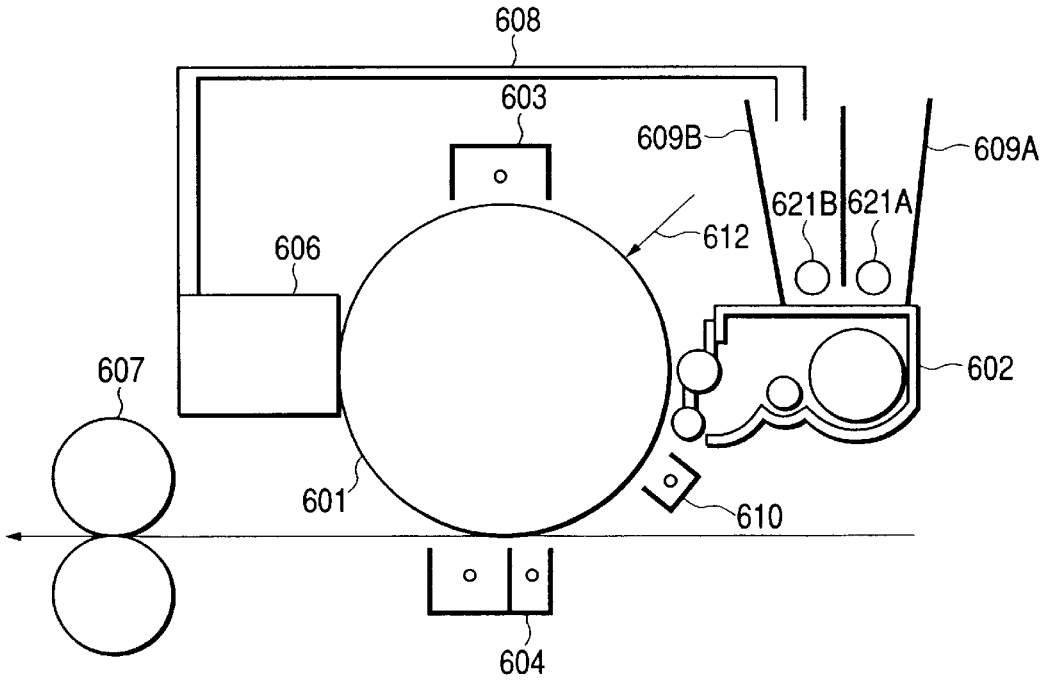
FIG. 38 is a cross-sectional view of the essential portion of a reuse image forming apparatus that includes a developing apparatus according to a ninth embodiment of the present invention.

For this embodiment, an explanation will now be given for a digital copier, functioning as the image forming apparatus shown in FIG. 38, that employs as a photosensitive drum 601 an a-Si drum.

The processing speed of the digital copier is 560 mm per second and 115 sheets per minute. The surface of the photosensitive drum 601 is uniformly charged to +500 V by a primary charger 603, and then, PWM exposure process 612 is performed at 600 dpi, by a semiconductor laser having a wavelength of 680 μm, to form an electrostatic latent image on the photosensitive drum 601.

Following this, the electrostatic latent image is normally developed by a developing apparatus 602 to visualize it as a toner image. A negative one-component magnetic toner is employed as a developer to perform jumping development, and the particle diameter of the toner is 6.0 μm. When the conventional two-component developer is employed, a carrier must be replaced by a maintenance man every 100,000 sheets, and because of maintenance free, the merits of the reuse system are not very well displayed. Thus, in this embodiment, a dry one-component magnetic toner is employed for which durability can be ignored and maintenance is not required. The development bias voltage is obtained by superimposing a DC voltage of +200 V and an AC voltage having a frequency of 2000 Hz, 1500 $V_{pp}$ and a duty ratio of 50% on both the first and the second developing sleeves. The S-$B_{gap}$ is set at 250 μm and the S-$D_{gap}$ is set at 250 μm. Then, a post charger 610 supplies a total current of −200 μA to charge the toner image, and a transfer charger 604 transfers the toner image to a transfer material that is fed in the direction indicated by an arrow. The transfer material bearing the toner image is then transmitted to a fixing unit 607, which fixes the toner image to the transfer material.

The residual toner after transfer on the photosensitive drum 601 is removed and is collected by a cleaning unit 606, and the waste toner (reuse toner) is returned via a conveyor pipe 608 to a developing hopper 609B. A screw-shaped conveyor member is provided in the conveyor pipe 608, and as the conveyor member is rotated, the reuse toner is transported. For reuse, the reuse toner is collected in the developing hopper 609B.

The new toner is retained in a hopper 609A. The new toner is attracted by the magnetic forces of magnetic rollers 621A and 621B, and is fed to the developing apparatus 602 as the rollers 621A and 621B are rotated. In this embodiment, a method for mixing the waste toner and the new toner in the developing apparatus 602 is employed, but space may be defined in the hopper for mixing these toners.

The toner mixed in the developing apparatus 602 is again fed to the developing sleeves, and is used to develop an electrostatic latent image on the photosensitive drum 601. The normal rotational speed of the magnetic roller 621A is two revolutions per minute, and the rotational speed of the magnetic roller 621B is changed. When the weight of the toner is not applied to a piezosensor (produced by TDK) in the developing apparatus 602, and the piezosensor is vibrated, a toner supply signal is generated. Generally, the ratio of the amount of toner supplied by the magnetic roller 621B to that supplied by the magnet roller 621B is 10/90 (magnetic roller 621A: magnetic roller 621B=9:1).

The arrangement of the developing apparatus 602 in this embodiment is the same as that for the eighth embodiment, i.e., the film is formed of epoxy resin, $TiO_2$ and carbon, and the diameters of the developing sleeves are ϕ 20 mm and ϕ 15 mm.

The effects obtained in this embodiment are shown in Table 26.

TABLE 26

| | First (ϕ20) | Second (ϕ15) |
|---|---|---|
| P/B | 1/2.5 | 1/3 |
| Scrape (μm) | 6.0 | 6.2 |

TABLE 26-continued

| | First (φ20) | Second (φ15) |
|---|---|---|
| Q/M (μC/g) | 7.5 | 8.5 |
| M/S (mg/cm$^2$) | 1.01 | 1.02 |
| Developing nip (mm) | 5.0 | 4.4 |
| Developing nip × (Q/M) × (M/S) | 37.88 | 38.15 |

As is shown in Table 26, during the processing performed for 500 k sheets, the developing sleeve having the diameter φ of 20 mm was scraped to a depth of 6.0 μm, and the developing sleeve having the diameter φ of 15 mm was scraped substantially the same, 6.2 μm. This means that the service life was long enough for the processing of about 800 k sheets, despite of the cohesion of the reused waste toner.

In addition, the triboelectricity (Q/M) could be greater for the developing sleeve having the diameter φ 15 mm for which the developing nip was small and the development was poor, and was 7.5 and 8.5 even though the deteriorated toner was employed. Therefore, the value of the amount of supplied toner (M/S)×the triboelectricity (Q/M)×the developing nip, which is the indicator for the development characteristic, was substantially equal, and as a result, the V-D curves, which are the development characteristics, were substantially the same. As a result, a reuse system can be provided for which the image tones and tone stability can be controlled, and the service lives of the developing sleeves can be equalized.

With the above arrangement, in a developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, the image density is stable and high relative to a high processing speed, and the space required is reduced.

As is apparent from the above explanation, according to the above embodiments, requests can be satisfied for image tones and the tone stability that can cope with recent digital images and graphics.

Furthermore, since the service lives of the developer bearing members are equalized, some of the labor for which a maintenance man is required is eliminated, and maintenance costs are reduced.

In addition, the occurrence of a sleeve ghost image can be prevented, and stable development and density can be provided relative to increase of the process speed.

<Tenth Embodiment>

Figure 42:
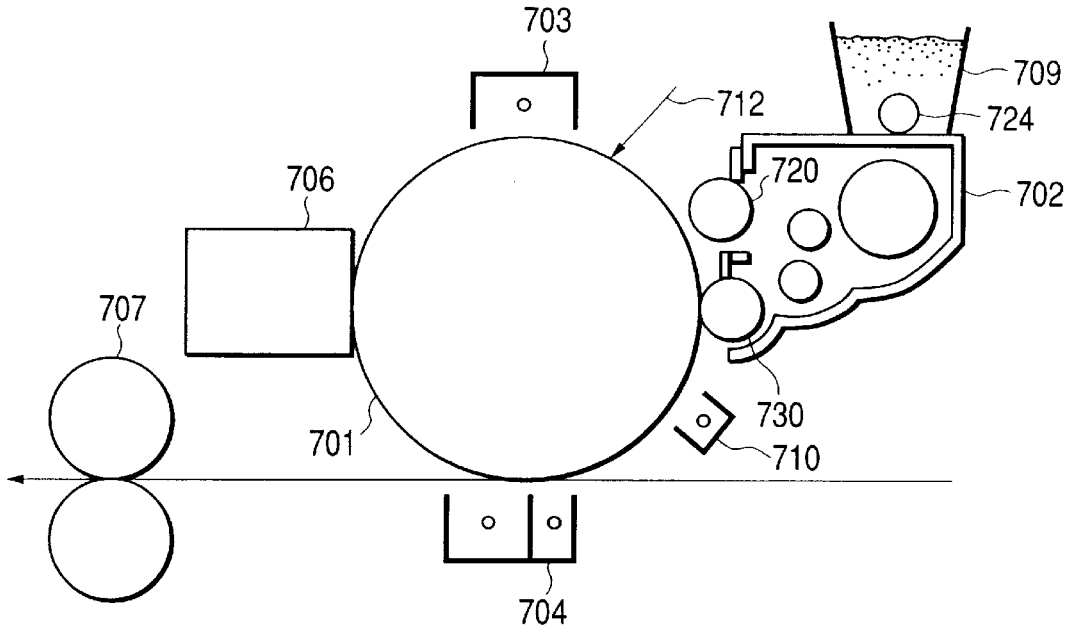
FIG. 42 is a cross-sectional view of the essential portion of an image forming apparatus that includes the developing apparatus according to the tenth embodiment of the present invention.

FIG. 42 is a cross-sectional view of the essential portion of an image forming apparatus that includes a developing apparatus according to the present invention. The image forming apparatus is a black and white digital copier that can output 90 sheets per minute at a processing speed of 480 mm/sec, and that employs, as a photosensitive member, an a-Si photosensitive drum 701 having a diameter φ of 108 mm. The relative dielectric constant of a-Si is approximately 10, which is greater than that of an organic photosensitive material, but the charge potential is relatively low and, when compared with OPC, a satisfactory latent image potential is not obtained. However, since a photosensitive drum 1 composed of a-Si is durable and has a service life of 3 million sheets or more, it is appropriate for use in a fast, image-forming apparatus.

The photosensitive drum 701 is uniformly charged to +500 V, for example, by a charger 703, and image exposure 712 is performed at 600 dpi. For the image exposure 712, a first laser beam is employed that is obtained by modulating a semiconductor laser source in accordance with a first image signal. The first laser beam is polarized by a polygon mirror that is rotated by a motor at a predetermined revolution speed, and the polarized beam passes through a focusing lens and is reflected by a return mirror. The reflected beam raster-scans the photosensitive drum 701, and the surface potential of the exposed portion is reduced to +100 V, for example, to form a latent image on the photosensitive drum 701. It should be noted that the wavelength of the laser beam is 680 nm.

Following this, the latent image formed on the photosensitive drum 701 is normally developed by a developing apparatus 702 and is visualized as a toner image. A post charger 710 charges the toner to the positive, and attraction force exerted between the photosensitive drum 701 and the toner is reduced so that a transfer material is easily transferred and separated.

Figure 40:
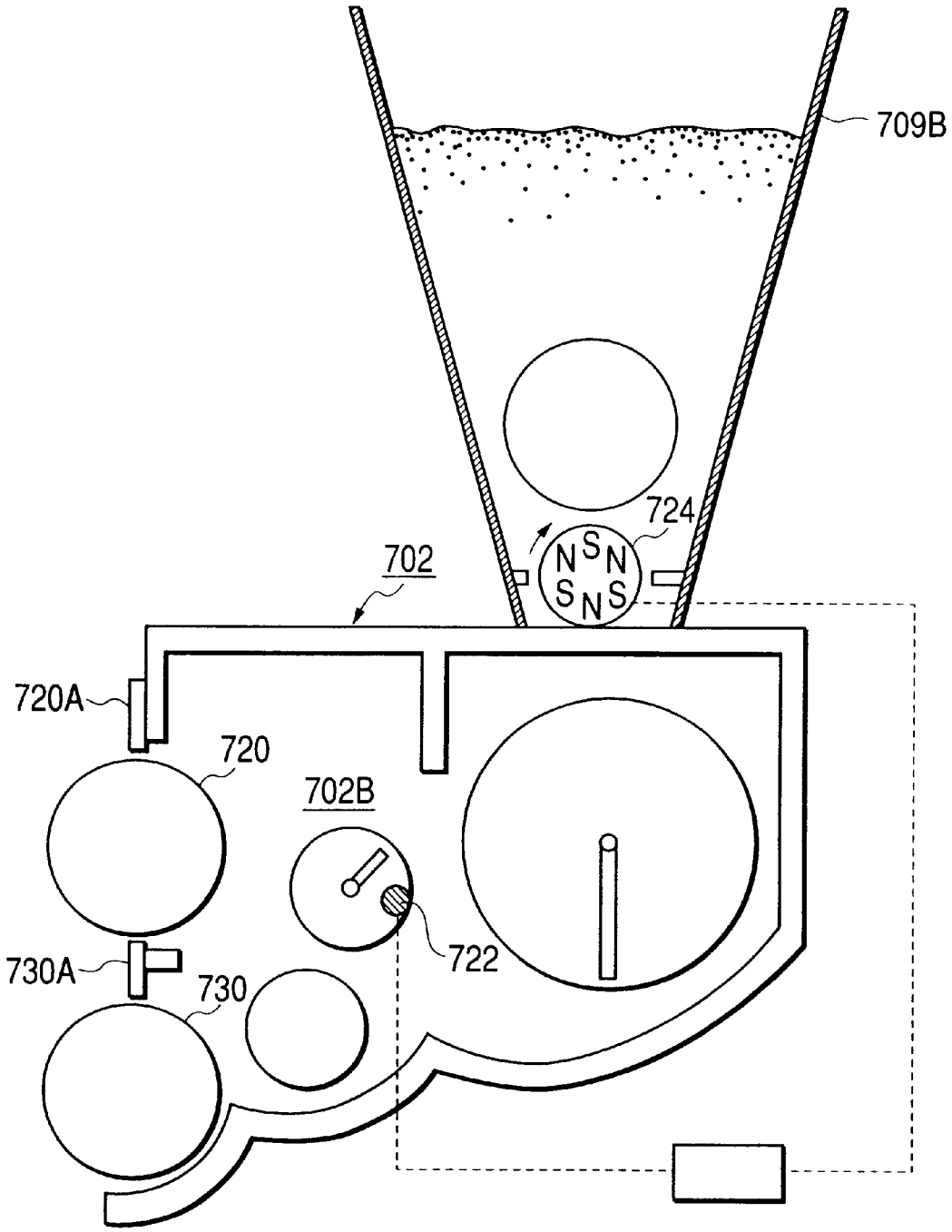
FIG. 40 is a cross-sectional view of a developing apparatus according to a tenth embodiment of the present invention.

In this embodiment, the developing apparatus 702 employs a simple and stable development method using a one-component magnetic developer, for which no maintenance is required until the service life of the developing sleeve has expired. The toner is a positive toner that has a particle diameter of 8.0 μm and that contains the weight % of 1.0 of $SiO_2$ as an outward additive. In this embodiment, the reversal developing process is performed using a plurality of developer bearing members (developing sleeves) 720 and 730. When toner near a portion 702B in FIG. 40 is exhausted, rotation of a magnetic roller 724 is begun upon the receipt of a signal from a piezoelectric element 722, and as the magnetic roller 724 is rotated, the supply of toner in the developing apparatus 702 is replenished from a hopper 709B.

After the electrostatic latent image has been developed and visualized as a toner image by the developing apparatus 702, the post charger 710 supplies a total current (AC+DC) of +200 μA and charges the toner image. The toner image is then transferred by a transfer charger 704 to a transfer material that is fed in the direction indicated by an arrow, and the transfer material bearing the toner image is conveyed to a fixing unit 707 where the toner image is fixed to the transfer material.

Figure 41:
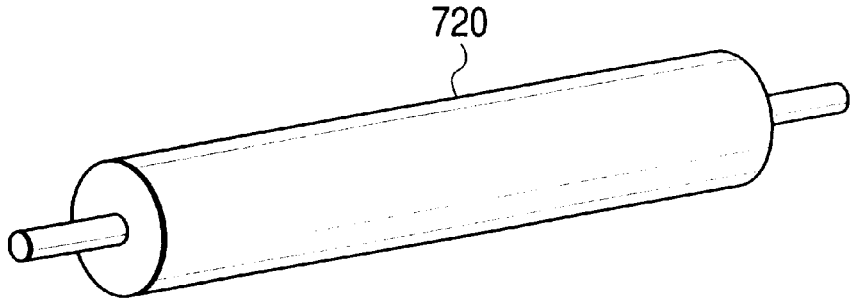
FIG. 41 is a perspective view of a developing sleeve in the developing apparatus according to the tenth embodiment of the present invention.

The developing apparatus 702 according to the present invention will now be described in detail while referring to FIGS. 40 and 41. FIG. 40 is a cross-sectional view of the developing apparatus, and FIG. 41 is a perspective view of the developing sleeve 720 of the developing apparatus.

In this embodiment, the developing apparatus 702 employs, as a simple developer, a positive, one-component magnetic toner that is durable, reliable and highly productive and for which no maintenance is required. When the a-Si photosensitive drum 501 is employed as the electrostatic latent image bearing member of the fast image forming apparatus in this embodiment, smudging occurs and the first image printed each day is smeared, while the a-Si material is affected by temperature. To prevent this problem and to stabilize the a-Si, a drum heater is incorporated in the a-Si photosensitive drum 701. When SUS is employed for the developing sleeves, since the thermal conductivity is small, the sleeves are deformed due to the heat of the drum heater. Therefore, aluminum that has a high thermal conductivity and that will be only slightly thermally deformed due to the drum heater is appropriate for the developing sleeves; however, the abrasion resistance of aluminum is considerably lower than that of SUS.

Therefore, in order to increase its abrasion resistance, the surface of aluminum may be cured by plating it with Ni—P, Ni—B or Cr. And when positive magnetic toner is coated with a resin, such as phenol resin, the toner is not normally charged because originally the charging polarity is the one for the negative charging of toner, and in this case the toner is not as dense as at the initial stage. Whereas it has been found that, of the various plating materials available, Ni—P, Ni—B and Cr can also satisfactorily charge the positive toner, another objective for coating using these plating materials is the suppression of the occurrence of ghost images. The occurrence of a ghost image is due to the charging of the developer on the surface of a developing sleeve. When the surface of a developing sleeve is coated with an Ni—P plated layer, an N-B plated layer or a Cr plated layer, the occurrence of ghost images can be suppressed.

As is shown in FIG. 40, two developing sleeves 720 and 730 are provided as developer bearing members for the developing apparatus 702. The first developing sleeve 720 is formed by performing a blast process with FGB#600 (Rz 3.0 $\mu$m) for a non-magnetic member that has a diameter of $\phi$30 mm and is made of aluminum A2017, and by plating the resultant member with Ni—P, as is shown in FIG. 41. Similarly, the second developing sleeve 730 is formed by performing a blast process with FGB#600 (Rz 3.0 $\mu$m) for a non-magnetic member that has a diameter of $\phi$30 mm and is made of aluminum A2017, and by plating the resultant member with Ni—P. The Ni—P plating is performed to prevent the occurrence of sleeve ghost images at a sleeve cycle and to increase the durability of the surfaces of the developing sleeves (the film is formed to protect the Al surface). The Ni—P plated layer is a non-magnetic electroless plated layer that contains 8% of P in Ni.

Figure 43:
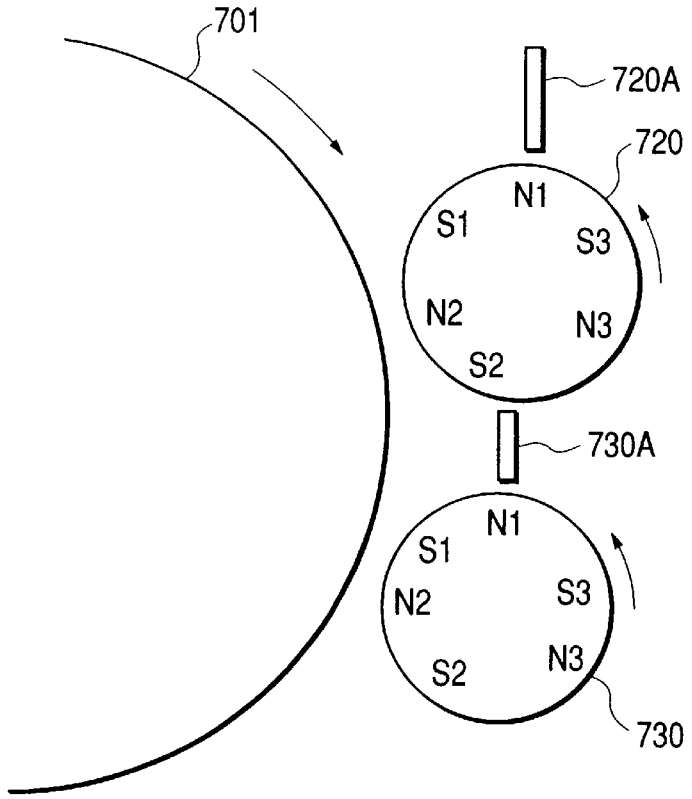
FIG. 43 is a cross-sectional view of the arrangement of the magnetic poles of the developing sleeves of the developing apparatus according to the tenth embodiment of the present invention.

A fixed magnet is incorporated in the first developing sleeve 720, which has a magnetic field pattern formed by the six poles (N1 to N3 and S1 to S3) shown in FIG. 43 and Table 27.

TABLE 27

| Magnet pole | Magnetic force (G) | Angle (°) | Half value width (°) |
|---|---|---|---|
| N1 | 900 | 0 | 36 |
| N2 | 950 | 60 | 46 |
| N3 | 550 | 220 | |
| S1 | 900 | 120 | |
| S2 | 500 | 175 | |
| S3 | 700 | 270 | |

Figure 44:
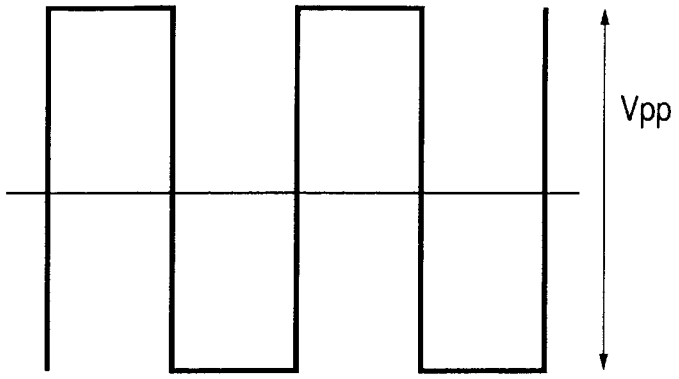
FIG. 44 is a diagram showing a development bias waveform.

The first developing sleeve 720 rotates at a speed 120% that to the photosensitive drum 701, and the thickness of the toner held on the developing sleeve 720 is controlled by a magnetic blade 720A. The gap S-$B_{gap}$ between the first developing sleeve 720 and the magnetic blade 720A is set at 250 $\mu$m, and the gap S-$D_{gap}$ between the sleeve 720 and the photosensitive drum 701 is set at 250 $\mu$m. A DC bias voltage of +400 V and an AC bias voltage, a rectangular wave $V_{pp}$ of 1500 V that has a frequency of 2.5 kHz, as is shown in FIG. 44, are applied to the first developing sleeve 720 to perform one-component non-contact magnetic development. Therefore, the developing contrast is 300 V in the toner dispersing direction, and the fog removal (toner returning) contrast is 100 V.

The second developing sleeve 730 is obtained by forming a film on a non-magnetic member that has a diameter $\phi$ 30 mm and is made of aluminum A2017. A magnet is provided internally for the second developing sleeve 730 and has a magnetic field pattern formed by the six poles (N1 to N3 and S1 to S3) shown in FIG. 43 and Table 28.

TABLE 28

| Magnet pole | Magnetic force (G) | Angle (°) | Half value width (°) |
|---|---|---|---|
| N1 | 900 | 330 | 36 |
| N2 | 950 | 30 | 46 |
| N3 | 500 | 190 | |
| S1 | 850 | 90 | |
| S2 | 500 | 145 | |
| S3 | 600 | 240 | |

A DC bias voltage of +400 V and an AC bias voltage, a rectangular wave $V_{pp}$ of 1500 V that has a frequency of 2.5 kHz, as is shown in FIG. 44, are applied to the second developing sleeve 730. Since the second developing sleeve 730 is the same as the first developing sleeve 720 and only on e power source is required, the manufacturing costs can be reduced and only a small area is required for the power source.

The second developing sleeve 730 rotates at a speed 170% that of the photosensitive drum 701. Generally, the peripheral speed frequently differs depending on the location of the developing apparatus 702 and the gear ratio. The toner layer held on the developing sleeve 730 is controlled by the magnetic blade 730A. The gap S-$D_{gap}$ between the second developing sleeve 730 and the photosensitive drum 701 is set at 250 $\mu$m, and the gap S-$B_{gap}$ between the second developing sleeve 730 and the magnetic blade 730A is set to 250 $\mu$m.

Figure 45:
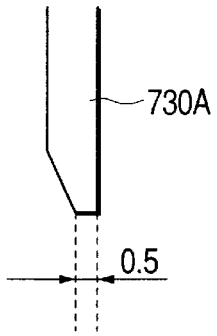
FIG. 45 is an enlarged cross-sectional view of the shape of the tip of the magnetic blade of the developing apparatus according to the tenth embodiment of the present invention.

The magnetic blades 720A and 730A are plate-shaped magnetic blades of 1.0 mm thick, and at the distal end of the magnetic blade 730A having thickness of 0.5 mm is tapered as is shown in FIG. 45. Since the peripheral speed differs for the first developing sleeve 720 and the second developing sleeve 730, a different amount of toner is supplied to the photosensitive drum 701 each unit time. The second developing sleeve 730 is tapered in order to correct for that difference. With this setup, the amounts of toner (M/S) coating the developing sleeves 720 and 730 are changed, and are set as approximately 1.0 mg/cm$^2$ and 0.7 mg/cm$^2$, as is shown in Table 29 to equalize the peripheral speed×M/S. Equalization of the amount of toner supplied per unit time is the most important factor contributing to the matching of the development conditions of the developing sleeves and to the stabilizing of the image tones.

TABLE 29

| | First (120%) | Second (170%) |
|---|---|---|
| Δa | 0.08 | 0.04 |
| Ni-P film thickness ($\mu$m) | 10 | 20 |
| Q/M | 30k | 30k |
| ($\mu$c/g) | 8.3 | 8.1 |
| Blade thickness (mm) | 1.0 | 0.5 |

TABLE 29-continued

| | First (120%) | Second (170%) |
|---|---|---|
| M/S (mg/cm$^2$) | 0.98 | 0.69 |
| M/S × peripheral speed ratio | 1.18 | 1.17 |
| Q/M × M/S × peripheral speed | 9.79 | 9.48 |

In order to satisfy requests for image tones and tone stability that can cope with current digital images and graphics, the important problem is the matching of the development characteristics of the developing sleeves 720 and 730 (the primary developing and the secondary developing). As is described above, the same amount of toner is supplied per unit time to the first and the second developing sleeves 720 and 730, the development pole of the first developing sleeve 720 is N2, while the development pole of the second developing sleeve 730 is S1, and the magnetic force and the half value width are the same for both sleeves.

Figure 46:
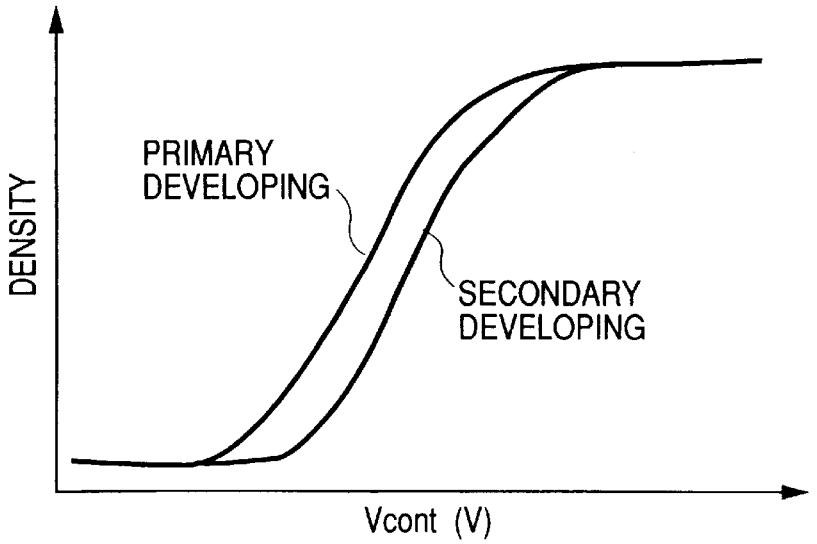
FIG. 46 is a graph showing the development characteristic of a conventional developing apparatus.
Figure 47A:
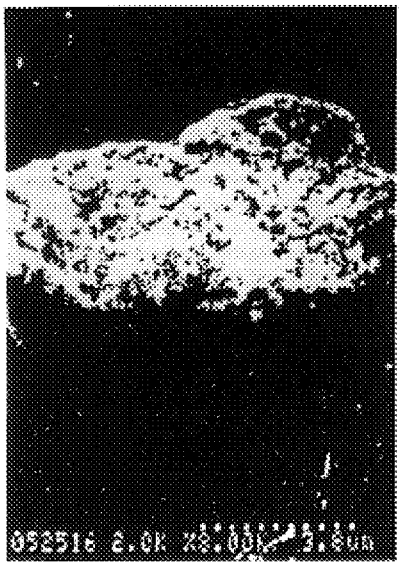
FIGS. 47A, 47B, 47C and 47D are diagrams showing SEM photos of toner.
Figure 47B:
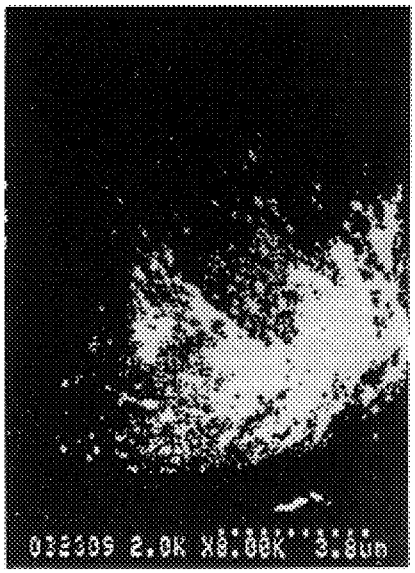
Figure 47C:
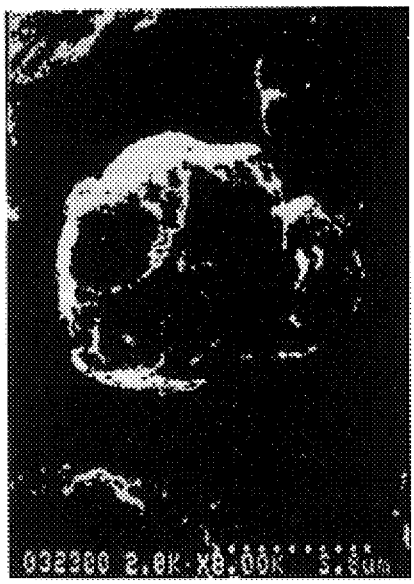
Figure 47D:
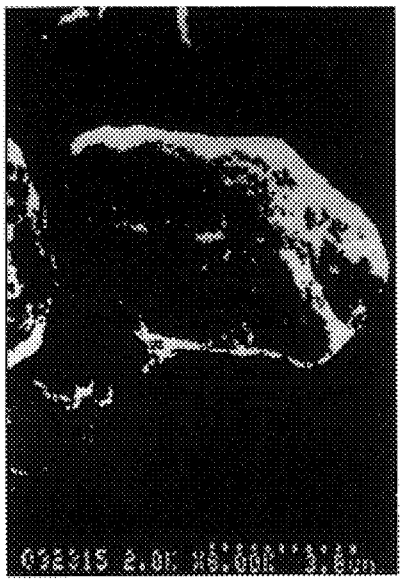

However, the development characteristic for the durability required for processing 30 k sheets differs for the two developing sleeves 720 and 730, as is shown in FIG. 46 (the upper line represents the primary developing and the lower line represents the secondary developing). These development characteristics will now be described.

Figure 48:
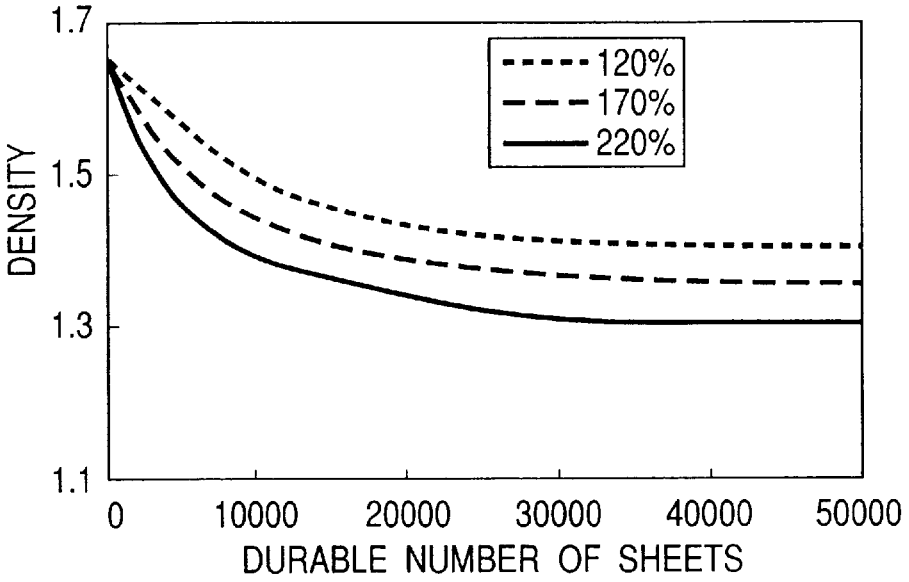
FIG. 48 is a graph showing the relationship between the durable number of sheets and a density having a peripheral speed ratio as a parameter.
Figure 49:
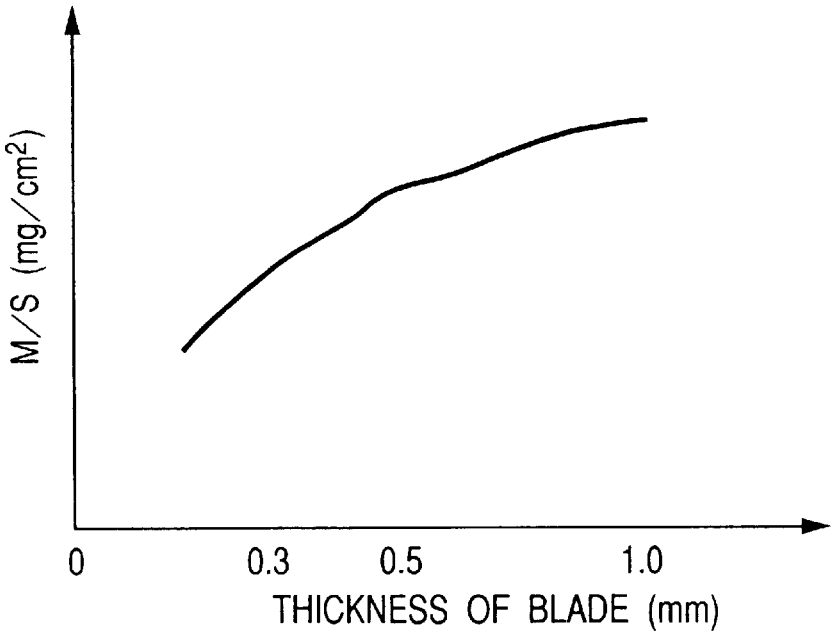
FIG. 49 is a graph showing the relationship between the thickness of a blade and a toner coating volume (M/S)

In a machine especially having the process speed of 400 mm/s or higher employs a plurality of developing sleeves, since the rotational speed of the developing sleeve is high in accordance with the increase of the process speed, the mechanical share applied to toner by the toner layer control portion is great as the speed is high. This phenomenon is shown in FIGS. 47A, 47B, 47 47C and 47D. FIGS. 47A, 47B, 47C and 47D are SEM photos of toners on the developing sleeve after processing of 30 k sheets when the peripheral speed ratios of the developing sleeve to the photosensitive drum are 120%, 170% and 220%. Compared with new toner, it is apparent that as the speed of the developing sleeve is increased, outward additive $SiO_2$ (particle diameter of about 7 nm) coating the surface of the toner is embedded in the toner and the surface of the toner becomes smooth. This is because the share received by the toner is increased as the speed is increased, and the toner is deteriorated. As a result, the charging (triboelectricity) is reduced due to the mechanical deterioration of the toner. FIG. 48 is a graph showing the shifting of the durable density when, in order to supply the constant amount of toner, the peripheral speed ratio of the developing sleeves is 120%, 170% and 220%, while the thickness of the blade is set at 1.0 mm, 0.5 mm and 0.3 mm, and the amount of coating toner (MiS) is adjusted to equalize the peripheral speed×M/S to 1.2. The property that, as is shown in FIG. 49, as the blade is thin, M/S can be reduced is employed to set M/S and the thickness of the blade. As is apparent from FIG. 49, after the processing of approximately 20 k sheets, the density differs. This means that the degree of deterioration of the toner relative to the sleeve speed differs, and that the contamination by toner on the surface of the sleeve is continued, and the reduction of triboelectricity due to them is the main cause. This difference causes a difference in the development characteristics in FIG. 46 (30 k sheets). The horizontal axis in FIG. 46 represents the contrast potential Vcont (V), and the vertical axis represents the V-D characteristic that is a density.

When the developing sleeves have the same diameter and the same amount of toner is supplied, basically the development characteristic is proportional to the triboelectricity (Q/M) of the toner.

The service life of a developing sleeve, which is the second problem, will now be explained.

Figure 50:
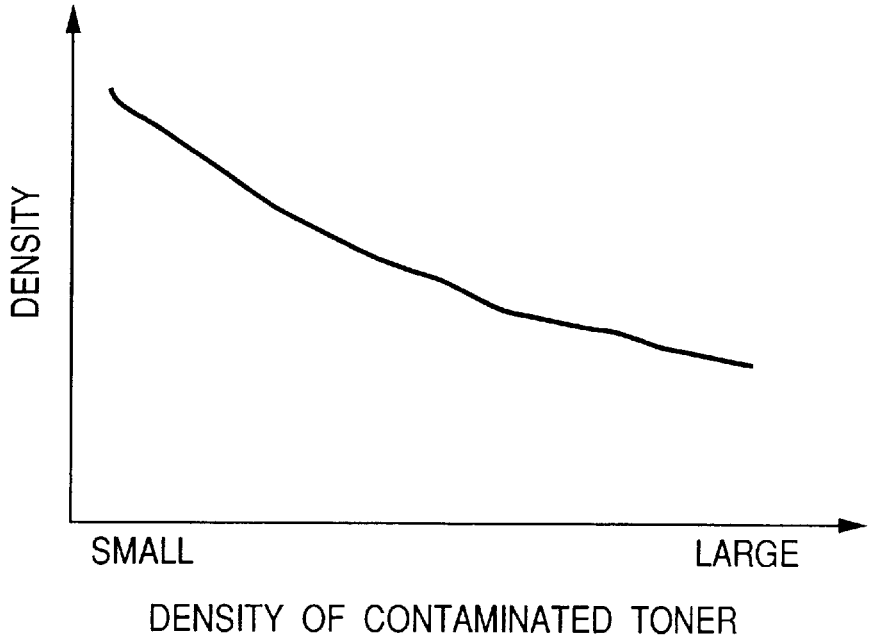
FIG. 50 is a graph showing the relationship between a contaminated toner density and an image density.

The cohesion of positive charged toner is 60 to 70%, which is higher than the cohesion, about 20%, of negative charged toner. Sleeve contamination depends on the share that the developing sleeve receives from the toner at the toner layer control portion. As the speed increases, a developing sleeve is more easily contaminated. In the long run, during use the developer or the element in the developer will melt easily and stick to uneven portions of the rough surface, so that the surface is contaminated. When such a phenomenon occurs, toner that is piled on the toner attached to the contaminated surface can not contact the surface of the developing sleeve, and charging is difficult. Thus, the image density is reduced. This is called sleeve contamination. This phenomenon is shown in FIG. 50. The horizontal axis in FIG. 50 represents the density of the contaminated toner that is attached to the developing sleeve, while the vertical axis represents the actual image density. It is apparent from FIG. 48 that as the amount of toner attached to the surface of a developing sleeve is increased, the image density is correspondingly reduced. The reduction in the density due to sleeve contamination and the mechanical deterioration of toner determine the service life of a developing sleeve. In this embodiment, when the density is equal to or lower than 1.2, it is ascertained that the service life of the developing sleeve has expired.

When the developing sleeves rotate at different speeds, the faster sleeve passes by the blade more frequently for a specific number of copy units (during a unit time) than the slower sleeve, and receives a greater mechanical shear because its speed is higher. The surface of the developing sleeve basically receives the greatest share at the toner control portion. Therefore, if as in this embodiment the peripheral speeds of the developing sleeves differ, the second developing sleeve 730, which is contaminated, must be replaced even though the service life of the first developing sleeve 720 has still not expired. Later, when the second developing sleeve 720 must be replaced, the labor cost for the maintenance man is increased accordingly, so that equalization of the service lives of the developing sleeves is needed.

This embodiment is carried out to resolve the above problem.

In order to prevent sleeve contamination, a developing sleeve must be employed that has a surface which is so shaped it is difficult for the developer to be attached to it. Surface shape parameters that generally represent the shape of the surface are Ra (an average roughness along the center line) and Rz (an average roughness at ten points). Though these conventional parameters are employed, correlation with the attachment of toner (contamination) can not be obtained. Further, as a method for preventing or reducing contamination, additional smoothing of the surface of the developing sleeve is required. However, if the surface is merely smoothed, deterioration of the delivery of toner occurs, and it is difficult to supply an adequate amount of toner to develop a latent image on a photosensitive drum.

Figure 51:
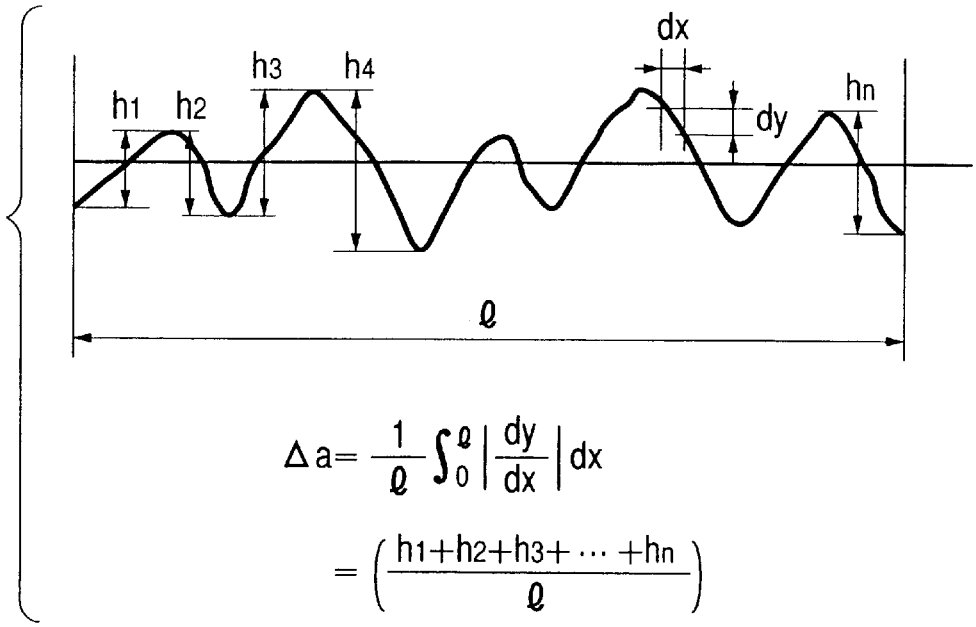
FIG. 51 is a diagram for explaining Δa (average inclination)
Figure 52:
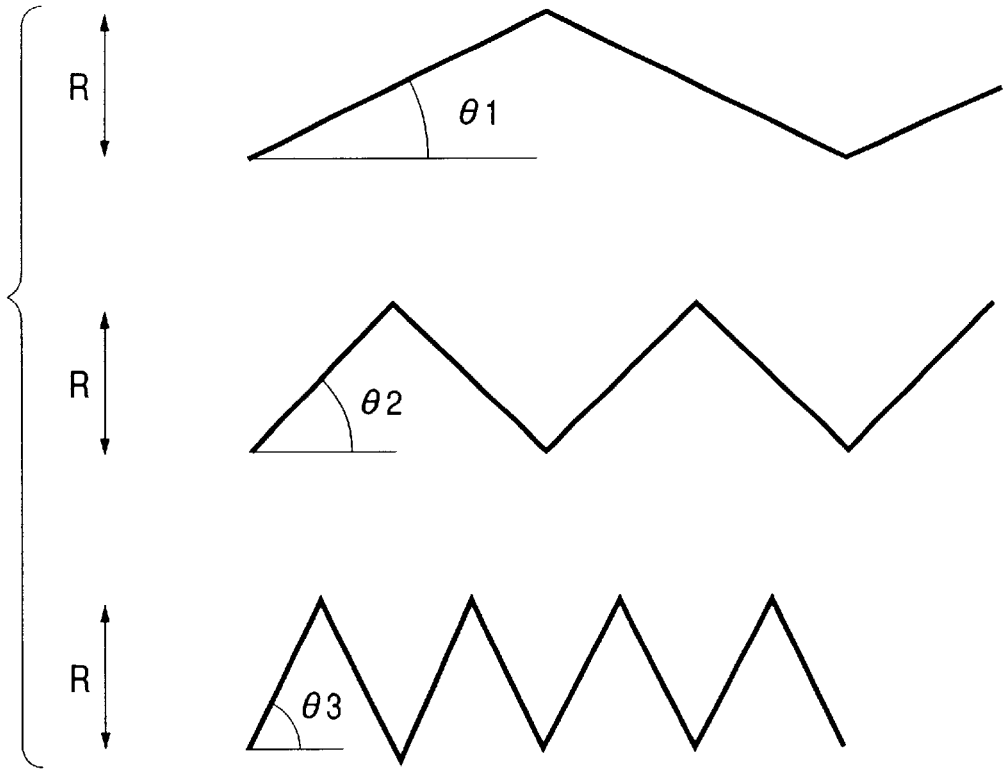
FIG. 52 is a diagram for explaining Δa (average inclination)

To resolve this, a parameter $\Delta a$ (average inclination) is found. $\Delta a$ can be obtained by using the equation in FIG. 51, and basically indicates $\tan\theta$. FIG. 52 is a specific graph showing the shapes of the surfaces of three developing sleeves, and the inclination is small and gradual ranging from low to high in FIG. 52. In this example, $\theta$ represents the inclination shown in FIG. 52, and is actually the average value of the raised and recessed portions that are measured. Therefore, Δa=tanθ represents the average inclination of roughness. It should be noted that the Δa which is obtained is not related to Ra and Rz, which are normally considered roughness values. And while the values of Ra and Rz remain the same, the value of Δa is greatly changed. This means that the value Δa can be changed without affecting the values of Ra and Rz, which normally have a great effect on changes in the amount of coating toner (the supplied toner).

To measure Δa, Ra and Rz, a contact surface roughness gauge (Surfcoder SE-3300, produced by Kosaka Laboratory Ltd.) was employed. Only a single measurement with this gauge was needed to obtain the Δa, Ra and Rz values. The measurement conditions were a cutoff value of 0.8 mm, a measured length of 2.5 mm, a feeding speed of 0.1 mm/sec and a magnification scale of 5000.

Although sleeve contamination is reduced when a developing sleeve is plated with a layer of Ni—P, the developer or an element in the developer still melts and sticks to a rough, uneven portion of the surface and contaminates it.

Figure 53:
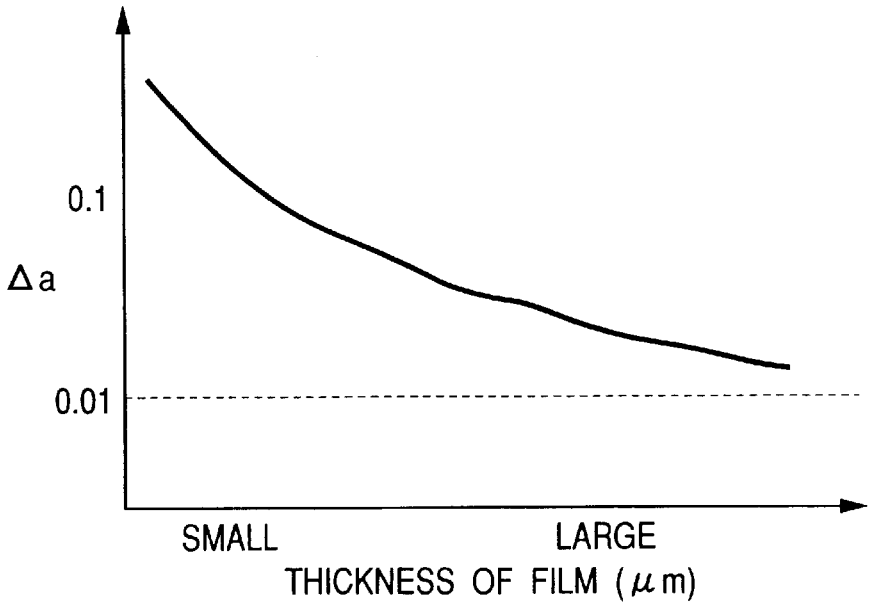
FIG. 53 is a graph showing the relationship between a and the thickness of an Ni—P plated film.
Figure 54:
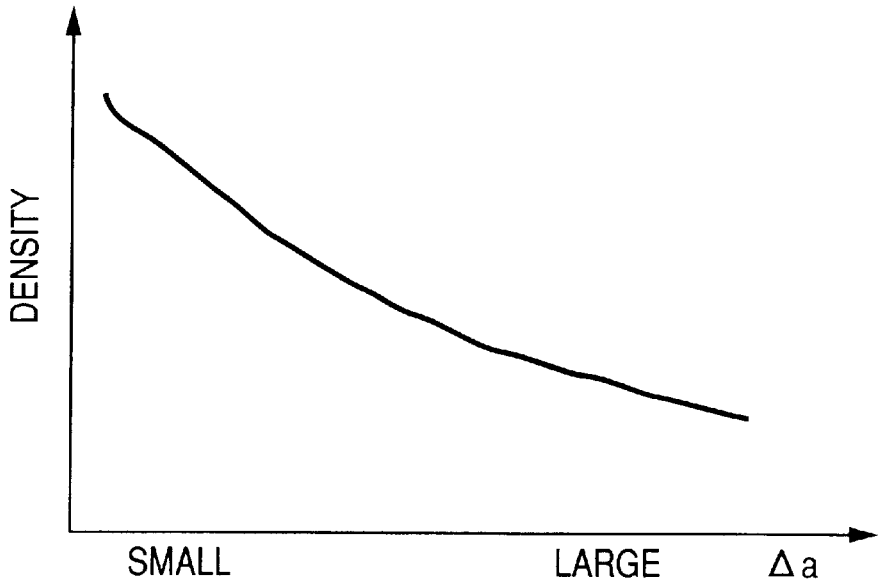
FIG. 54 is a graph showing the relationship between Δa and the density.

FIG. 53 is a graph showing the relationship of Δa and the density of the toner attached to a sleeve surface. As is apparent from the graph, the level of the sleeve contamination is correlated with Δa (the average inclination), which is the surface shape factor. When the value of Δa is small, the contamination level is preferable, and when the value of Δa is equal to or smaller than 0.1, the sleeve contamination level is considered satisfactory. In accordance with the relationship between the actual image density and the value of Δa shown in FIG. 54, as the value of Δ is reduced, the contamination becomes less, and as a result, the image density can be maintained. This is because, as is assumed from FIG. 52, as the value Δa is reduced the likelihood that toner will adhere to an uneven portion is likewise reduced. During a normal blast process, though, it is difficult to reduce the value of Δa while maintaining the value of Rz, which contributes to the effectiveness of the toner feeding.

However, in this embodiment, since the thickness of the Ni—P plated layer is changed, the value of Δa can be reduced while the value of Rz is maintained, and a satisfactory sleeve contamination level can be provided.

In Table 30 is shown Δa, the thickness of an Ni film, Q/M, a developing nip, and Q/M (the triboelectricity)×(M/S)×the developing peripheral speed ratio for a comparison example.

TABLE 30

| | First (120%) | Second (170%) |
|---|---|---|
| Δa | 0.08 | 0.08 |
| Ni-P film thickness (μm) | 10 | 10 |
| Q/M | 30k | 30k |
| (μc/g) | 8.3 | 6.5 |
| Blade thickness (mm) | 1.0 | 0.5 |
| M/S (mg/cm$^2$) | 0.98 | 0.69 |
| M/S × peripheral speed ratio | 1.18 | 1.17 |
| Q/M × M/S × peripheral speed | 9.79 | 7.61 |

As is shown in Table 30, for a durability of 30 k sheets, the development differs in consonance with the deterioration of toner and sleeve contamination. Q/M (the triboelectricity)×(M/S)×the developing peripheral speed ratio, which is the indicator for development, is 9.79 for the first and 7.61 for the second developing sleeves. As a result, a great difference appears between the primary developing and the secondary developing.

Whereas, in this embodiment, the arrangement in Table 29 was employed to resolve the above problem. The value Δa (the average inclination), which is the surface shape factor, was set so it was greater for the developing sleeve that was rotating faster than for the developing sleeve that was rotating more slowly. For this method, the Ni—P plated layer formed on the surface of the developing sleeve having the smaller outer diameter was thicker than the one formed on the surface of the developing sleeve having the larger outer diameter. As a result, the difference in the development characteristics was removed and the service lives of the sleeves was equalized.

Figure 55:
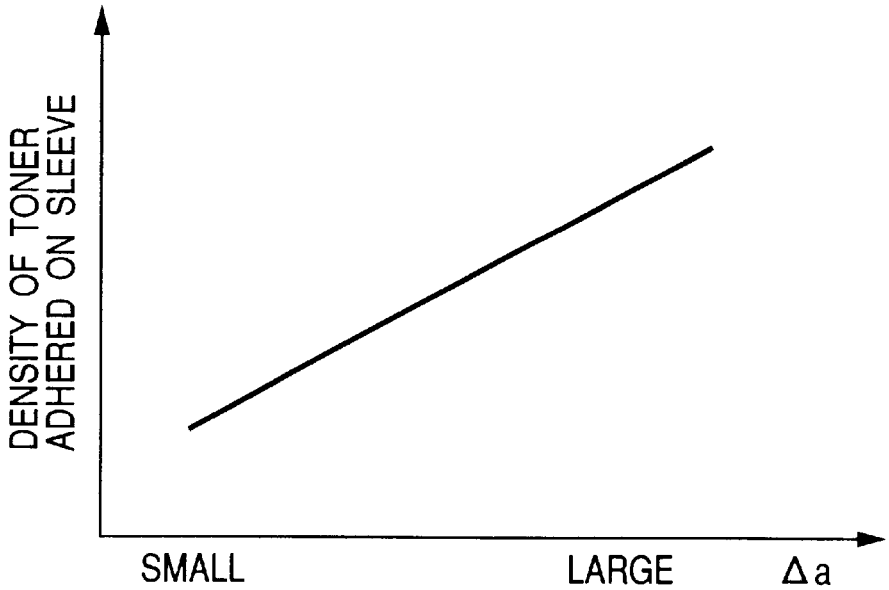
FIG. 55 is a graph showing the relationship between Δa and the density of the toner attached to the sleeve.

FIG. 55 is a graph showing the relationship between the thickness of the Ni—P plated film and Δa. It is apparent that as the film thickness is increased, Δa is reduced. By using Ni—P plating, the value Δa can be set so it is to equal to or lower than the 0.1 that is effective for the prevention of contamination. As the film thickness is increased, the value of Δa is gradually reduced, and when the film thickness is equal to or greater than 50 μm, Δa converges at approximately 0.01. This means that during the manufacturing process it is difficult to obtain a smaller Δa value. Therefore, the effective manufacturing range for Δa is 0.01 to 0.1.

The effects obtained in this embodiment are shown in Table 29.

First, relative to the sleeve service life, which is the number of sheets that can be processed before the image density on a sheet falls below 1.2, the service life for the first developing sleeve 720 was 980 k sheets, and the service life for the second developing sleeve 730 was substantially the same, i.e., 900 k sheets, while the conventional service life was 650 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

Figure 56:
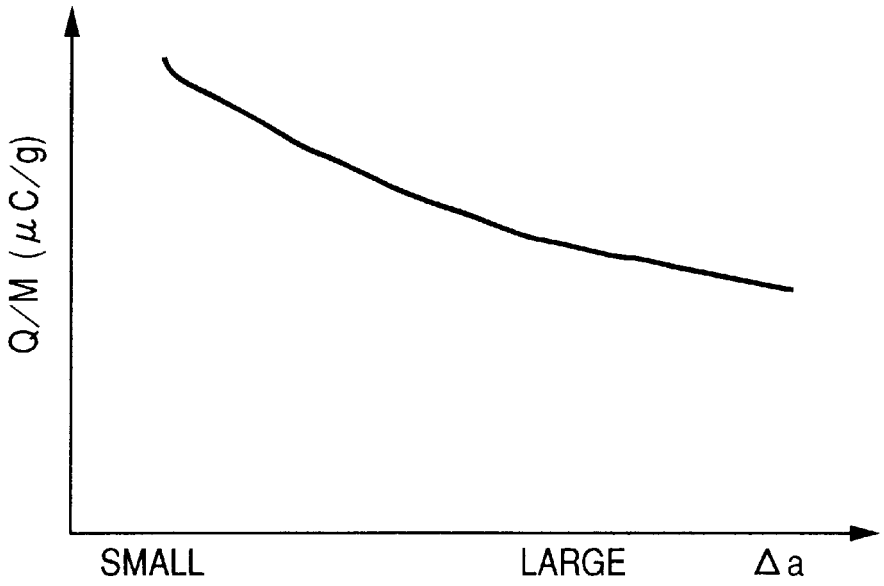
FIG. 56 is a graph showing the relationship between Δa and the Q/M (triboelectricity)
Figure 57:
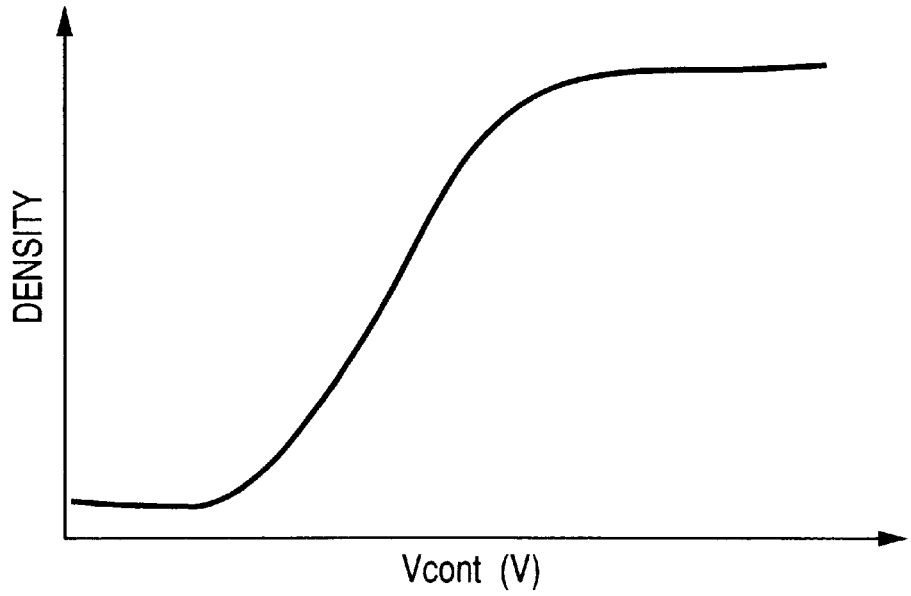
FIG. 57 is a graph showing the development characteristic of the developing apparatus according to the present invention.

Second, concerning the triboelectricity (Q/M), since the faster developing sleeve was deteriorated due to mechanical share and there was more deterioration of durability due to sleeve contamination, the charging of the deteriorated sleeve with toner could be increased, and a triboelectricity level could be maintained that prevented contamination. In other words, the triboelectricity (Q/M) of the fast developing sleeve could be always higher than the triboelectricity of the slow developing sleeve. As is apparent from the relationship between Δa and Q/M in FIG. 56, the employed characteristic was that as Δa was increased, the triboelectricity (Q/M) was reduced, while as Δa was reduced, the triboelectricity (Q/M) was increased. As a result, the triboelectricity (Q/M)×M/S× the peripheral speed ratio, which is the indicator of the development characteristic, can be substantially the same, i.e., 9.79 and 9.48. Therefore, while as shown in FIG. 46 the V-D curves, which are the development characteristics, conventionally differ, V-D curves can be obtained that are substantially the same, as is shown in FIG. 57 (it should be noted that, since the deterioration is small in the initial state, the development is very high and a difference in Q/M does not appear as a density difference). As a result, the image tones and tone stability can be controlled, and the service lives of the developing sleeves can be equalized.

In this embodiment, Ni—P plated film is employed; however, the same effects can be obtained by forming either an Ni—B plated film or a Cr plated film. Since the Cr plated film has a high positive toner charging capability and has superior abrasion resistance, it is especially appropriate for a fast image forming apparatus.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

<Eleventh Embodiment>

An eleventh embodiment of the present invention will now be described.

The image forming apparatus for this embodiment is the same as that for the tenth embodiment.

The feature of the eleventh embodiment is the saving of space by further reducing the size of a developing sleeve. Featured in this embodiment is not only the thickness of an Ni—P plated film but also the method used to process an underlayer before plating. If the charging of a developing sleeve having a greater outer diameter is enhanced and contamination of the sleeve is reduced, the charging enhancement and the contamination reduction must be even greater for a developing sleeve having a smaller diameter. According to the feature of this embodiment, to reduce the value of Δa, not only the thickness of the film is adjusted, but also a diamond polishing process is performed for the film in advance. After the diamond polishing, a normal blast process using FGB is performed.

A developing apparatus 702 according to this embodiment will now be described in detail.

A positive one-component magnetic toner is employed as a developer. As is shown in FIG. 40, two developing sleeves 720 and 730 are provided as developer bearing members for the developing apparatus 702. The first developing sleeve 720 is formed by performing a blast process using FGB#600 for a non-magnetic member that has a diameter ϕ of 20 mm and is made of aluminum A2017, and by then Ni—P plating for the resultant non-magnetic member. Similarly, the second developing sleeve 730 is formed by performing a blast process using FGB#600 for a non-magnetic member that has a diameter ϕ of 20 mm and is made of aluminum A2017. The surface of the resultant sleeve is finished like a mirror by diamond polishing, and the obtained sleeve is processed by then Ni—P plating. The film coating is performed in order to prevent the occurrence of sleeve ghost images during sleeve cycles, and to increase the durability of the sleeve surface.

The first developing sleeve 720 rotates at a speed that is 120% that of the photosensitive drum 701, and the thickness of the toner held on the developing sleeve 720 is controlled by a magnetic blade 720A. The gap S-$B_{gap}$ between the magnetic blade 720A and the first developing sleeve 720 is set at 250 μm, and the gap S-$D_{gap}$ between the sleeve 720 and the photosensitive drum 701 is set at 200 μm. A DC bias voltage of +400 V and an AC bias voltage, a rectangular wave $V_{pp}$ of 1200 V that has a frequency of 2.5 kHz, as is shown in FIG. 44, are applied to the first developing sleeve 720 to perform one-component non-contact magnetic development. Therefore, the developing contrast is 300 V in the toner dispersing direction, and the fog removal (toner returning) contrast is 100 V.

The second developing sleeve 730 is obtained by diamond polishing for a non-magnetic member that has a diameter ϕ of 20 mm and is made of aluminum A2017 and by performing diamond blast process and Ni—P plating for the resultant sleeve. A DC bias voltage of +400 V and an AC bias voltage, a rectangular wave $V_{pp}$ of 1200 V that has a frequency of 2.5 kHz, as is shown in FIG. 44, are applied to the second developing sleeve 730. Since the second developing sleeve 730 is the same as the first developing sleeve 720 and since only one power source is required, the manufacturing costs can be reduced and only a small area is required for the power source. The second developing sleeve 730 rotates at a speed that is 170% that of the photosensitive drum 701, and the magnetic blade 730A is employed to control the thickness of a toner layer. The gap S-$B_{gap}$ between the magnetic blade 730A and the second developing sleeve 730 is set at 250 μm, and the gap S-$D_{gap}$ between the developing sleeve 730 and the photosensitive drum 701 is set at 200 μm. The magnetic blades 720A and 730A are the same as those for the tenth embodiment.

The features of this embodiment will now be described.

In this embodiment, the thickness of an Ni—P plated film was changed, the diamond polishing process was performed for the underlayer of a sleeve having a smaller diameter, and the blast process was performed for the resultant sleeve. As a result, the value of Δa was reduced while the value of Rz was maintained, and a satisfactory sleeve contamination level could be obtained.

In Table 33 is shown Δa, the thickness of an Ni—P film, Q/M, a developing nip, and Q/M (the triboelectricity)×(M/S)×the developing peripheral speed ratio for a comparison example.

TABLE 31

| | First (120%) | Second (170%) |
|---|---|---|
| Δa | 0.08 | 0.08 |
| Ni-P film thickness (μm) | 10 | 10 |
| Q/M | 30k | 30k |
| (μc/g) | 8.3 | 8.3 |
| Diamond polishing | No | No |
| Blade thickness (mm) | 1.0 | 0.5 |
| M/S (mg/cm$^2$) | 0.98 | 0.69 |
| Q/M × peripheral speed ratio | 1.18 | 1.17 |
| Q/M × M/S × peripheral speed | 9.79 | 7.61 |

As is shown in Table 31, for a durability of 30 k sheets, the development differs in consonance with the deterioration of toner and sleeve contamination. Q/M (the triboelectricity)×(M/S)×the developing peripheral speed ratio, which is the indicator for development, is 9.79 for the first and 9.48 for the second developing sleeves. As a result, a great difference appears between the primary developing and the secondary developing.

Whereas, in this embodiment, the arrangement in Table 32 was employed to resolve the above problem. The value Δa (the average inclination), which is the surface shape factor, was set so it was greater for the developing sleeve that was rotating faster than for the developing sleeve that was rotating more slowly. For this method, the Ni—P plated layer formed on the surface of the developing sleeve having the smaller outer diameter was thicker than the one formed on the surface of the developing sleeve having the larger outer diameter. As a result, the difference in the development characteristics was removed and the service lives of the sleeves was equalized.

The effects obtained in this embodiment are shown in Table 32.

TABLE 32

| | First (120%) | Second (170%) |
|---|---|---|
| Δa | 0.08 | 0.03 |
| Ni-P film thickness (μm) | 10 | 20 |
| Q/M | 30k | 30k |
| (μc/g) | 8.5 | 8.5 |
| Diamond polishing | No | Yes |
| Blade thickness (mm) | 1.0 | 0.5 |
| M/S (mg/cm$^2$) | 0.98 | 0.69 |
| Q/M × peripheral speed ratio | 1.18 | 1.17 |
| Q/M × M/S × peripheral speed | 9.79 | 9.95 |

First, relative to the sleeve service life, which is the number of sheets that can be processed before the image density on a sheet falls below 1.2, the service life for the first developing sleeve 720 was 820 k sheets, and the service life for the second developing sleeve 730 was substantially the same, i.e., 800 k sheets, while the conventional service life was 500 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

Second, concerning the triboelectricity (Q/M), since the faster developing sleeve was deteriorated due to mechanical share and there was more deterioration of durability due to sleeve contamination, the charging of the deteriorated sleeve with toner could be increased, and a triboelectricity level could be maintained that prevented contamination. In other words, the triboelectricity (Q/M) of the fast developing sleeve could be always higher than the triboelectricity of the slow developing sleeve. As is apparent from the relationship between Δa and Q/M in FIG. 56, the employed characteristic was that as Δa was increased, the triboelectricity (Q/M) was reduced, while as Δa was reduced, the triboelectricity (Q/M) was increased. As a result, Q/M (the triboelectricity)×M/S× the peripheral speed ratio, which is the indicator of the development characteristic, can be substantially the same. Therefore, while the V-D curves that are the development characteristics conventionally differ, V-D curves can be obtained that are substantially the same. Since the above shape of the surface is formed, the image tones and tone stability can be controlled, the service lives of the developing sleeves can be equalized, and the space required can be reduced.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

In addition, a developing apparatus having a service life of 800,000 sheets can be provided wherein, as the third objective, the image density is stable and high, relative to high processing speed, and the required space is reduced.

<Twelfth Embodiment>

A twelfth embodiment of the present invention will now be described.

The feature of this embodiment is that the developing apparatus according to this invention is employed for a reuse image forming apparatus.

Figure 58:
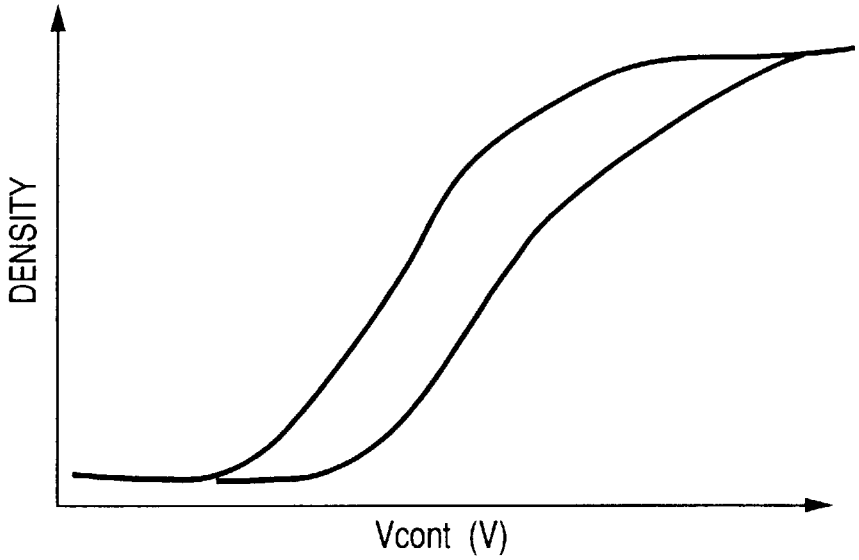
FIG. 58 is a graph showing the development characteristic of the conventional reuse image forming apparatus.

Since a reuse system basically employs waste toner that remains after the transferring process and is collected by cleaning, compared with new toner, the triboelectricity produced is considerably smaller and development is poor. Further, cohesion of the waste toner and the share at S-$B_{gap}$ are increased, and the film is scraped more. This phenomenon is shown in FIG. 58 as the development characteristic of the reuse system. It is apparent that compared with new toner, the density overall is low, and the difference between the developing sleeves is greater. The twelfth embodiment is provided while taking all this into account.

Figure 59:
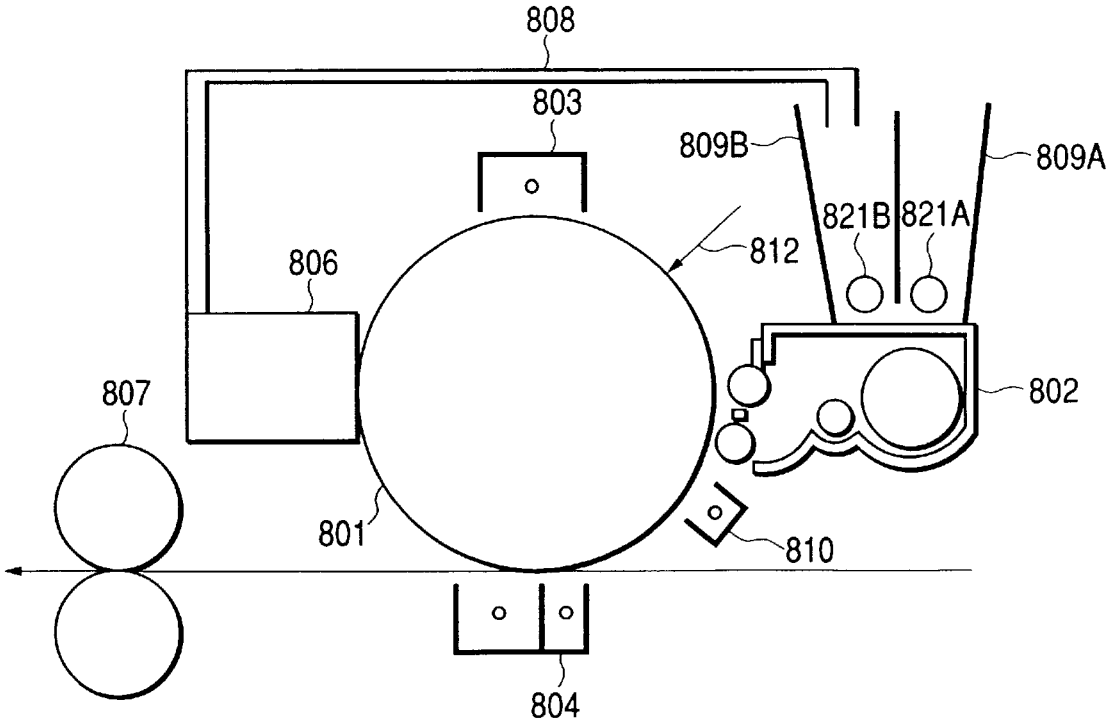
FIG. 59 is a cross-sectional view of the essential portion of a reuse image forming apparatus that includes a developing apparatus according to a twelfth embodiment of the present invention.

For this embodiment, an explanation will now be given for a digital copier, functioning as the image forming apparatus shown in FIG. 59, that employs as a photosensitive drum 801 an a-Si drum.

The processing speed of the digital copier is 630 mm per second and 120 sheets per minute. The surface of the photosensitive drum 801 is uniformly charged to +500 V by a primary charger 803, and then, PWM exposure process 812 is performed at 600 dpi, by a semiconductor laser having a wavelength of 680 μm, to form an electrostatic latent image on the photosensitive drum 801.

Following this, the electrostatic latent image is normally developed by a developing apparatus 802 to visualize it as a toner image. A negative one-component magnetic toner is employed as a developer to perform jumping development, and the particle diameter of the toner is 6.0 μm. When the conventional two-component developer is employed, a carrier must be replaced by a maintenance man every 100,000 sheets, and because of maintenance free, the merits of the reuse system are not very well displayed. Thus, in this embodiment, a dry one-component magnetic toner is employed for which durability can be ignored and maintenance is not required. The development bias voltage is obtained by superimposing a DC voltage of +400 V and an AC voltage having a frequency of 2000 Hz, 1500 V and a duty ratio of 50% on both the first and the second developing sleeves. The S-$B_{gap}$ is set at 250 μm and the S-$D_{gap}$ is set at 250 μm. Then, a post charger 810 supplies a total current of +200 μA to charge the toner image, and a transfer charger 804 transfers the toner image to a transfer material that is fed in the direction indicated by an arrow. The transfer material bearing the toner image is then transmitted to a fixing unit 807, which fixes the toner image to the transfer material.

The residual toner on the photosensitive drum 801 is removed and is collected by a cleaning unit 806, and the waste toner (reuse toner) is returned via a conveyor pipe 808 to a developing hopper 809B. A screw-shaped conveyor member is provided in the conveyor pipe 808, and as the conveyor member is rotated, the reuse toner is transported. For reuse, the reuse toner is collected in the developing hopper 809B.

The new toner is retained in a hopper 809A. The new toner is attracted by the magnetic forces of magnetic rollers 821A and 821B, and is fed to the developing apparatus 802 as the rollers 821A and 821B are rotated. In this embodiment, a method for mixing the waste toner and the new toner in the developing apparatus 802 is employed, but space may be defined in the hopper for mixing these toners.

The toner mixed in the developing apparatus 802 is again fed to the developing sleeves, and is used to develop an electrostatic latent image on the photosensitive drum 801.

The normal rotational speed of the magnetic roller 821A is two revolutions per minute, and the rotational speed of the magnetic roller 821B is changed. When the weight of the toner is not applied to a piezosensor (produced by TDK) in the developing apparatus 802, and the piezosensor is vibrated, a toner supply signal is generated. Generally, the ratio of the amount of toner supplied by the magnetic roller 821B to that supplied by the magnet roller 821B is 10/90 (magnetic roller 821A: magnetic roller 821B=9:1).

The arrangement of the developing apparatus 802 in this embodiment is the same as that for the eleventh embodiment, i.e., the film is formed by Ni—P plating, and the diameter of both sleeves is ϕ 20 mm.

The effects obtained in this embodiment are shown in Table 33.

TABLE 33

| | First (120%) | Second (170%) |
|---|---|---|
| Δa | 0.06 | 0.02 |
| Ni-P film thickness (μm) | 15 | 30 |
| Q/M | 50k | 50k |
| (μc/g) | 8.0 | 8.1 |
| Diamond polishing | No | Yes |
| Blade thickness (mm) | 1.0 | 0.5 |
| M/S (mg/cm$^2$) | 0.96 | 0.67 |
| Q/M × peripheral speed ratio | 1.15 | 1.14 |
| Q/M × M/S × peripheral speed | 9.2 | 9.23 |

With this arrangement, it is apparent that, because of the durability, it is difficult to contaminate even the reuse toner that is highly cohesive, and the triboelectricity level can be maintained.

On the first developing sleeve the thickness of the Ni—P plated film was 15 μm, while on the second developing sleeve the thickness of the Ni—P plated film was 20 μm and the diamond polishing process was performed before the blast process. As a result, the service lives of the two sleeves could be equalized. This means that even though the reuse waste toner was coagulated, the conventional service life of 400 k sheets was extended to about 700 k sheets.

In addition, concerning the triboelectricity (Q/M), even though there was deterioration of the fast developing sleeve due to a mechanical share, the charging with the toner of the deteriorated sleeve could be increased. That is, the triboelectricity (Q/M) of the first developing sleeve was substantially the same as that of the second developing sleeve. Therefore, in the reuse system for which the overall was charge low, the value of Q/M (the triboelectricity×M/S×the peripheral speed ratio, which is the indicator for the development characteristic, was substantially equal, and as a result, the V-D curves, which are the development characteristics, were substantially the same. As a result, a reuse system can be provided for which the image tones and tone stability can be controlled, and the service lives of the developing sleeves can be equalized.

With the above arrangement, in a developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, the image density is stable and high relative to a high processing speed, and the space required is reduced.

<Thirteenth Embodiment>

A thirteenth embodiment will now be described.

Figure 60:
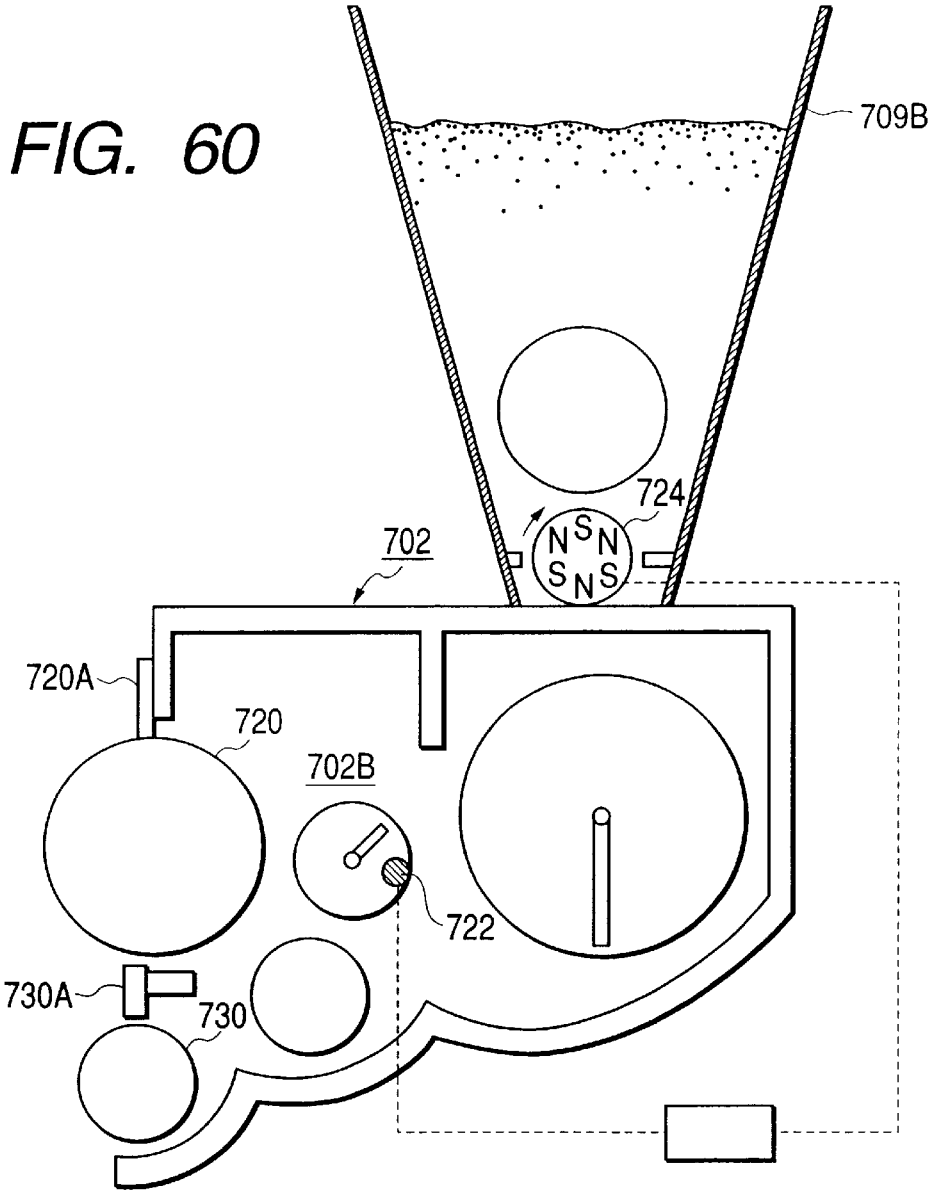
FIG. 60 is a cross-sectional view of a developing apparatus according to a thirteenth embodiment of the present invention.
Figure 61:
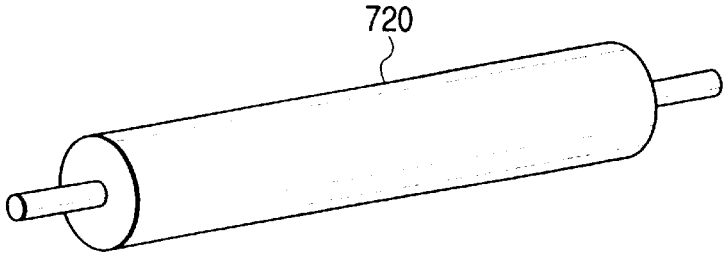
FIG. 61 is a perspective view of a developing sleeve in the developing apparatus according to the thirteenth embodiment of the present invention.

In this embodiment, as is shown in FIG. 60, two developing sleeves 720 and 730 are provided as developer bearing members for the developing apparatus 702. The first developing sleeve 720 is formed by performing a blast process with FGB#600 (Rz 3.0 μm) for a non-magnetic member that has a diameter of ϕ30 mm and is made of aluminum A2017, and by plating the resultant member with Ni—P, as is shown in FIG. 61. Similarly, the second developing sleeve 730 is formed by performing a blast process with FGB#600 (Rz 3.0 μm) for a non-magnetic member that has a diameter of ϕ20 mm and is made of aluminum A2017, and by plating the resultant member with Ni—P. The Ni—P plating is performed to prevent the occurrence of sleeve ghost images at a sleeve cycle and to increase the durability of the surfaces of the developing sleeves (the film is formed to protect the Al surface). The Ni—P plated layer is a non-magnetic electroless plated layer that contains 8% of P in Ni.

Figure 62:
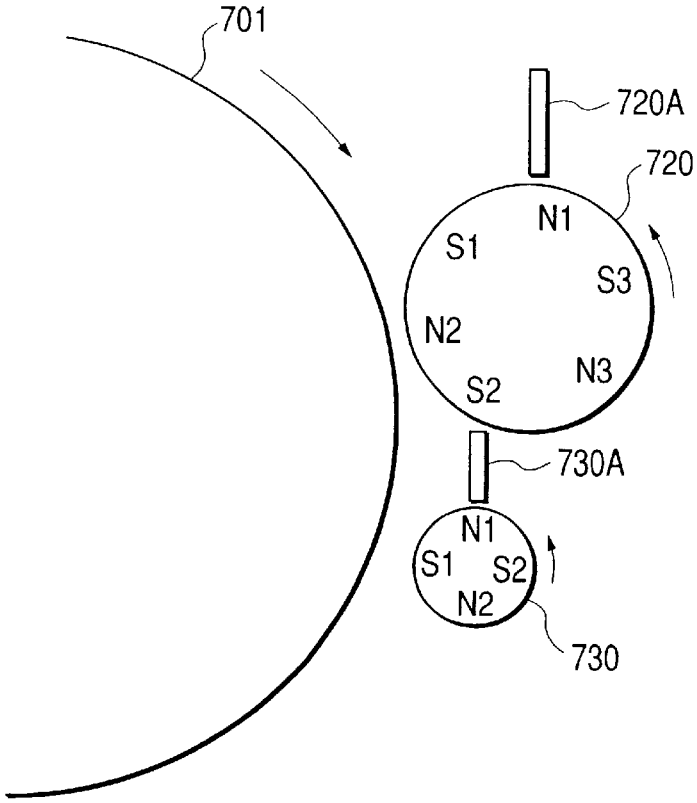
FIG. 62 is a cross-sectional view of the arrangement of the magnetic poles of the developing sleeves of the developing apparatus according to the thirteenth embodiment of the present invention.

A fixed magnet is incorporated in the first developing sleeve 720, which has a magnetic field pattern formed by the six poles (N1 to N3 and S1 to S3) shown in FIG. 62 and Table 34.

TABLE 34

| Magnet pole | Magnetic force (G) | Angle (°) | Half value width (°) |
|---|---|---|---|
| N1 | 950 | 0 | 38 |
| N2 | 950 | 60 | 46 |
| N3 | 550 | 220 | |
| S1 | 900 | 120 | |
| S2 | 500 | 175 | |
| S3 | 700 | 270 | |

The first developing sleeve 720 rotates at a speed 150% that to the photosensitive drum 701, and the thickness of the toner held on the developing sleeve 720 is controlled by a magnetic blade 720A. The gap S-$B_{gap}$ between the first developing sleeve 720 and the magnetic blade 720A is set at 250 μm, and the gap S-$D_{gap}$ between the sleeve 720 and the photosensitive drum 701 is set at 200 μm. A DC bias voltage of +400 V and an AC bias voltage, a rectangular wave $V_{pp}$ of 1200 V that has a frequency of 2.5 kHz, as is shown in FIG. 44, are applied to the first developing sleeve 720 to perform one-component non-contact magnetic development. Therefore, the developing contrast is 300 V in the toner dispersing direction, and the fog removal (toner returning) contrast is 100 V.

The second developing sleeve 730 is obtained by Ni—P plating on a non-magnetic member that has a diameter ϕ 20 mm and is made of aluminum A2017. A magnet is provided internally for the second developing sleeve 730 and has a magnetic field pattern formed by the four poles (N1, N2, S1 and S2) shown in FIG. 62 and Table 35.

TABLE 35

| Magnet pole | Magnetic force (G) | Angle (°) | Half value width (°) |
|---|---|---|---|
| N1 | 950 | 0 | 38 |
| N2 | 800 | 170 | |
| S1 | 950 | 90 | 46 |
| S2 | 500 | 260 | |

A DC bias voltage of +400 V and an AC bias voltage, a rectangular wave $V_{pp}$ of 1200 V that has a frequency of 2.5 kHz, as is shown in FIG. 44, are applied to the second developing sleeve 730. Since the second developing sleeve 730 is the same as the first developing sleeve 720 and only one power source is required, the manufacturing costs can be reduced and only a small area is required for the power source.

The second developing sleeve 730 rotates at a speed 150% that of the photosensitive drum 701. The toner layer held on the developing sleeve 730 is controlled by the magnetic blade 730A. The gap S-$D_{gap}$ between the second developing sleeve 730 and the photosensitive drum 701 is set at 250 $\mu$m, and the gap S-$B_{gap}$ between the second developing sleeve 730 and the magnetic blade 730A is set to 200 $\mu$m.

The magnetic blades 720A and 730A are plate-shaped magnetic blades that are 1.0 mm thick. This is because, since the primary and secondary developing conditions are nearly the same, the density can be corrected if it fluctuates due to the environment and durability.

In order to satisfy requests for image tones and tone stability that can cope with current digital images and graphics, the important problem is the matching of the development characteristics of the developing sleeves 720 and 730 (the primary developing and the secondary developing). Since the gap S-$B_{gap}$ is the same, the amount of supplied toner (M/S) is substantially the same, i.e., approximately 1.0 mg/cm$^2$. The development pole of the first developing sleeve 720 is N2, while the development pole of the second developing sleeve 730 is S1, and the magnetic force and the half-width are the same for both sleeves. Although the peripheral speeds for the developing sleeves 720 and 730 are the same, the actual development characteristics differ for the two developing sleeves 720 and 730, as is shown in FIG. 46 (the upper line represents the primary developing and the lower line represents the secondary developing). These development characteristics will now be described.

Figure 63:
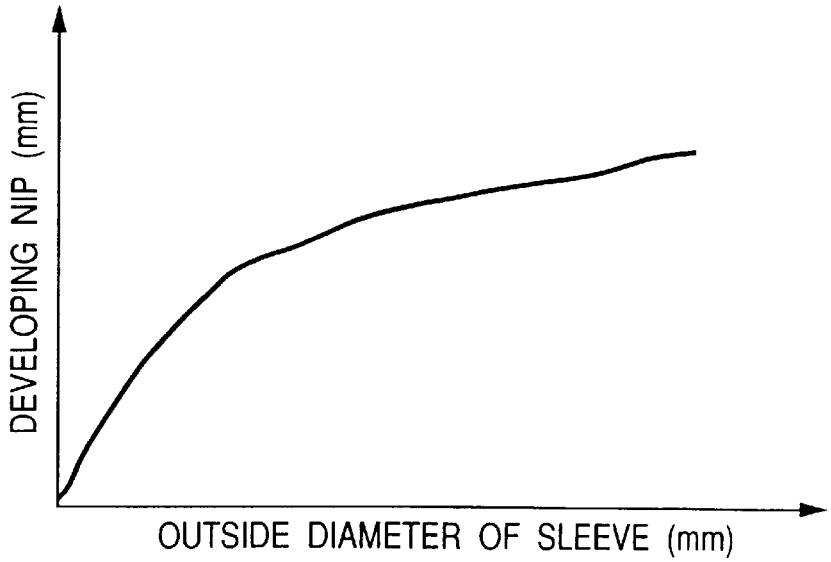
FIG. 63 is a graph showing the outside diameter of the sleeve and a developing nip.

This is because, as is shown in FIG. 63, when the outer diameter differs in the developing sleeves, the size of the developing area (developing nip) differs depending on the sleeve diameter. As the outer diameter is increased, the developing nip is also increased. The development is basically proportional to the values of the amount of supplied toner (M/S), the triboelectricity (Q/M) and the developing nip. That is, when the peripheral speed ratio of the developing speeds is equal, it is proportional to the amount of supplied toner (M/S)×the triboelectricity (Q/M)×the developing nip. Therefore, under the above described development conditions, the developing nip is 5.7 mm for the primary developing and 5.0 mm for the secondary developing. A difference between the two causes a difference in the development characteristics (for 100 k sheets) in FIG. 46. The difference between the development characteristics is present in the initial state, and not only this difference but also the sleeve contamination additionally affects the durability.

The service life of a developing sleeve, which is the second problem, will now be explained.

When the developing sleeves have different outer diameters, the sleeve having the larger outer diameter passes by the blade less frequently for a specific number of copy units (during the unit time) than the sleeve having the smaller diameter, and receives a smaller mechanical share from the toner. The surface of the developing sleeve basically receives the greatest share at the toner control portion. Therefore, if the diameters of the developing sleeves differ, i.e., ϕ20 mm and ϕ30 mm as in this embodiment, the ϕ20 mm developing sleeve passes through the toner control portion 1.6 times as frequently as does the ϕ30 mm sleeve. Therefore, due to sleeve contamination, the ϕ20 mm developing sleeve must be replaced even though the service life of the ϕ30 mm developing sleeve is still not exhausted. Then, when the ϕ30 mm developing sleeve of is replaced later, the cost for the labor performed by a maintenance man is increased accordingly, so that the equalization of the service lives of the developing sleeves is needed.

This embodiment is carried out to resolve the above problem.

In Table 36 is shown Δa, the thickness of an Ni film, Q/M, a developing nip, the amount of supplied toner, and (M/S)×(Q/M)×the developing nip for a comparison example.

TABLE 36

| | First (ϕ30) | | Second (ϕ20) | |
|---|---|---|---|---|
| Δa | 0.08 | | 0.08 | |
| Ni film thickness ($\mu$m) | 10 | | 10 | |
| Q/M | 1k | 100k | 1k | 100k |
| ($\mu$c/g) | 8.0 | 7.8 | 8.1 | 6.9 |
| Developing nip (mm) | 5.7 | | 5.0 | |
| M/S | 1k | 100k | 1k | 100k |
| (mg/cm$^2$) | 0.99 | 0.99 | 0.98 | 0.98 |
| Developing nip × | 1k | 100k | 1k | 100k |
| Q/M × M/S | 45.1 | 44.0 | 39.7 | 33.8 |

As is shown in Table 36, from the beginning, the development differs due to a developing nip, and (M/S)×Q/M (the triboelectricity)×the developing nip, which is the indicator for development, is 45.1 and 39.7 during the process for 1 k sheets. Further, after processing of 100 k sheets, a great difference appears between the primary developing and the secondary developing, i.e., 44.0 and 33.8.

Whereas, in this embodiment, the arrangement in Table 37 was employed to resolve the above problem. The value Δa (the average inclination), which is the surface shape factor, was set so it was smaller for the developing sleeve having a small diameter than for the developing sleeve having a large diameter. For this method, the Ni—P plated layer formed on the surface of the developing sleeve having the smaller outer diameter was thicker than the one formed on the surface of the developing sleeve having the larger outer diameter. As a result, the difference in the development characteristics was removed and the service lives of the sleeves effected by the contamination was equalized.

By using Ni—P plating, the value Δa can be set so it is to equal to or lower than the 0.1 that is effective for the prevention of contamination. As the film thickness is increased, the value of Δa is gradually reduced, and when the film thickness is equal to or greater than 50 $\mu$m, Δa converges at approximately 0.01. This means that during the manufacturing process it is difficult to obtain a smaller Δa value. Therefore, the effective manufacturing range for Δa is 0.01 to 0.1.

The effects obtained in this embodiment are shown in Table 37.

TABLE 37

| | First (ϕ30) | | Second(ϕ20) | |
|---|---|---|---|---|
| Δa | 0.08 | | 0.04 | |
| Ni film thickness (μm) | 10 | | 20 | |
| Q/M | 1k | 100k | 1k | 100k |
| (μc/g) | 8.0 | 7.8 | 9.0 | 8.6 |
| Developing nip (mm) | 5.7 | | 5.0 | |
| M/S | 1k | 100k | 1k | 100k |
| (mg/cm$^2$) | 0.99 | 0.99 | 0.98 | 0.98 |
| Developing nip × | 1k | 100k | 1k | 100k |
| Q/M × M/S | 45.1 | 44.0 | 44.1 | 42.1 |

First, relative to the sleeve service life, which is the number of sheets that can be processed before the image density on a sheet falls below 1.2, the service life for the ϕ30 mm developing sleeve 720 was 980 k sheets, and the service life for the ϕ20 mm developing sleeve 730 was substantially the same, i.e., 900 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

As for triboelectricity (Q/M), great durability could be obtained for the second developing using the ϕ20 mm sleeve that had a small developing nip and poor development at the initial stage, and was contaminated more than the other sleeve due to durability. As is apparent from the relationship between Δa and Q/M in FIG. 56, the employed characteristic was that as Δa was increased, the triboelectricity (Q/M) was reduced, while as Δa was reduced, the triboelectricity (Q/M) was increased. As a result, the triboelectricity (Q/M)×M/S× the developing nip, which is the indicator of the development characteristic, can be substantially the same, i.e., 45.1 and 44.1 in the initial state, and 44.0 and 41.7 after the durability process. Therefore, while as shown in FIG. 46 the V-D curves, which are the development characteristics, conventionally differ, V-D curves can be obtained that are substantially the same, as is shown in FIG. 57. As a result, the image tones and tone stability can be controlled, and the service lives of the developing sleeves can be equalized.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

<Fourteenth Embodiment>

A fourteenth embodiment of the present invention will now be described.

The image forming apparatus for this embodiment is the same as that for the thirteenth embodiment.

The feature of the present embodiment is the saving of space by further reducing the size of a developing sleeve. Featured in this embodiment is not only the thickness of an Ni—P plated film but also the method used to process an underlayer before plating. If the charging of a developing sleeve having a greater outer diameter is enhanced and contamination of the sleeve is reduced, the charging enhancement and the contamination reduction must be even greater for a developing sleeve having a smaller diameter. According to the feature of this embodiment, to reduce the value of Δa, not only the thickness of the film is adjusted, but also a diamond polishing process is performed for the film in advance. After the diamond polishing, a normal blast process using FGB is performed.

A developing apparatus 702 according to this embodiment will now be described in detail.

A negative, one-component magnetic toner is employed as a developer. As is shown in FIG. 60, two developing sleeves 720 and 730 are provided as developer bearing members for the developing apparatus 702. The first developing sleeve 720 is formed by performing a blast process using FGB#600 for a non-magnetic member that has a diameter ϕ of 20 mm and is made of aluminum A2017, and by then Ni—P plating for the resultant non-magnetic member. Similarly, the second developing sleeve 730 is formed by performing a blast process using FGB#600 for a non-magnetic member that has a diameter ϕ of 15 mm and is made of aluminum A2017. The surface of the resultant sleeve is finished like a mirror by diamond polishing, and the obtained sleeve is processed by then Ni—P plating. The film coating is performed in order to prevent the occurrence of sleeve ghost images during sleeve cycles, and to increase the durability of the sleeve surface.

The first developing sleeve 720 rotates at a speed that is 150% that of the photosensitive drum 701, and the thickness of the toner held on the developing sleeve 720 is controlled by a magnetic blade 720A. The gap S-$B_{gap}$ between the magnetic blade 720A and the first developing sleeve 720 is set at 250 μm, and the gap S-$D_{gap}$ between the sleeve 720 and the photosensitive drum 701 is set at 200 μm. A DC bias voltage of +400 V and an AC bias voltage, a rectangular wave $V_{pp}$ of 1200 V that has a frequency of 2.5 kHz, as is shown in FIG. 44, are applied to the first developing sleeve 720 to perform one-component non-contact magnetic development. Therefore, the developing contrast is 300 V in the toner dispersing direction, and the fog removal (toner return) contrast is 100 V.

The second developing sleeve 730 is obtained by diamond polishing for a non-magnetic member that has a diameter ϕ of 15 mm and is made of aluminum A2017 and by performing blast process and Ni—P plating for the resultant sleeve. A DC bias voltage of +400 V and an AC bias voltage, a rectangular wave $V_{pp}$ of 1200 V that has a frequency of 2.5 kHz, as is shown in FIG. 44, are applied to the second developing sleeve 730. Since the second developing sleeve 730 is the same as the first developing sleeve 720 and since only one power source is required, the manufacturing costs can be reduced and only a small area is required for the power source. The second developing sleeve 730 rotates at a speed that is 150% that of the photosensitive drum 701, and the magnetic blade 730A is employed to control the thickness of a toner layer. The gap S-$B_{gap}$ between the magnetic blade 730A and the second developing sleeve 730 is set at 250 μm, and the gap S-$D_{gap}$ between the developing sleeve 730 and the photosensitive drum 701 is set at 200 μm. The magnetic blades 720A and 730A are the same as those for the tenth embodiment.

The features of this embodiment will now be described.

In this embodiment, the thickness of an Ni—P plated film was changed, the diamond polishing process was performed for the underlayer of a sleeve having a smaller diameter, and the blast process was performed for the resultant sleeve. As a result, the value of Δa was reduced while the value of Rz was maintained, and a satisfactory sleeve contamination level could be obtained.

In Table 38 is shown Δa, the thickness of an Ni film, Q/M, a developing nip, the service lives of developing sleeves, and (M/S)×Q/M (the triboelectricity)×the developing nip for a comparison example.

TABLE 38

| | First (ϕ20) | | Second (ϕ15) | |
|---|---|---|---|---|
| Δa | 0.08 | | 0.08 | |
| Diamong polishing | No | | No | |
| Ni film thickness (μm) | 10 | | 10 | |
| Q/M | 1k | 100k | 1k | 100k |
| (μc/g) | 8.0 | 7.8 | 7.9 | 6.4 |
| Developing nip (mm) | 5.0 | | 4.5 | |
| M/S | 1k | 100k | 1k | 100k |
| (mg/cm$^2$) | 0.99 | 0.99 | 0.98 | 0.98 |
| Developing nip × | 1k | 100k | 1k | 100k |
| Q/M × M/S | 39.6 | 38.6 | 34.8 | 28.2 |

As is shown in Table 38, from the beginning, the development differs due to a developing nip, and (M/S)×Q/M (the triboelectricity)×the developing nip, which is the indicator for development, is 39.6 and 34.8 during the process for 1 k sheets. Further, after processing of 100 k sheets, a great difference appears between the primary developing and the secondary developing, i.e., 38.6 and 28.2.

Whereas, in this embodiment, the arrangement in Table 39 was employed to resolve the above problem. The value Δa (the average inclination), which is the surface shape factor, was set so it was smaller for the developing sleeve having a small diameter than for the developing sleeve having a large diameter. For this method, the Ni—P plated layer formed on the surface of the developing sleeve having the smaller outer diameter was thicker than the one formed on the surface of the developing sleeve having the larger outer diameter. As a result, the difference in the development characteristics was removed and the service lives of the sleeves was equalized.

The effects obtained in this embodiment are shown in Table 39.

TABLE 39

| | First (ϕ20) | | Second(ϕ15) | |
|---|---|---|---|---|
| Δa | 0.08 | | 0.03 | |
| Diamond polishing | No | | Yes | |
| Ni film thickness (μm) | 10 | | 20 | |
| Q/M | 1k | 100k | 1k | 100k |
| (μc/g) | 8.0 | 7.8 | 9.3 | 8.9 |
| Developing nip (mm) | 5.0 | | 4.5 | |
| M/S | 1k | 100k | 1k | 100k |
| (mg/cm$^2$) | 0.99 | 0.99 | 0.98 | 0.98 |
| Developing nip × | 1k | 100k | 1k | 100k |
| Q/M × M/S | 39.6 | 38.6 | 41.0 | 39.2 |

First, relative to the sleeve service life, which is the number of sheets that can be processed before the image density on a sheet falls below 1.2, the service life for the ϕ20 mm developing sleeve 720 was 820 k sheets, and the service life for the ϕ15 mm developing sleeve 730 was substantially the same, i.e., 850 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

As for triboelectricity (Q/M), great durability could be obtained for the secondary developing using the ϕ15 mm sleeve that had a small developing nip and poor development at the initial stage, and was contaminated more than the other sleeve due to durability. As is apparent from the relationship between Δa and Q/M in FIG. 56, the employed characteristic was that as Δa was increased, the triboelectricity (Q/M) was reduced, while as Δa was reduced, the triboelectricity (Q/M) was increased. As a result, Q/M (the triboelectricity×M/S×the peripheral speed ratio, which is the indicator of the development characteristic, can be substantially the same, i.e., 39.6 and 41.0 in the initial state and 38.6 and 39.2 after the durability process. Therefore, while the V-D curves that are the development characteristics conventionally differ, V-D curves can be obtained that are substantially the same. Since the above shape of the surface is formed, the image tones and tone stability can be controlled, the service lives of the developing sleeves can be equalized, and the space required can be reduced.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

In addition, a developing apparatus having a service life of 800,000 sheets can be provided wherein, as the third objective, the image density is stable and high, relative to high processing speed, and the required space is reduced.

<Fifteenth Embodiment>

A fifteenth embodiment of the present invention will now be described.

The feature of this embodiment is that the developing apparatus according to this invention is employed for a reuse image forming apparatus.

The developing apparatus according to this embodiment, as well as the fourteenth embodiment, includes developing sleeves that have diameters of ϕ20 mm and of ϕ15 mm and that are Ni—P plated.

The effects obtained in this embodiment are shown in Table 40.

TABLE 40

| | First (ϕ20) | Second (ϕ15) |
|---|---|---|
| Δa | 0.06 | 0.02 |
| Diamond polishing | No | Yes |
| Ni film thickness (mm) | 15 | 30 |
| Q/M | 100k | 100k |
| (μC/g) | 7.6 | 8.5 |
| Developing nip (mm) | 5.0 | 4.5 |
| M/S | 100k | 100k |
| (mg/cm$^2$) | 0.95 | 0.95 |
| Developing nip × | 100k | 100k |
| (Q/M) × (M/S) | 36.1 | 36.3 |

With this arrangement, it is apparent that reuse toner that is very cohesive is difficult to be contaminated because of durability, and the triboelectricity level can be maintained. Further, the service lives for the sleeves was equalized. This means that even though the reuse and the waste toner cohered, the service life was extended to about 700 k sheets.

The triboelectricity (Q/M) level could be set so it was greater for the ϕ15 mm sleeve that had a small developing hip and poor development, i.e., the values of the triboelectricity for the first and the second developing sleeves were 7.6 and 8.5. Therefore, the value of the (M/S)×Q/M (the triboelectricity×the developing nip, which is the indicator for the development characteristic, was substantially equal, i.e., 36.1 and 36.3, and as a result, the V-D curves, which are the development characteristics, were substantially the same. As a result, a reuse system can be provided for which the image tones and tone stability can be controlled, and the service lives of the developing sleeves can be equalized.

With the above arrangement, in a developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, the image density is stable and high relative to a high processing speed, and the space required is reduced.

<Sixteenth Embodiment>

A sixteenth embodiment will now be described.

Figure 64:
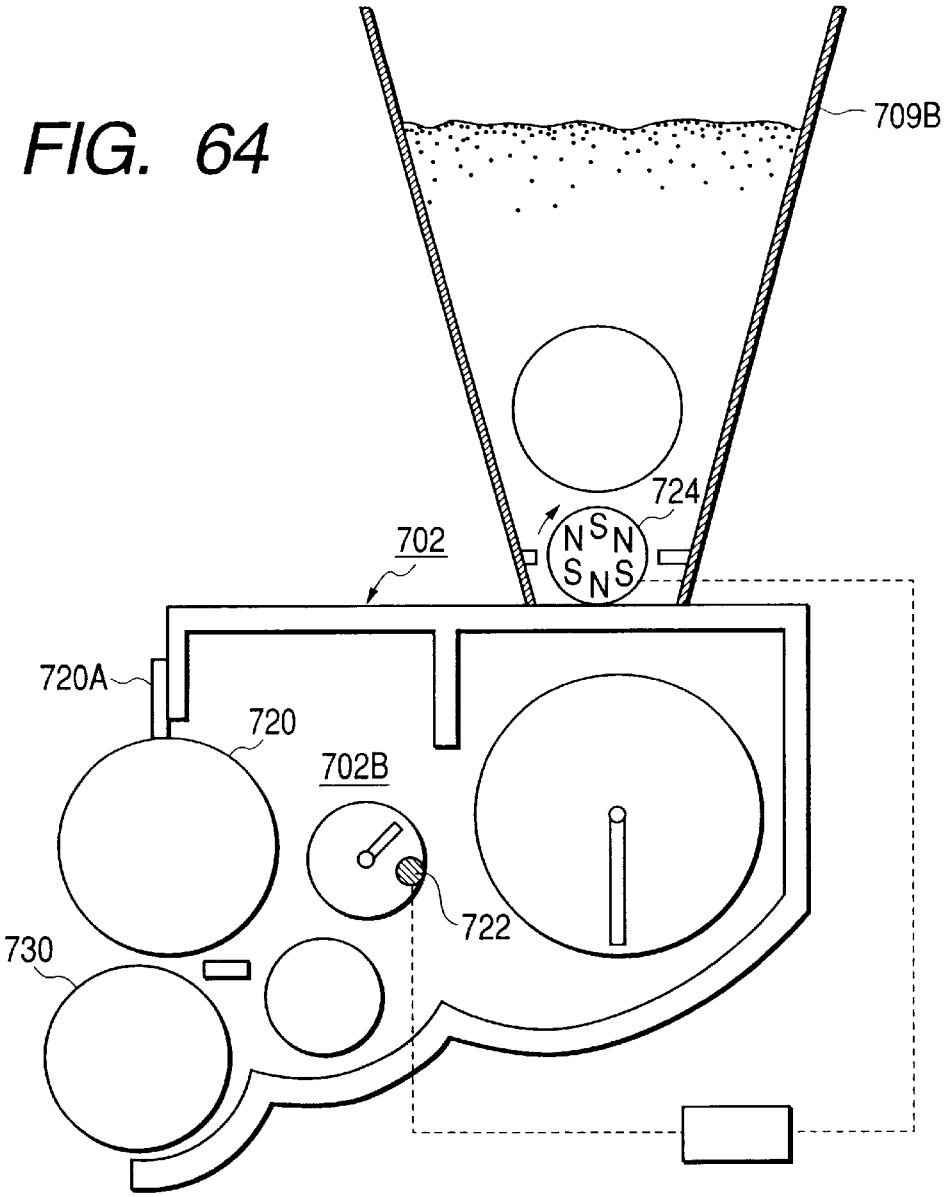
FIG. 64 is a cross-sectional view of a developing apparatus according to a sixteenth embodiment of the present invention.
Figure 65:
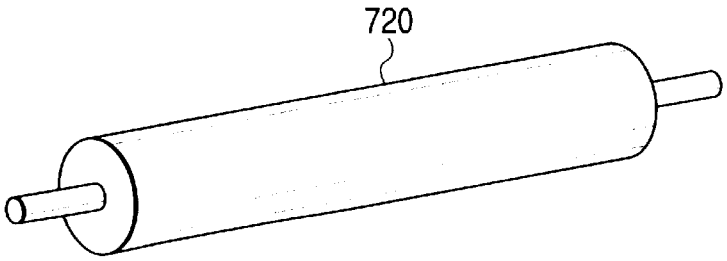
FIG. 65 is a perspective view of a developing sleeve in the developing apparatus according to the sixteenth embodiment of the present invention.

As is shown in FIG. 64, two developing sleeves 720 and 730 are provided as developer bearing members for the developing apparatus 702. The first developing sleeve 720 is formed by performing a blast process with FGB#600 (Rz 3.0 μm) for a non-magnetic member that has a diameter of ϕ30 mm and is made of aluminum A2017, and by plating the resultant member with Ni—P, as is shown in FIG. 65. Similarly, the second developing sleeve 730 is formed by performing a blast process with FGB#600 (Rz 3.0 μm) for a non-magnetic member that has a diameter of ϕ30 mm and is made of aluminum A2017, and by plating the resultant member with Ni—P. The Ni—P plating is performed to prevent the occurrence of sleeve ghost images at a sleeve cycle and to increase the durability of the surfaces of the developing sleeves (the film is formed to protect the Al surface). The Ni—P plated layer is a non-magnetic electroless plated layer that contains 7% of P in Ni.

A magnetic sealing member will now be described.

Figure 66:
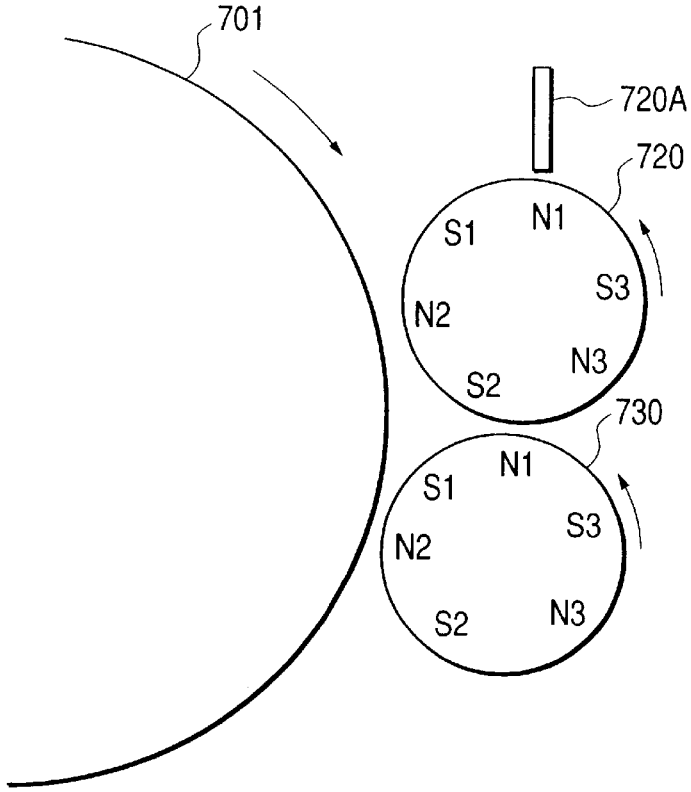
FIG. 66 is a cross-sectional view of the arrangement of the magnetic poles of the developing sleeves of the developing apparatus according to the sixteenth embodiment of the present invention.
Figure 67:
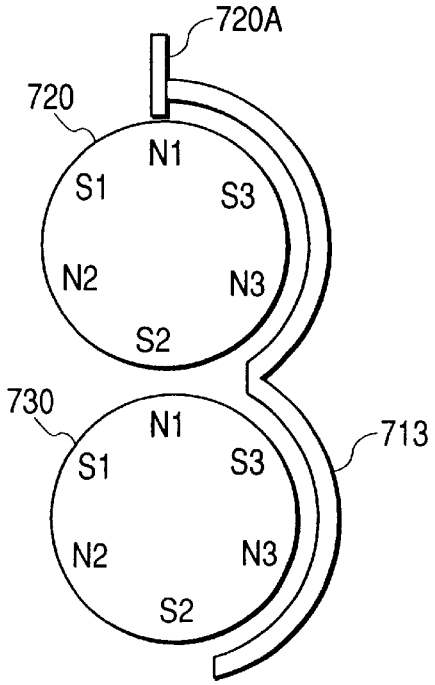
FIG. 67 is a diagram for explaining the locations of the developing sleeves and an end seal of the developing apparatus according to the sixteenth embodiment of the present invention.

As is shown in FIGS. 66 and 67, the first developing sleeve 720 and the second developing sleeve 730 have six internal magnetic poles (N1 to N3 and S1 to S3), and a magnetic sealing member 713 having the shape shown in FIG. 67 is provided along the external surfaces and near both ends of the sleeves 720 and 730. A gap between the developing sleeves 720 and 730 and the magnetic sealing member 713 is set to 420 μm=100 μm. The magnetic sealing member 713 is made of moldaroi (KN plated, magnetic permeability of 10.6) composed mainly of iron. The lengths of the first and the second magnets are set at 305 mm.

Figure 68:
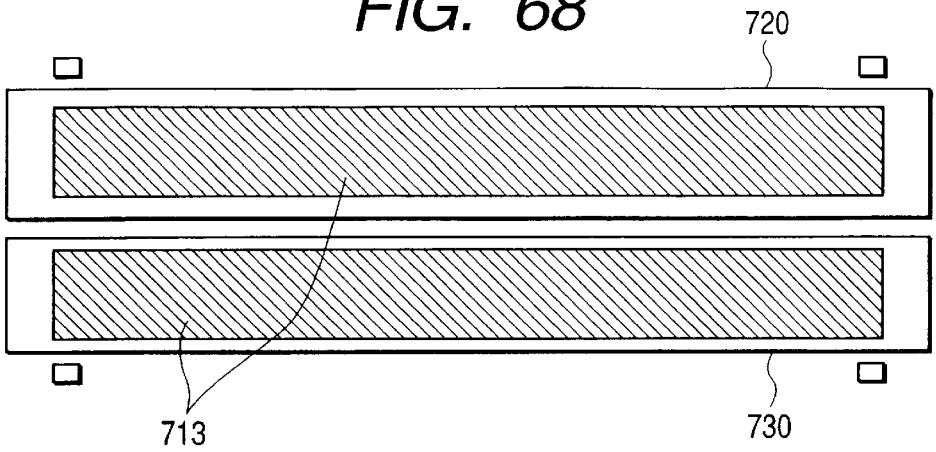
FIG. 68 is a diagram for explaining the locations of the developing sleeves and the end seal of the developing apparatus according to the sixteenth embodiment of the present invention.

For the appropriate positioning of the magnetic sealing member 713, it is most preferable that the outer ends of the magnets and those of the sealing member 713 correspond. This is because if the magnets extend out too far, beyond the area corresponding to that of the magnetic sealing member 713, an external longitudinal magnetic force will be produced, and accordingly, toner will be carried out too far and a leakage will occur. Conversely, if the ends of the magnets are withdrawn too far from an end of the magnetic sealing member 713, a magnetic brush, which originally is formed between the magnetic sealing member 713 and the magnets to prevent the leakage of toner, will be formed on a developing sleeve the width of the magnetic sealing member 713, even though no magnetic force is present at the outer end of the brush. Then, toner on the outside will leak out to the end, and at the same time the thickness of a toner layer will also be increased and cause toner to flake off. Since there is longitudinal play between the developing sleeves 720 and 730 and the magnets, while taking this into account the magnetic sealing member 713 is located 1 mm inside measured from the magnet ends, as is shown in FIG. 68.

A fixed magnet is incorporated in the first developing sleeve 720, which has a magnetic field pattern formed by the six poles (N1 to N3 and S1 to S3) shown in FIG. 66 and Table 41.

TABLE 41

| Magnet pole | Magnetic force (G) | Angle (°) | Half value width (°) |
|---|---|---|---|
| N1 | 950 | 0 | 36 |
| N2 | 950 | 60 | 46 |
| N3 | 550 | 220 | |
| S1 | 900 | 120 | |
| S2 | 500 | 175 | |
| S3 | 700 | 270 | |

The first developing sleeve 720 rotates at a speed 120% that to the photosensitive drum 701, and the thickness of the toner held on the developing sleeve 720 is controlled by a magnetic blade 720A. The gap S-$B_{gap}$ between the first developing sleeve 720 and the magnetic blade 720A is set at 250 μm, and the gap S-$D_{gap}$ between the sleeve 720 and the photosensitive drum 701 is set at 200 μm. A DC bias voltage of +400 V and an AC bias voltage, a rectangular wave $V_{pp}$ of 1200 V that has a frequency of 2.7 kHz, as is shown in FIG. 44, are applied to the first developing sleeve 720 to perform one-component non-contact magnetic development. Therefore, the developing contrast is 300 V in the toner dispersing direction, and the fog removal (toner returning) contrast is 100 V.

The second developing sleeve 730 is obtained by Ni—P plating on a non-magnetic member that has a diameter ϕ of 30 mm and is made of aluminum A2017. A magnet is provided internally for the second developing sleeve 730 and has a magnetic field pattern formed by the six poles (N1 to N3 and S1 to S3) shown in FIG. 66 and Table 42.

TABLE 42

| Magnet pole | Magnetic force (G) | Angle (°) | Half value width (°) |
|---|---|---|---|
| N1 | 900 | 330 | 36 |
| N2 | 950 | 30 | 46 |
| N3 | 500 | 190 | |
| S1 | 850 | 90 | |
| S2 | 500 | 145 | |
| S3 | 600 | 240 | |

A DC bias voltage of +200 V and an AC bias voltage, a rectangular wave $V_{pp}$ of 1400 V that has a frequency of 2.7 kHz, as is shown in FIG. 44, are applied to the second developing sleeve 730. Since the second developing sleeve 730 is the same as the first developing sleeve 720 and only one power source is required, the manufacturing costs can be reduced and only a small area is required for the power source.

The second developing sleeve 730 rotates at a speed 150% that of the photosensitive drum 701, and the gap S-$D_{gap}$ between the second developing sleeve 730 and the photosensitive drum 701 is set at 300 μm.

The magnetic blade 720A is plate-shaped magnetic blade of 1.0 mm thick, and the upstream developing sleeve 720 controls the thickness of the toner layer on the second developing sleeve 730. The distance between the first developing sleeve 720 and the second developing sleeve 730 is set at 300 μm. This distance value is required in order to equalize the amount of toner supplied to the first and the second developing sleeves 720 and 730. The amount of toner coating the developing sleeves 720 and 730 (M/S) is approximately 1.0 mg/cm$^2$. The distance S-$D_{gap}$ between the second developing sleeve 730 and the photosensitive drum 701 is 200 μm. Equalization of the amount of toner supplied per unit time is the most important factor contributing to the matching of the development characteristics of the developing sleeves and to the stabilizing of the image tones.

Figure 69:
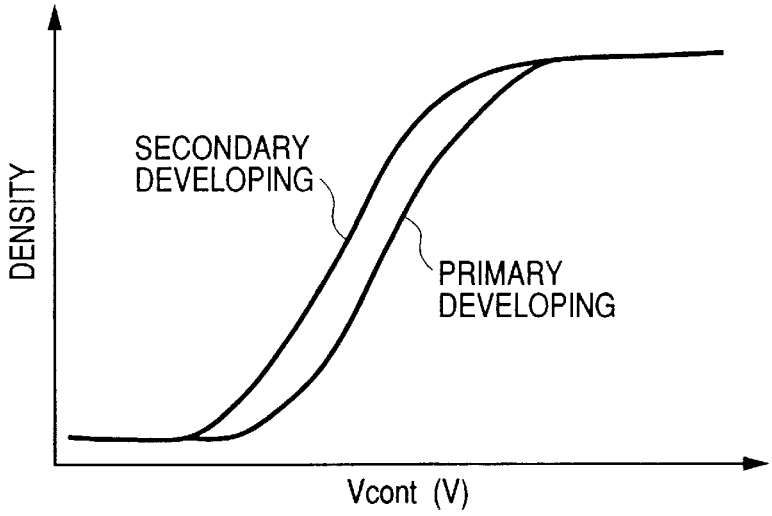
FIG. 69 is a graph showing the development characteristic of a conventional developing apparatus.

In order to satisfy requests for image tones and tone stability that can cope with current digital images and graphics, the most important factor is the matching of the development characteristics of the developing sleeves 720 and 730 (the first developing character and second developing character). The same amount of toner is supplied per unit time to the first and the second developing sleeves 720 and 730, the development pole of the first (primary) developing sleeve 720 is N2, while the development pole of the second (secondary) developing sleeve 730 is S1, and the magnetic force and the half-width are the same for both sleeves. While the peripheral speed is also the same for both sleeves, the development characteristic for the durability required for processing 30 k sheets differs for the two developing sleeves 720 and 730, as is shown in FIG. 69 (the upper line represents the secondary developing and the lower line represents the primary developing). These development characteristics will now be described.

Whereas for the first developing sleeve 720 the magnetic blade 720A is employed to control the toner, for the second developing sleeve 730 the first developing sleeve 720 is employed to control the toner, and the first developing sleeve 720 is rotated at the toner control portion of the second developing sleeve 730 in the direction opposite to the direction in which the toner is fed. Thus, the toner is forcefully compressed and rubbed between the second developing sleeve 730 and the first developing sleeve 720, and the friction charging capability of the toner is increased so that it is higher than when the toner is normally controlled by the magnetic blade. In other words, the triboelectricity (Q/M) produced for the secondary developing is higher than that produced for the primary developing.

Generally, since the development characteristic depends on the triboelectricity (Q/M)×the amount of supplied toner (M/S), a difference in the triboelectricity (Q/M) appears on a V-D curve as a difference in the development characteristic, as is shown in FIG. 69. This trend is outstanding when a satisfactory development time, such as is provided by a fast image forming apparatus having a processing speed of 400 mm/s or more, can not be obtained, and when the rotational speed of the developing sleeve is high and the force exerted on the toner by friction is strong at the toner layer control member. The difference in triboelectricity causes a difference in the development characteristic (case of 30 k sheets) in FIG. 69.

The service life of a developing sleeve, which is the second problem, will now be described.

The developing apparatus 702 in this invention is compactly designed because no member is provided between the developing sleeves 720 and 730. With this arrangement, the toner on the first developing sleeve 720 is controlled by the magnetic blade 720A, and then the toner on the second developing sleeve 730 is controlled by the first developing sleeve 720. That is, while the first developing sleeve 720 is rotated once, it accepts mechanical sharing of the toner twice, but the second developing sleeve 730 accepts the mechanical share once at the control portion. That is, as far as durability of image forming is concerned, the surface of the first developing sleeve 720 receives approximately twice the shares accepted by the surface of the second developing sleeve, i.e., more shares are received by the first developing sleeve 720 at the toner layer control portion. As more shares are received, the sleeve contamination is worse. For this reason the coating life (sleeve life) differs for the first developing sleeve 720 and for the second developing sleeve 730. As a result, one developing sleeve will have to be replaced even though the service life of the other developing sleeve has not yet expired, and thus when the other sleeve is replaced later, the costs associated with the servicing provided by a maintenance man are is increased. Therefore, what is required is the equalization of the service lives of developing sleeves.

This embodiment is carried out while taking the above problem into account.

In Table 43 is shown Δa, the thickness of an Ni—P film, Q/M, M/S, and (Q/M)×(M/S) for a comparison example.

TABLE 43

| | First (upstream) | | Second (downstream) | |
|---|---|---|---|---|
| Δa | 0.04 | | 0.08 | |
| Ni P-film thickness (μm) | 20 | | 10 | |
| Q/M | 1k | 50k | 1k | 50k |
| (μc/g) | 8.7 | 8.0 | 9.0 | 8.3 |
| M/S | 1k | 50k | 1k | 50k |
| (mg/cm$^2$) | 0.98 | 0.97 | 0.97 | 0.96 |
| Q/M × M/S | 1k | 50k | 1k | 50k |
| | 8.5 | 7.8 | 8.7 | 8.0 |

As is shown in Table 43, for a durability of 50 k sheets, the development differs in consonance with the deterioration of toner and sleeve contamination. Due to the difference in the triboelectricity, Q/M (the triboelectricity)×(M/S), which is the indicator for development, differs from the beginning, i.e., 7.9 for the first and 8.7 for the second developing sleeves. After the durability process for 50 k sheets, Q/M×M/S was overall low due to a difference in sleeve contamination, i.e., 6.6 for the first and 8.0 for the second developing sleeves. As a result, a great difference appears between the primary developing and the secondary developing.

Whereas, in this embodiment, the arrangement in Table 44 was employed to resolve the above problem. The value Δa (the average inclination), which is the surface shape factor, was set so it was smaller upstream than downstream. For this method, the Ni—P plated layer formed on the surface of the upstream developing sleeve was thicker than the one formed on the surface of the downstream developing sleeve. As a result, the difference in the development characteristics was removed and the service lives of the sleeves was equalized.

By using Ni—P plating, the value Δa can be set so it is to equal to or lower than the 0.1 that is effective for the prevention of contamination. As the film thickness is increased, the value of Δa is gradually reduced, and when the film thickness is equal to or greater than 50 μm, Δa converges at approximately 0.01. This means that during the manufacturing process it is difficult to obtain a smaller Δa value. Therefore, the effective manufacturing range for Δa is 0.01 to 0.1.

The effects obtained in this embodiment are shown in Table 44.

TABLE 44

| | First (upstream) | | Second (downstream) | |
|---|---|---|---|---|
| Δa | 0.04 | | 0.08 | |
| Ni P-film thickness (μm) | 20 | | 10 | |
| Q/M | 1k | 50k | 1k | 50k |
| (μc/g) | 8.7 | 8.0 | 9.0 | 8.3 |
| M/S | 1k | 50k | 1k | 50k |
| (mg/cm$^2$) | 0.98 | 0.97 | 0.97 | 0.96 |
| Q/M × M/S | 1k | 50k | 1k | 50k |
| | 8.5 | 7.8 | 8.7 | 8.0 |

First, relative to the sleeve service life, which is the number of sheets that can be processed before the image density on a sheet falls below 1.2, the service life for the second developing sleeve 730 was 960 k sheets, and the service life for the first developing sleeve 720 was substantially the same, i.e., 920 k sheets, while the conventional service life was 630 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

Second, concerning the triboelectricity (Q/M), since the faster developing sleeve was deteriorated due to mechanical share and there was more deterioration of durability due to sleeve contamination, the charging of the deteriorated sleeve with toner could be increased, and a triboelectricity level could be maintained that prevented contamination. In other words, the triboelectricity (Q/M) of the fast developing sleeve could be always higher than the triboelectricity of the slow developing sleeve.

Figure 70:
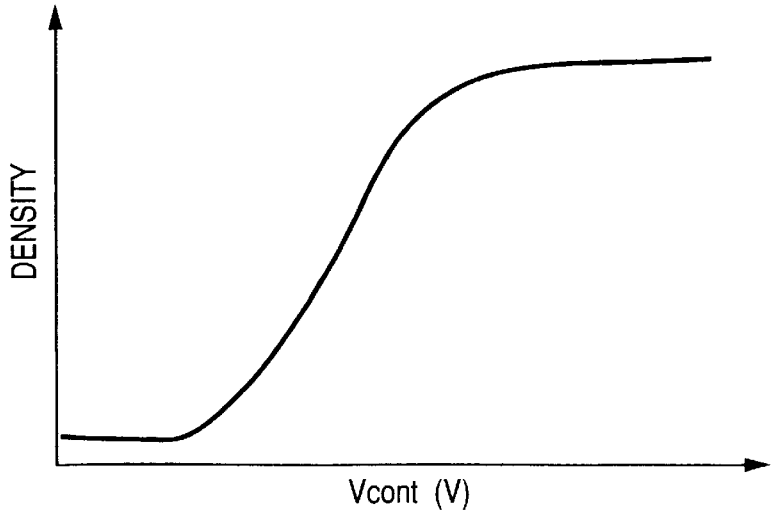
FIG. 70 is a graph showing the development characteristic of the developing apparatus according to the present invention.

Since the second developing sleeve was controlled by the first developing sleeve, and the first developing sleeve was rotated at the toner control portion in a direction opposite to that in which the toner was fed, a difference in triboelectricity (Q/M) levels occurred between the primary developing and the secondary developing. This difference was 8.7 and 9.0 μC/g in the initial state, and 8.0 and 8.3 μC/g after 50 k sheets were output, values that are substantially the same. As is apparent from the relationship between Δa and Q/M in FIG. 56, the employed characteristic was that as Δa was increased, the triboelectricity (Q/M) was reduced, while as Δa was reduced, the triboelectricity (Q/M) was increased. As a result, the triboelectricity (Q/M)×M/S, which is the indicator of the development characteristic, can be substantially the same, i.e., 8.5 and 8.7 in the initial state and 7.8 and 8.0 after processing of 50 k sheets. Therefore, while as shown in FIG. 69 the V-D curves, which are the development characteristics, conventionally differ, V-D curves can be obtained that are substantially the same, as is shown in FIG. 70 (it should be noted that, since the deterioration is small in the initial state, the development is very high and a difference in Q/M does not appear as a density difference). As a result, the image tones and tone stability can be controlled, and the service lives of the developing sleeves can be equalized.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

<Seventeenth Embodiment>

A seventeenth embodiment of the present invention will now be described.

The image forming apparatus for this embodiment is the same as that for the sixteenth embodiment.

The feature of the eleventh embodiment is the saving of space by further reducing the size of a developing sleeve. Featured in this embodiment is not only the thickness of an Ni—P plated film but also the method used to process an underlayer before plating. If the charging of a developing sleeve having a greater outer diameter is enhanced and contamination of the sleeve is reduced, the charging enhancement and the contamination reduction must be even greater for a developing sleeve having a smaller diameter. According to the feature of this embodiment, to reduce the value of Δa, not only the thickness of the film is adjusted, but also a diamond polishing process is performed for the film in advance. After the diamond polishing, a normal blast process using FGB is performed.

A developing apparatus 702 according to this embodiment will now be described in detail.

A negative, one-component magnetic toner is employed as a developer. As is shown in FIG. 64, two developing sleeves 720 and 730 are provided as developer bearing members for the developing apparatus 702. The first developing sleeve 720 is formed by performing a blast process using FGB#600 for a non-magnetic member that has a diameter ϕ of 20 mm and is made of aluminum A2017, and by then Ni—P plating for the resultant non-magnetic member. Similarly, the second developing sleeve 730 is formed by performing a blast process using FGB#600 for a non-magnetic member that has a diameter ϕ of 20 mm and is made of aluminum A2017. The surface of the resultant sleeve is finished like a mirror by diamond polishing, and the obtained sleeve is processed by then Ni—P plating. The film coating is performed in order to prevent the occurrence of sleeve ghost images during sleeve cycles, and to increase the durability of the sleeve surface.

The first developing sleeve 720 rotates at a speed that is 150% that of the photosensitive drum 701, and the thickness of the toner held on the developing sleeve 720 is controlled by a magnetic blade 720A. The gap S-$B_{gap}$ between the magnetic blade 720A and the first developing sleeve 720 is set at 250 μm, and the gap S-$D_{gap}$ between the sleeve 720 and the photosensitive drum 701 is set at 200 μm. A DC bias voltage of +400 V and an AC bias voltage, a rectangular wave $V_{pp}$ of 1200 V that has a frequency of 2.5 kHz, as is shown in FIG. 44, are applied to the first developing sleeve 720 to perform one-component non-contact magnetic development. Therefore, the developing contrast is 300 V in the toner dispersing direction, and the fog removal (toner return) contrast is 100 V.

The second developing sleeve 730 is obtained by diamond polishing for a non-magnetic member that has a diameter ϕ of 20 mm and is made of aluminum A2017 and by performing blast process and Ni—P plating for the resultant sleeve. A DC bias voltage of +400 V and an AC bias voltage, a rectangular wave $V_{pp}$ of 1200 V that has a frequency of 2.5 kHz, as is shown in FIG. 44, are applied to the second developing sleeve 730. Since the second developing sleeve 730 is the same as the first developing sleeve 720 and since only one power source is required, the manufacturing costs can be reduced and only a small area is required for the power source. The second developing sleeve 730 rotates at a speed that is 150% that of the photosensitive drum 701, and the magnetic blade 730A is employed to control the thickness of a toner layer. The gap S-$B_{gap}$ between the magnetic blade 730A and the second developing sleeve 730 is set at 250 μm, and the gap S-$D_{gap}$ between the developing sleeve 730 and the photosensitive drum 701 is set at 200 μm. The magnetic blades 720A and 730A are the same as those for the sixteenth embodiment.

The features of this embodiment will now be described.

In this embodiment, the thickness of an Ni—P plated film was changed, the diamond polishing process was performed for the underlayer of the sleeve having the smaller diameter, and the blast process was performed for the resultant sleeve. The merit of diamond polishing is that it removes super-micro unevenness and smoothes the surface, while overall, large raised and recessed portions are maintained.

In Table 45 is shown Δa, the thickness of an Ni—P film, Q/M, M/S, and Q/M (the triboelectricity)×(M/S) for a comparison example.

TABLE 45

| | First (upstream) | | Second (downstream) | |
|---|---|---|---|---|
| Δa | 0.08 | | 0.08 | |
| Ni-P film thickness (μm) | 10 | | 10 | |
| Diamond polishing | Yes | | No | |
| Q/M | 1k | 50k | 1k | 50k |
| (μc/g) | 8.0 | 6.5 | 9.0 | 8.3 |
| M/S | 1k | 50k | 1k | 50k |
| (mg/cm²) | 0.97 | 0.96 | 0.97 | 0.96 |
| Q/M × M/S | 1k | 50k | 1k | 50k |
| | 7.8 | 6.2 | 8.7 | 8.0 |

As is shown in Table 45, for a durability of 50 k sheets, the development differs in consonance with the deterioration of toner and sleeve contamination. Q/M (the triboelectricity)×(M/S), which is the indicator for development, is 7.8 and 8.7 in the initial state, and 6.2 and 8.0 after the durability process. As a result, a great difference appears between the primary developing and the secondary developing.

Whereas, in this embodiment, the arrangement in Table 46 was employed to resolve the above problem. The value Δa (the average inclination), which is the surface shape factor, was set so it was greater for the developing sleeve that was rotating faster than for the developing sleeve that was rotating more slowly. For this method, the Ni—P plated layer formed on the surface of the developing sleeve having the smaller outer diameter was thicker than the one formed on the surface of the developing sleeve having the larger outer diameter. As a result, the difference in the development characteristics was removed and the service lives of the sleeves was equalized.

The effects obtained in this embodiment are shown in Table 46.

TABLE 46

| | First (upstream) | | Second (downstream) | |
|---|---|---|---|---|
| Δa | 0.03 | | 0.08 | |
| Ni-P film thickness (μm) | 20 | | 10 | |
| Diamond polishing | Yes | | No | |
| Q/M | 1k | 50k | 1k | 50k |
| (μc/g) | 9.1 | 8.4 | 9.0 | 8.3 |
| M/S | 1k | 50k | 1k | 50k |
| (mg/cm²) | 0.97 | 0.96 | 0.97 | 0.96 |
| Q/M × M/S | 1k | 50k | 1k | 50k |
| | 8.8 | 8.1 | 8.7 | 8.0 |

First, relative to the sleeve service life, which is the number of sheets that can be processed before the image density on a sheet falls below 1.2, the service life for the second developing sleeve 730 was 810 k sheets, and the service life for the first developing sleeve 720 was substantially the same, i.e., 800 k sheets, while the conventional service life was 500 k sheets. This is because, as previously mentioned, the property shown in FIG. 54 was present. The characteristic that was employed was the one whereby as the value of Δa was increased, contamination of a sleeve surface occurred more easily, while as the value of Δa was reduced, the contamination of the sleeve surface was reduced until it was minimal.

Since the second developing sleeve was controlled by the first developing sleeve, and the first developing sleeve was rotated at the toner control portion in a direction opposite to that in which the toner was fed, a difference in triboelectricity (Q/M) levels occurred between the primary developing and the secondary developing. This difference was 9.1 and 9.0 μC/g in the initial state, and 8.4 and 8.3 μC/g after 50 k sheets were output, values that are substantially the same. As a result, the triboelectricity (Q/M)×M/S, which is the indicator of the development characteristic, can be substantially the same, and while the V-D curves that are the development characteristics conventionally differ, V-D curves can be obtained that are substantially the same. Therefore, the image tones and tone stability can be controlled, the service lives of the developing sleeves can be equalized, and the space required can be reduced.

With the above arrangement, in a developing apparatus that constitutes a developing system for a fast image forming apparatus and that has a plurality of developing sleeves, which is the first objective, differences in the development of the developing sleeves can be prevented, and requests can be satisfied for image tones and for tone stability that can cope with recent digital images and graphics. In addition, in a developing apparatus that has a plurality of developing sleeves, the service lives of the developing sleeves can be equalized, which is the second objective, and maintenance costs can be reduced by eliminating some of the labor for which a maintenance man is required. Furthermore, a stable developing apparatus can be obtained that generates no sleeve ghost images and provides a high density.

In addition, a developing apparatus having a service life of 800,000 sheets can be provided wherein, as the third objective, the image density is stable and high, relative to high processing speed, and the required space is reduced.

<Eighteenth Embodiment>

An eighteenth embodiment of the present invention will now be described.

The feature of this embodiment is that the developing apparatus according to this invention is employed for a reuse image forming apparatus.

The developing apparatus in this embodiment employs developing sleeves for which Ni—P plating is performed, as well as in the seventeenth embodiment, and the diameter of both sleeves is ϕ20 mm.

The effects obtained in this embodiment are shown in Table 47.

TABLE 47

| | First (upstream) | | Second (downstream) | |
|---|---|---|---|---|
| Δa | 0.02 | | 0.06 | |
| Ni-P film thickness (μm) | 30 | | 15 | |
| Diamond polishing | Yes | | No | |
| Q/M | 1k | 50k | 1k | 50k |
| (μc/g) | 8.5 | 8.1 | 8.6 | 8.2 |
| M/S | 1k | 50k | 1k | 50k |
| (mg/cm$^2$) | 0.96 | 0.95 | 0.96 | 0.95 |
| Q/M × M/S | 1k | 50k | 1k | 50k |
| | 8.2 | 7.7 | 8.3 | 7.8 |

With this arrangement, it is apparent that, because of the durability, it is difficult to contaminate even the reuse toner that is highly cohesive, and the triboelectricity level can be maintained.

On the first developing sleeve the thickness of the Ni—P plated film was 30 μm, while on the second developing sleeve the thickness of the Ni—P plated film was 15 μm and the diamond polishing process was performed before the blast process. As a result, the service lives of the two sleeves could be equalized. This means that even though the reuse waste toner was coagulated, the conventional service life of 400 k sheets was extended to about 700 k sheets.

In addition, concerning the triboelectricity (Q/M), even though there was deterioration of the fast developing sleeve due to a mechanical share, the charging with the toner of the deteriorated sleeve could be increased. That is, the triboelectricity (Q/M) of the first developing sleeve was substantially the same as that of the second developing sleeve. Therefore, in the reuse system for which the overall was charge low, the value of Q/M (the triboelectricity×the amount of supplied toner (M/S), which was the indicator for the development characteristic, was substantially equal, and as a result, the V-D curves, which were the development characteristics, were substantially the same. As a result, a reuse system can be provided for which the image tones and tone stability can be controlled, and the service lives of the developing sleeves can be equalized.

With the above arrangement, in a developing apparatus, which is a reuse developing system, that has a plurality of developing sleeves, which is the first objective, differences in the development of the developing sleeves can be prevented, and requests can be satisfied for image tones and tone stability that can cope with recent digital images and graphics. In addition, in a developing apparatus that has a plurality of developing sleeve, the service life of each developing sleeve can be equalized, which is the second objective, and the maintenance costs can be reduced by eliminating some of the labor for which a maintenance man is required. Furthermore, a stable developing apparatus can be obtained that provides a high density.

In addition, a developing apparatus having a superior reuse environment can be provided wherein, as the third objective, the image density is stable and high relative to a high processing speed, and the space required is reduced.

As is apparent from the above explanation, according to the above embodiments, requests can be satisfied for image tones and the tone stability that can cope with recent digital images and graphics.

Furthermore, since the service lives of the developer bearing members are equalized, some of the labor for which a maintenance man is required is eliminated, and maintenance costs are reduced.

In addition, the occurrence of a sleeve ghost image can be prevented, and stable development and density can be provided relative to increase of the process speed.

What is claimed is:

1. A developing apparatus comprising:

a first developer bearing member for developing a latent image formed on an image bearing member; and a second developer bearing member, provided on a downstream side of said image bearing member from said first developer bearing member, for developing the latent image formed on said image bearing member;

wherein said first developer bearing member and said second developer bearing member include a non-magnetic member and a coating member that covers said non-magnetic member, and a ratio P/B of weight P of a pigment member to weight B (Kgw) of a resin contained in said coating member of said second developer bearing member is greater than a ratio P/B of weight P of a pigment member to weight B (Kgw) of a resin contained in said coating member of said first developer bearing member.

2. A developing apparatus according to claim 1, wherein said resin is phenol resin or epoxy resin.

3. A developing apparatus according to claim 1, wherein said pigment member has at least one of a conductive carbon, crystalline graphite and titanium oxide.

4. A developing apparatus comprising:

a first developer bearing member for developing a latent image formed on an image bearing member; and a second developer bearing member, having a moving speed larger than a moving speed of said first developer bearing member, for developing the latent image formed on said image bearing member;

wherein said first developer bearing member and said second developer bearing member include a non-magnetic member and a coating member that covers said non-magnetic member, and a ratio P/B of weight P of a pigment member to weight B (Kgw) of a resin contained in said coating member of said second developer bearing member is smaller than a ratio P/B of weight P of a pigment member to weight B (Kgw) of a resin contained in said coating member of said first developer bearing member.

5. A developing apparatus according to claim 4, wherein said resin is phenol resin or epoxy resin.

6. A developing apparatus according to claim 4, wherein said pigment member has at least one of a conductive carbon, crystalline graphite and titanium oxide.

7. A developing apparatus comprising:

a first developer bearing member for developing a latent image formed on an image bearing member; and a second developer bearing member, having an outer diameter smaller than an outer diameter of said first developer bearing member, for developing the latent image formed on said image bearing member;

wherein said first developer bearing member and said second developer bearing member include a non-magnetic member and a coating member that covers said non-magnetic member, and a ratio P/B of weight P of a pigment member to weight B (Kgw) of a resin contained in said coating member of said second developer bearing member is smaller than a ratio P/B of weight P of a pigment member to weight B (Kgw) of a resin contained in said coating member of said first developer bearing member.

8. A developing apparatus according to claim 7, wherein said resin is phenol resin or epoxy resin.

9. A developing apparatus according to claim 7, wherein said pigment member has at least one of a conductive carbon, crystalline graphite and titanium oxide.

10. A developing apparatus comprising:

a first developer bearing member for developing a latent image formed on an image bearing member; and a second developer bearing member, having a moving speed larger than a moving speed of said first developer bearing member, for developing the latent image formed on said image bearing member;

wherein said first developer bearing member and said second developer bearing member include a non-magnetic member and a coating member that covers said non-magnetic member, and Δa (an average inclination) that is a surface shape factor of said second developer bearing member is smaller than Δa (an average inclination) that is a surface shape factor for said first developer bearing member.

11. A developing apparatus according to claim 10, wherein said coating member has an Ni—P plating member, an Ni—B plating member or a Cr plating member.

12. A developing apparatus according to claim 10, wherein a thickness of said coating member for said second developer bearing member is greater than a thickness of said coating member for said first developer bearing member.

13. A developing apparatus according to claim 10, wherein a surface of said non-magnetic member is polished by diamond.

14. A developing apparatus according to claim 10, wherein a surface shape factor Δa (an average inclination) of said first developer bearing member and said surface shape factor Δa (an average inclination) of said second developer bearing member are both equal to or greater than 0.01 and equal to or smaller than 0.1.

15. A developing apparatus comprising:

a first developer bearing member for developing a latent image formed on an image bearing member; and a second developer bearing member, having an outer diameter smaller than an outer diameter of said first developer bearing member, for developing the latent image formed on said image bearing member;

wherein said first developer bearing member and said second developer bearing member include a non-magnetic member and a coating member that covers said non-magnetic member, and Δa (an average inclination) that is a surface shape factor of said second developer bearing member is smaller than Δa (an average inclination) that is a surface shape factor for said first developer bearing member.

16. A developing apparatus according to claim 15, wherein said coating member has an Ni—P plating member, an Ni—B plating member or a Cr plating member.

17. A developing apparatus according to claim 15, wherein a thickness of said coating member for said developer bearing member having a smaller outer diameter is greater than a thickness of said coating member for said developer bearing member having a larger outer diameter.

18. A developing apparatus according to claim 15, wherein a surface of said non-magnetic member is polished by diamond.

19. A developing apparatus according to claim 15, wherein a surface shape factor Δa (an average inclination) of said first developer bearing member and said surface shape factor Δa (an average inclination) of said second developer bearing member are both equal to or greater than 0.01 and equal to or smaller than 0.1.

20. A developer apparatus comprising:

a first developer bearing member for developing a latent image formed on an image bearing member; and a second developer bearing member, provided on downstream side of a moving direction of said image bearing member from said first developer bearing member, for developing the latent image formed on said image bearing member;

wherein said first developer bearing member and said second developer bearing member include a non-magnetic member and a coating member that covers said non-magnetic member, and Δa (an average inclination) that is a surface shape factor of said second developer bearing member is smaller than Δa (an average inclination) that is a surface shape factor for said first developer bearing member.

21. A developing apparatus according to claim 20, wherein said coating member has an Ni—P plating member, an Ni—B plating member or a Cr plating member.

22. A developing apparatus according to claim 20, wherein a thickness of said coating member for said upstream developer bearing member is greater than a thickness of said coating member for said downstream developer bearing member.

23. A developing apparatus according to claim 20, wherein a surface of said non-magnetic member is polished by diamond.

24. A developing apparatus according to claim 20, wherein a surface shape factor Δa (an average inclination) of said first developer bearing member and said surface shape factor Δa (an average inclination) of said second developer bearing member are both equal to or greater than 0.01 and equal to or smaller than 0.1.

25. A developing apparatus according to claim 20, wherein a thickness of a developer layer of said second developer bearing member is regulated by said first developer bearing member.

* * * * *

UNITED STATES PATENT AND TRADEMARK OFFICE

CERTIFICATE OF CORRECTION

PATENT NO. : 6,269,235 B1
DATED : July 31, 2001
INVENTOR(S) : Kazushige Nishiyama It is certified that error appears in the above-identified patent and that said Letters Patent is hereby corrected as shown below:

Column 3,
Line 55, 22A, 22B, 22C and 22D" should read -- 22A to 22D --.

Column 4,
Line 60, "47A, 47B, 47C and 47D" should read -- 47A to 47D --.

Column 5,
Line 7, "a" (second occurrence) should read -- $\Delta a$ --.

Column 7,
Line 52, "sleeve" should read -- sleeves --.

Column 8,
Line 55, "is" should read -- is a -- and "blades" should read -- blade --;
Line 56, "upstream" should read -- first --; and
Line 62, "30" should read -- 30. --.

Column 9,
Line 7, "30" should read -- 30. --;
Line 38, "can not" should read -- cannot --; and
Line 51, "30" should read -- 30. --.

Column 10,
Line 3, "is" should be deleted.

Column 12,
Line 28, "$V_{pp}$," should read -- $V_{pp}$ --.

Column 13,
Line 23, "smaller" should read -- is smaller --.

Column 14,
Line 53, "maintenance free" should read -- being maintenance-free --.

UNITED STATES PATENT AND TRADEMARK OFFICE

CERTIFICATE OF CORRECTION

PATENT NO. : 6,269,235 B1
DATED : July 31, 2001
INVENTOR(S) : Kazushige Nishiyama It is certified that error appears in the above-identified patent and that said Letters Patent is hereby corrected as shown below:

Column 15,
Line 48, "of" (first occurrence) should be deleted; and
Line 51, "share," should read -- shear, --.

Column 17,
Line 32, "member." should read -- member. --.

Column 19,
Line 38, "22A, 22B, 22C and 22D." should read -- 22A to 22D. -- and "22A, 22B" should read -- 22A to 22D --; and
Line 39, "22C and 22D" should be deleted; and
Line 47, "by," should read -- by --.

Column 24,
Line 56, "maintenance free" should read -- being maintenance-free --.

Column 25,
Line 56, "of" (first occurrence) should be deleted.

Column 27,
Line 20, "524is" should read -- 524 is --.

Column 29,
Line 31, "is" (first occurrence) should be deleted.

Column 34,
Line 12, "maintenance free," should read -- being maintenance-free, --; and
Line 52, "621B" (first occurrence) should read -- 621A -- and "magnet" should read -- magnetic --.

Column 35,
Line 16, "of" (first occurrence) should be deleted.

Column 38,
Line 28, "on e" should read -- one --.

UNITED STATES PATENT AND TRADEMARK OFFICE

CERTIFICATE OF CORRECTION

PATENT NO. : 6,269,235 B1
DATED : July 31, 2001
INVENTOR(S) : Kazushige Nishiyama It is certified that error appears in the above-identified patent and that said Letters Patent is hereby corrected as shown below:

Column 39,
Line 34, "47A, 47B, 47C, and 47D." should read -- 47A to 47D. -- and "47A," (second occurrence) should read -- 47A --;
Line 35, "47B, 47C and 47D" should read -- to 47D --; and
Line 52, "(MiS)" should read -- (M/S) --.

Column 40,
Lines 15 and 54, "can not" should read -- cannot --; and
Line 35, "share" should read -- shear --; and Column 46,
Line 35, "maintenance free" should read -- being maintenance-free --; and
Line 41, "1500 V" should read -- 1500 $V_{pp}$ --.

Column 50,
Line 16, "of" should be deleted;
Line 36, " '100k" should read -- 100k --;
Line 41, "1" should read -- 100 --; and
Line 57, "to" should be deleted.

Column 53,
Line 8, "Diamong" should read -- Diamond --; and
Line 24, "1" should read -- 100 --.

Column 54,
Line 7, "triboelectricity" should read -- triboelectricity) --.

Column 55,
Line 6, "triboelectricity" should read -- triboelectricity) --;
Line 20, "sleeve," should read -- sleeves --; and
Line 57, "μm=100" should read -- μm±100 --.

Column 57,
Line 62, "can not" should read -- cannot --.

UNITED STATES PATENT AND TRADEMARK OFFICE

CERTIFICATE OF CORRECTION

PATENT NO. : 6,269,235 B1
DATED : July 31, 2001
INVENTOR(S) : Kazushige Nishiyama It is certified that error appears in the above-identified patent and that said Letters Patent is hereby corrected as shown below:

Column 58,
Line 25, "is" should be deleted;
Table 43, "Ni P-film" should read -- Ni-P film --; and
Line 66, "to" should be deleted.

Column 59,
Table 44, "Ni P-film" should read -- Ni-P film --.

Column 60,
Line 44, "then" should read -- the --; and
Line 50, "then" should read -- the --.

Column 63,
Line 36, "share," should read -- shear, --; and
Line 41, "triboelectricity" should read -- triboelectricity) --.

Signed and Sealed this

Second Day of July, 2002

*Attest:*

*Attesting Officer*

JAMES E. ROGAN
*Director of the United States Patent and Trademark Office*